US009366049B1

(12) United States Patent
Hui et al.

(10) Patent No.: US 9,366,049 B1
(45) Date of Patent: Jun. 14, 2016

(54) JET PROPELLED POOL CLEANER

(71) Applicants: Wing-Tak Hui, Hong Kong (CN); Andrew Matthew Hui, San Jose, CA (US); Wing-Kin Hui, Hong Kong (CN)

(72) Inventors: Wing-Tak Hui, Hong Kong (CN); Andrew Matthew Hui, San Jose, CA (US); Wing-Kin Hui, Hong Kong (CN)

(73) Assignee: ZHIBAO POOLS COMPANY, Dongguan, Guangdong (CN)

( * ) Notice: Subject to any disclaimer, the term of this patent is extended or adjusted under 35 U.S.C. 154(b) by 0 days.

(21) Appl. No.: 14/551,894

(22) Filed: Nov. 24, 2014

(51) Int. Cl.
*E04H 4/16* (2006.01)

(52) U.S. Cl.
CPC ..... *E04H 4/1663* (2013.01); *E04H 4/1654* (2013.01)

(58) Field of Classification Search
None
See application file for complete search history.

(56) References Cited

U.S. PATENT DOCUMENTS

| | | | | |
|---|---|---|---|---|
| 3,675,261 | A | 7/1972 | Burgess et al. | |
| 4,168,557 | A | 9/1979 | Rasch et al. | |
| 5,197,158 | A | 3/1993 | Moini | |
| 6,412,133 | B1 * | 7/2002 | Erlich et al. | 15/1.7 |
| 7,213,287 | B2 | 5/2007 | Hui | |
| 8,273,183 | B2 | 9/2012 | Erlich et al. | |
| 8,784,652 | B2 * | 7/2014 | Rief et al. | 210/167.16 |
| 9,032,575 | B2 | 5/2015 | Sebor et al. | |
| 2007/0157413 | A1 | 7/2007 | Roumagnac | |
| 2013/0030659 | A1 | 1/2013 | Porat et al. | |
| 2013/0146106 | A1 | 6/2013 | Erlich | |
| 2013/0269729 | A1 | 10/2013 | Erlich et al. | |
| 2014/0014140 | A1 * | 1/2014 | Correa | 134/34 |
| 2014/0076789 | A1 * | 3/2014 | Shlomi-Shlomi et al. | 210/195.1 |
| 2014/0262997 | A1 * | 9/2014 | Renaud et al. | 210/138 |

FOREIGN PATENT DOCUMENTS

| | | | |
|---|---|---|---|
| CN | 1244747 | C | 3/2006 |
| CN | 101666168 | B | 1/2011 |
| WO | WO/2011/100067 | A1 | 8/2011 |

OTHER PUBLICATIONS

U.S. Appl. No. 14/284,386, filed May 21, 2014, Wing-Tak Hui.
U.S. Appl. No. 14/331,164, filed Jul. 14, 2014, All Good Inc.
*Aqua Products, Inc.* v. *Intex Recreation Corp.* United States District Court, S.D. New York. No. 06 CV 1746(LAP), Jun. 5, 2007.
*Zodiac Pool Systems, Inc.* v. *Aqua Products, Inc.*: Final Written Decision IPR2013-00159. Paper 71. Aug. 22, 2014. APRIN. © 2014 Drinker Biddle & Reath LLP:. Published on the National Law Review (http://www.natlawreview.com).

* cited by examiner

*Primary Examiner* — Terry Cecil
(74) *Attorney, Agent, or Firm* — Bowen Liu; David Lewis

(57) ABSTRACT

A pool cleaner having two tilted pumps pointing in opposite directions, which propel the pool cleaner. In an embodiment, the pumps are turned on alternatively to alternate the direction of travel of the pool cleaner. In an embodiment, each pump has a discharge opening facing upwards at an angle, covered by an adjustable flap. The flap can be adjusted to open to different degrees to change the speed of the pool cleaner. The flap is attached to a ring that rotates and thereby rotates the angle of the orientation of the flap. Adjusting the angle of orientation of the flap of the pool cleaner changes the extent to which the pool cleaner moves sideways while moving forwards or the extent to which the pool cleaner turns.

29 Claims, 35 Drawing Sheets

300b

300c

700a

800a

800c

1200d

1200e

1300e

JET PROPELLED POOL CLEANER

FIELD

This specification generally relates to pool cleaners.

BACKGROUND

The subject matter discussed in the background section should not be assumed to be prior art merely as a result of its mention in the background section. Similarly, a problem and the understanding of the causes of a problem mentioned in the background section or associated with the subject matter of the background section should not be assumed to have been previously recognized in the prior art. The subject matter in the background section may merely represent different approaches, which in and of themselves may also be inventions.

Presently, there are various pool cleaners that can clean swimming pools by filtering the pool water and removing dirt debris and algae. There are various pools with different sizes and/or shapes. To clean various pools, pool cleaners need to move in the water across the entire floor of the pools.

BRIEF DESCRIPTION OF THE FIGURES

In the following drawings like reference numbers are used to refer to like elements. Although the following figures depict various examples of the invention, the invention is not limited to the examples depicted in the figures.

DETAILED DESCRIPTION

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

In general, at the beginning of the discussion of each of FIGS. 1A-9, 12A-13G, and 14 is a brief description of each element, which may have no more than the name of each of the elements in the one of FIGS. 1A-9, 12A-13G, and 14 that is being discussed. After the brief description of each element, each element is further discussed in numerical order. In general, each of FIGS. 1A-9, 12A-13G, and 14 is discussed in numerical order and the elements within FIGS. 1A-9, 12A-13G, and 14 are also usually discussed in numerical order to facilitate easily locating the discussion of a particular element. Nonetheless, there is no one location where all of the information of any element of FIGS. 1A-9, 12A-13G, and 14 is necessarily located. Unique information about any particular element or any other aspect of any of FIGS. 1A-9, 12A-13G, and 14 may be found in, or implied by, any part of the specification.

In various places in discussing the drawings a range of letters, such as a-n are used to refer to individual elements of various series of elements that are the same. In each of these series, the ending letters are integer variables that can be any number. Unless indicated otherwise, the number of elements in each of these series is unrelated to the number of elements in others of these series. Specifically, even though one letter (e.g. "c") comes earlier in the alphabet than another letter (e.g., "n"), the order of these letters in the alphabet does not mean that the earlier letter represents a smaller number. The value of the earlier letter is unrelated to the later letter, and may represent a value that is greater the same or less than the later letter.

Figure 1A:
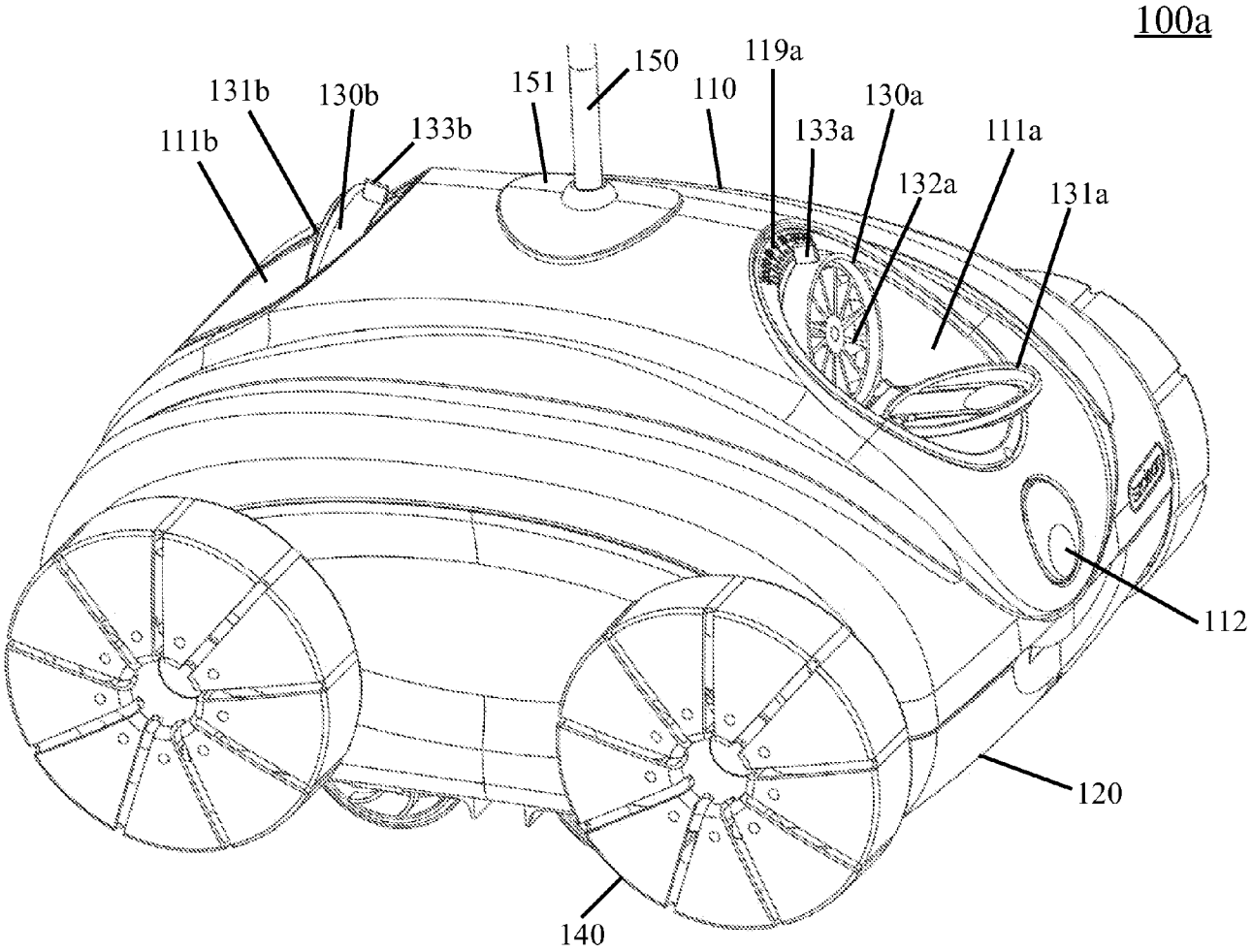
FIG. 1A shows a diagram of an embodiment of a pool cleaner.

FIG. 1A shows a diagram of an embodiment of a pool cleaner 100*a*. Pool cleaner 100*a* includes at least a head 110, a pair of discharge mounts 111*a* and 111*b*, a fastener 112, rotation markings 119*a*, a base 120, a pair of neck portions 130*a* and 130*b*, a pair of flaps 131*a* and 131*b*, a cover 132*a*, a pair of indicator tabs 133*a* and 133*b*, wheels 140, a power cord 150, and a cap 151. In other embodiments, pool cleaner 100*a* may not have all of the elements or features listed and/or may have other elements or features instead of or in addition to those listed.

Pool cleaner 100*a* is a cleaning machine that is propelled by two tilted pumps pointing in opposite directions, which pumps are turned on alternatively in order to propel the pool cleaner 100*a* in either direction to traverse the floor of a swimming pool or a water tank. In at least one embodiment, pool cleaner 100*a* traverses the floor of the pool making zigzag routes that eventually covers the entire floor of the pool to remove debris from the bottom of the pool. Generally, pool cleaner 100*a* is submerged and operated under water. When pool cleaner 100*a* is turned on, at least one of the two pumps within pool cleaner 100*a* is powered to create a water jet that pushes the pool cleaner 100*a* in a direction that is opposite the direction that pump that is on faces. To switch directions, the current pump that is on is turned off, and the other pump is turned on. In at least one embodiment, each pump faces a discharge opening pointing upwards at an angle, while each discharge opening includes a neck portion and an adjustable flap that is pivotally connected to the neck portion. Each flap may be closed to cover the discharge opening or may be pushed open at a predetermined angle, allowing pool water to exit pool cleaner 100*a*. The exiting pool water propels pool cleaner 100*a* along the pool floor. The exiting pool water also creates a downward force that keeps pool cleaner 100*a* on the floor of the pool while moving. In at least one embodiment, the speed of the pool cleaner 100*a* is adjustable by adjusting the angle that each flap is held open while pool cleaner 100*a* is propelled by the exiting pool water. In at least one embodiment, each neck portion may be rotated within a limited range causing the pool cleaner 100*a* to turn, adjusting the directions of movement of pool cleaner 100*a*. In at least one embodiment, when one pump is turned on and the other pump is turned off, the water inside the pool cleaner 100*a* is pushed out through the discharge opening facing the pump that is on. The water exiting the pool cleaner 100*a* pushes open the corresponding flap and bounces off the flap to propel pool cleaner 100*a* in the desired direction while holding the pool cleaner 100*a* on the floor of the pool. Consequently, the pump that pumps water out of the pool cleaner 100*a* creates a vacuum within the body, which causes the flap of the other pump to close and the pool water to flow into the body through an intake opening at the bottom of pool cleaner 100*a*. The water is then pushed out of the body of pool cleaner 100*a* by the pump that is on. In at least one embodiment, which one of the two pumps is turned on is controlled by a circuit. Which of the pumps is kept on alternates, so that pool cleaner 100*a* may move in one direction for a given period of time, and then reverses direction when the pump that is on is turned off and the pump that is off is turned on. As a result of at least one of the flaps being angled to the side, the pool cleaner 100*a* turns slightly when traveling in at least one direction, and pool cleaner 100*a* travels in a zigzag pattern across the entire floor of the pool (other patterns of travel are also possible). In at least one embodiment, at least a filter within the body of pool cleaner 100*a* blocks any debris in the water from passing through as the water flows in and out of the body, thereby filtering the water. The process is performed until the pool water is clean or until movement of pool cleaner 100*a* has covered the entire floor of the pool. In at least one embodiment, pool cleaner 100*a* is portable, is light enough, and is small enough that pool cleaner 100*a* may be put in and/or taken out from a pool by a single individual.

Head 110 is a top portion of the pool cleaner 100*a* that connects to a base to form the body of pool cleaner 100*a*. In at least one embodiment, head 110 includes a part of an approximately oval shaped top cover with two oval shaped openings in either end along longitudinal axis of the head 110, facing upward at an angle in approximately opposite directions (in other embodiments, the top cover may have other shapes). In at least one embodiment, head 110 includes at least two tilted pumps facing the oval shaped openings for pumping water out of the body of pool cleaner 100*a*. In at least one embodiment, two discharge mounts are mounted to the two oval shaped openings, into which two neck portions with adjustable flaps are connected. In at least one embodiment, a power cord is connected to the pool cleaner 100*a* through the top of the head 110, while at the other end connects to a power outlet such as an AC outlet for powering pool cleaner 100*a*. In at least one embodiment, head 110 is pivotally connected to the base of pool cleaner 100*a* and may be locked via a fastener such as a latch. In at least one embodiment, head 110 and/or the base may include a filter for removing debris and filtering pool water when pool cleaner 100*a* is on. In at least one embodiment, head 110 may include other structures and/or shapes.

Discharge mounts 111*a* and 111*b* are two mounting pieces that mount to the oval shaped openings of the head 110 for connecting and positioning two pumps within the body and facing outwards. In at least one embodiment, each of discharge mounts 111*a* and 111*b* includes a circular opening for connecting a neck portion and an oval shaped opening for mounting to the oval shaped openings of the head 110. In at least one embodiment, the circular opening and oval shaped opening have perimeters at one side that are proximal to (and may touch) each other, and the circular opening and oval shaped opening are connected via a partial cylindrical bracket. In at least one embodiment, neck portions are fitted into the circular openings of discharge mounts 111*a* and 111*b*, with the propellers of two pumps located in or facing towards the neck portions for pushing water out of the pool cleaner 100*a*. In at least one embodiment, the neck portions in the circular openings may rotate with respect to the axis of the circular openings of discharge mounts 111*a* and 111*b* within a limited range. In at least one embodiment, each of the discharge mounts 111*a* and 111*b* is open at the discharge side of each pump of the pool cleaner 100*a* so that water flowing in the direction that each pump faces and water flowing upwards is unobstructed.

In at least one embodiment, propellers of the pumps directly push water out of the pool cleaner 100*a* via discharge openings that the pumps face. In at least one embodiment, the pool cleaner 100*a* does not include any conduit for carrying the flow of water that is propelled by the pumps. In this specification a "conduit" is defined as "a pipe or tube through which something (such as water) passes" (see the Merriam-Webster Dictionary). In this specification a conduit is "a pipe suitable for carrying the flow of liquids and gases" (see Wiki Dictionary). In at least one embodiment, the water inside the body of the pool cleaner 100*a* directly exits the pool cleaner 100*a* through discharge openings, therefore no tubes or pipes, or structure similar to a tube or a pipe, are used in the pool cleaner 100*a* for carrying or directing the water flow.

Fastener 112 is a mechanical fastener, such as a latch, that holds the head 110 and the base to one another, closing and locking the two components together. Fastener 112 may have a clasp or hook portion that is located on the intake side of the head 110 that engages a receiving portion located on the base. The clasp or hook portion may have a spring mechanism, and may be pressed to release the fastener 112 for opening the body of the pool cleaner 100*a*. In at least one embodiment, the body of pool cleaner 100*a* may be opened by releasing fastener 112 to remove debris and/or clean the filter. In this specification, whenever one type of fastener is used another type of fastener may be substituted to obtain a different embodiment. For example, latches, screws, snaps, rivets, glue, adhesives, straps and/or tabs (that is, tabs that engage in slots), may be used for any of the fasteners in this specification. Latches, screws, snaps, rivets, tabs (tabs that engage in slots), glue, adhesives, and/or straps may be substituted one for another to obtain different embodiments. Also, many fasteners have two parts that interlock with one another to hold two pieces together, where one of the two parts of the fastener is attached to one piece and another of the two parts is attached to another piece. In this specification, which piece is attached to which part may be reversed to obtain a different embodiment. For example, if a top piece has a slot and a bottom piece has a latch that interlock with the slot, whether the top piece has the slot and the bottom piece has the latch may be reversed from that which is shown in the drawings to obtain another embodiment.

Rotation markings 119*a* are markings on the discharge mount 111*a* above the circular opening to be viewed in conjunction with an indicator tab for indicating the rotational angle of the neck portion. In at least one embodiment, rotation markings 119*a* include numerical markings from zero degrees until 30 degrees. In an embodiment, the zero degrees marking is in the middle of the markings and there are two 30 degrees markings—one on each side of the zero degrees marking (which are each at thirty degrees away from the zero degrees marking). In at least one embodiment, rotation markings 119*a* may include other numbers and/or letters marking the positions. In at least one embodiment, rotation markings 119*a* may be in other locations.

Base 120 is the bottom portion of pool cleaner 100*a* that is connected to the head 110 to form the body of pool cleaner 100*a*. In at least one embodiment, base 120 includes a receiving portion that engages with fastener 112 for locking the head 110 to the base 120 when the pool cleaner 100*a* is in use. In at least one embodiment, base 120 is connected to wheels and/or other traversing structures allowing the pool cleaner 100*a* to move across the floor of the pool. In at least one embodiment, base 120 includes an intake opening at the bottom, which serves as an inlet for the pool water to enter the body, so that the water is filtered by the filter within the body of pool cleaner 100*a*. In at least one embodiment, base 120 may include other structures and/or shapes.

Neck portions 130*a* and 130*b* are collar-like structures fitted in the circular openings of discharge mounts 111*a* and 111*b*, within which the propellers of the two pumps are located for pushing water out through neck portions 130*a* and 130*b* to exit pool cleaner 100*a*. In at least one embodiment, a part of neck portions 130*a* and 130*b* is inserted into and partially interlocks with the circular openings of discharge mounts 111*a* and 111*b*, while the other part (having a slightly larger diameter) meets with the circular openings of discharge mounts 111*a* and 111*b* and serves as an outlet for water to exit the pool cleaner 100*a*. In at least one embodiment, neck portions 130*a* and 130*b* are able to rotate inside the circular openings of discharge mounts 111*a* and 111*b* within a limited range and may stay at an angle at which the user sets neck portions 130*a* and 130*b*. In at least one embodiment, adjustable flaps are connected to the neck portions 130*a* and 130*b*, via pivots for controlling the water flow. In an embodiment, slotted covers are attached to, and located in, discharge openings of the neck portions 130*a* and 130*b* for blocking fingers or other objects from coming in contact with the propellers. In at least one embodiment, neck portions 130*a* and 130*b* include indicator tabs for indicating rotational angles at which neck portions 130*a* and 130*b* are set. In other embodiments, neck portions 130*a* and 130*b* may include other structures. Neck portions 130*a* and 130*b* will be further discussed in FIGS. 2A and 2B.

Flaps 131*a* and 131*b* are circular plates that are connected to neck portions 130*a* and 130*b*, respectively, on one side via pivots (to form a hinge). In at least one embodiment, flaps 131*a* and 131*b* are mechanically biased to stay closed to cover the discharge openings of neck portions 130*a* and 130*b* until being pushed open by water exiting the discharge openings. In at least one embodiment, there may be two stops, one stop for each of flaps 131*a* and 131*b*, that prevents flaps 131*a* and 131*b* from opening beyond a predetermined angle. In at least one embodiment, flaps 131*a* and 131*b* may be opened facing upwards at a predetermined angle (e.g., an angle in the range of 65 to 90 degrees). In at least one embodiment, the flaps 131*a* and 131*b* have extended portions that are connected, via pivots to the bottom of the neck portions 130*a* and 130*b*. In other embodiments, flaps 131*a* and 131*b* may include other structures.

Cover 132*a* may include a ring shaped rim with spokes positioned radially from a hub to the rim, forming openings between the spokes. The spokes may be slats. In at least one embodiment, cover 132*a* is fitted in the discharge opening of neck portion 130*a*. Cover 132*a* blocks fingers and/or other objects from coming in contact with the propeller positioned inside the neck portion 130*a*, while still allowing the water to exit the discharge opening of neck portion 130*a*. In at least one embodiment, the spokes of the cover 132*a* are tilted with respect to the plane of the cover 132*a*, so that the slat shaped spokes are aligned to minimize the rotational motion of the water. In at least one embodiment, another cover similar to cover 132*a* is fitted in the neck portion 132*b* with openings aligning to the flow of water exiting the neck portion 312*b*. In other embodiments, cover 132*a* may have other shapes and/or structures.

Indicator tabs 133*a* and 133*b* are tabs protruding from outside surfaces of neck portions 130*a* and 130*b*, respectively, on the sides that are opposite the sides having the pivots. Indicator tabs 133*a* and 133*b* indicate the rotational angles of the neck portions 130*a* and 130*b*. In at least one embodiment, the indicator tabs 133*a* and 133*b* point to the rotation markings (119*a* on discharge mount 111*a* and other markings on discharge mount 111*b*) that correspond to the angles that the neck portions 130*a* and 130*b* make with the zero marking, which also indicate the angles of the flow of water that has bounced off flaps 131*a* and 131*b*, causing pool cleaner 100*a* to turn. In at least one embodiment, a user may rotate the neck portions 131*a* and 131*b* in either direction so that indicator tabs 133*a* and 133*b* may point to an angle at either side of the rotation markings, so that pool cleaner 100*a* can turn in either direction.

Wheels 140 are pivotally attached to the base 120 to provide mobility for pool cleaner 100*a* to move across the floor of the pool. In at least one embodiment, wheels 140 are placed far enough from one another to maintain stability of pool cleaner 100*a*. In various embodiments, there may be various numbers of wheels (e.g., 3, 4, 5, 6, or 8, for example) attached to the base 120. Power cord 150 is an insulated electrical cord that connects pool cleaner 100*a* to a power outlet such as an AC outlet. Power cord 150 transmits the electricity from the power outlet to pool cleaner 100*a* to power the two pumps as needed. Power cord 150 may run through a cover on the top of head 110 to further connect to a connector that engages a socket that is inside a pump chamber in which the pumps are located. In at least one embodiment, the electrical connections between power cord 150 and the connector and between the connector and the socket are hermetically sealed.

Cap 151 is a cap that is attached to the top of the head 110, through which the power cord 150 passes and/or connects to the pumps inside pool cleaner 100*a*. In at least one embodiment, cap 151 is affixed to a connector that the power cord 150 is connected, for stabilizing the connector inside the head 110. In at least one embodiment, cap 151 may include other structures and/or shapes.

Figure 1B:
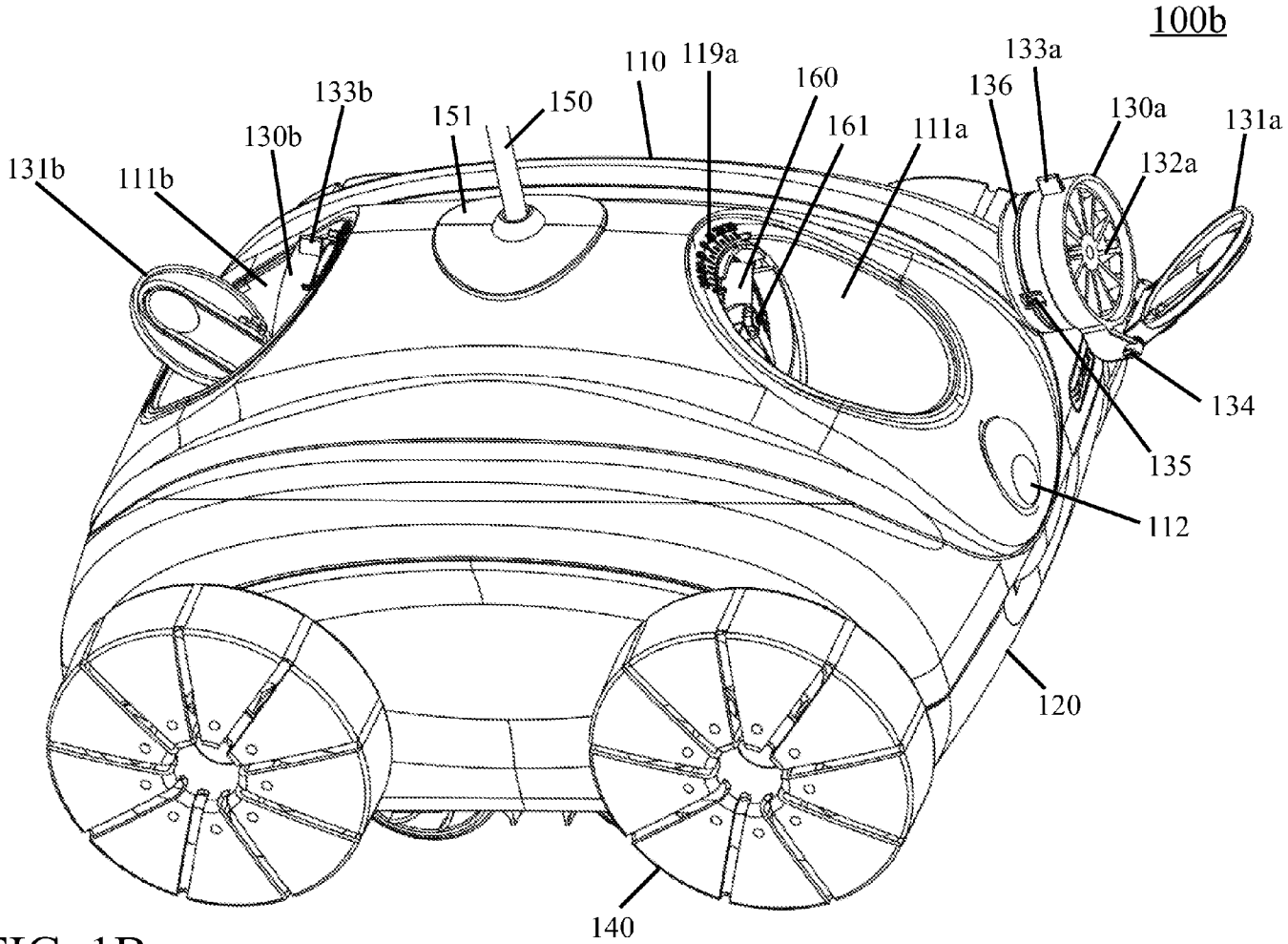
FIG. 1B shows another view of an embodiment of the pool cleaner of FIG. 1A with the neck portion disconnected from the pool cleaner.

FIG. 1B shows another view 100*b* of an embodiment of the pool cleaner 100*a* of FIG. 1A with the neck portion 130*a* disconnected from the pool cleaner 100*a*. FIG. 1B includes at least head 110, discharge mounts 111*a* and 111*b*, fastener 112, rotation markings 119*a*, base 120, neck portions 130*a* and 130*b*, flaps 131*a* and 131*b*, cover 132*a*, indicator tabs 133*a* and 133*b*, wheels 140, power cord 150, and cap 151, which were discussed in conjunction with FIG. 1A. FIG. 1B further includes a pivot 134, a tab 135, a groove 136, a propeller 160, and an axle 161. In other embodiments, FIG. 1B may not have all of the elements or features listed and/or may have other elements or features instead of or in addition to those listed.

FIG. 1B shows a view with details of the neck portion 130*a*, while neck portion 130*a* is disconnected from the circular opening of the discharge mount 111*a*. In FIG. 1B, the part of neck portion 130*a* that is inserted into the circular opening of discharge mount 111*a* includes a groove and a tab(s) for interlocking the neck portion 130 and the discharge mount 111*a* while allowing the neck portion 130*a* to rotate and stay in a position where the user places neck portion 130*a*.

Pivot 134 is a pivot structure that runs through holes in pivot mounts on neck portion 130*a* and hole(s) in extended portions of flap 131 for holding the flap 131*a* and neck portion 130*a* together. Pivot 134 allows flap 131*a* to swing within a limited range while one end is connected to neck portion 130*a*. In an embodiment, pivot 134 is a rod. Together with the pivot mounts on neck portion of 130*a* and extended portions of flap 131 form a hinge.

Tab 135 is a piece of resilient material, such as a resilient plastic within a notch that acts like a spring and after being deformed, tab 135 tends to return to the original shape of tab 135. Tab 135 is in a groove on neck portion 130*a*. Tab 135 is biased to stay in a position away from neck portion 130*a*. Tab 135 is mechanically biased to protrude between bumps or other protrusions on the inner surface of the circular opening of discharge mount 111*a*. The bumps form a circle and are in alignment with the groove when neck portion 130*a* is fitted into the circular opening of discharge mount 111*a*. The bumps protrude into the groove (while tab 135 protrudes between bumps) holding neck portion 130*a* in place. In at least one embodiment, tab 135 keeps the neck portion 130*a* at the particular angle chosen by the user. While the user changes the angle of neck portion 130*a*, tab 135 depresses each time tab 135 slides over the bumps of the discharge mount 111*a*, acting like a bidirectional ratchet allowing the neck portion 130*a* to be stepped from one angle setting to another angle without slipping once in any given angle setting. In at least one embodiment, more than one tab is located on the neck portion 130*a* for holding the neck portion 130*a* in place. In at least one embodiment, other structures may be used instead of or in addition to the tab 135 and the bumps for holding the neck portion 130*a* in place. The bumps will be discussed further in conjunction with FIG. 3A, below. In at least one embodiment, the neck portion 130*b* also includes at least a similar tab on neck portion 130*b* for holding the neck portion 130*b* in a user chosen angle setting without slipping, while allowing the user to step neck portion 130*b* to other angle settings. Optionally, another tab similar to tab 135 may be located on the part of neck portion 130*a* opposite to the tab 135 that further aids in holding the neck portion 130*a* in a user chosen angle setting. Similarly, neck portion 130*b* may also include a second tab opposite the first tab.

Groove 136 is a groove on the outside surface of the part of neck portion 130*a* to be inserted into the circular opening of discharge mount 111*a* for interlocking neck portion 130*a* and discharge mount 111*a*. In at least one embodiment, groove 136 interlocks with bumps on the circular opening of discharge mount 111*a*. In at least one embodiment, tab 135 interrupts groove 136 for keeping the neck portion 130*a* at a user chosen angle as described in conjunction with tab 135, above. In at least one embodiment, other structures may be included in neck portion 130*a* for interlocking neck portion 130*a* to discharge mount 111*a* while allowing rotation of neck portion 130*a*. In an at least one alternative embodiment, tab 135 and groove 136 could be located on the circular opening of discharge mount 111, while the bumps could be located on neck portion 130*a*. In at least one alternative embodiment, the groove 136 may be replaced with a series of depressions that each engages one of the bumps when neck portion 103*a* is in one of the angle settings. In the embodiment in which groove 136 is replaced with a series of depressions, tab 135 is optional.

Propeller 160 is a fan blade on one of the pumps. Propeller 160 rotates when the pump is on, causing the surrounding water to move, pulling water from the floor of the pool into pool cleaner 100*a*, through a filter, and pushing the filtered water out of the pool cleaner 100*a* in the direction that the pump that is on faces. Propeller 160 may be powered by a motor. In at least one embodiment, pool cleaner 100*a* includes two pumps facing proximately opposite directions, each pump having a propeller facing upwards at an angle with respect to one another, with respect to the surface of the water, and with respect to the floor of the pool.

Axle 161 is the axle on which propeller 160 is mounted. Turning axle 161 turns propeller 160. Axle 161 may be mounted in holes or wells in a housing of the pump of propeller 160. Note that one of the pumps may include propeller 160, a motor to turn propeller 160, a housing for the motor that holds axle 161, axle 161 (and the other pump may likewise include another propeller, motor, motor housing, and axle).

Figure 1C:
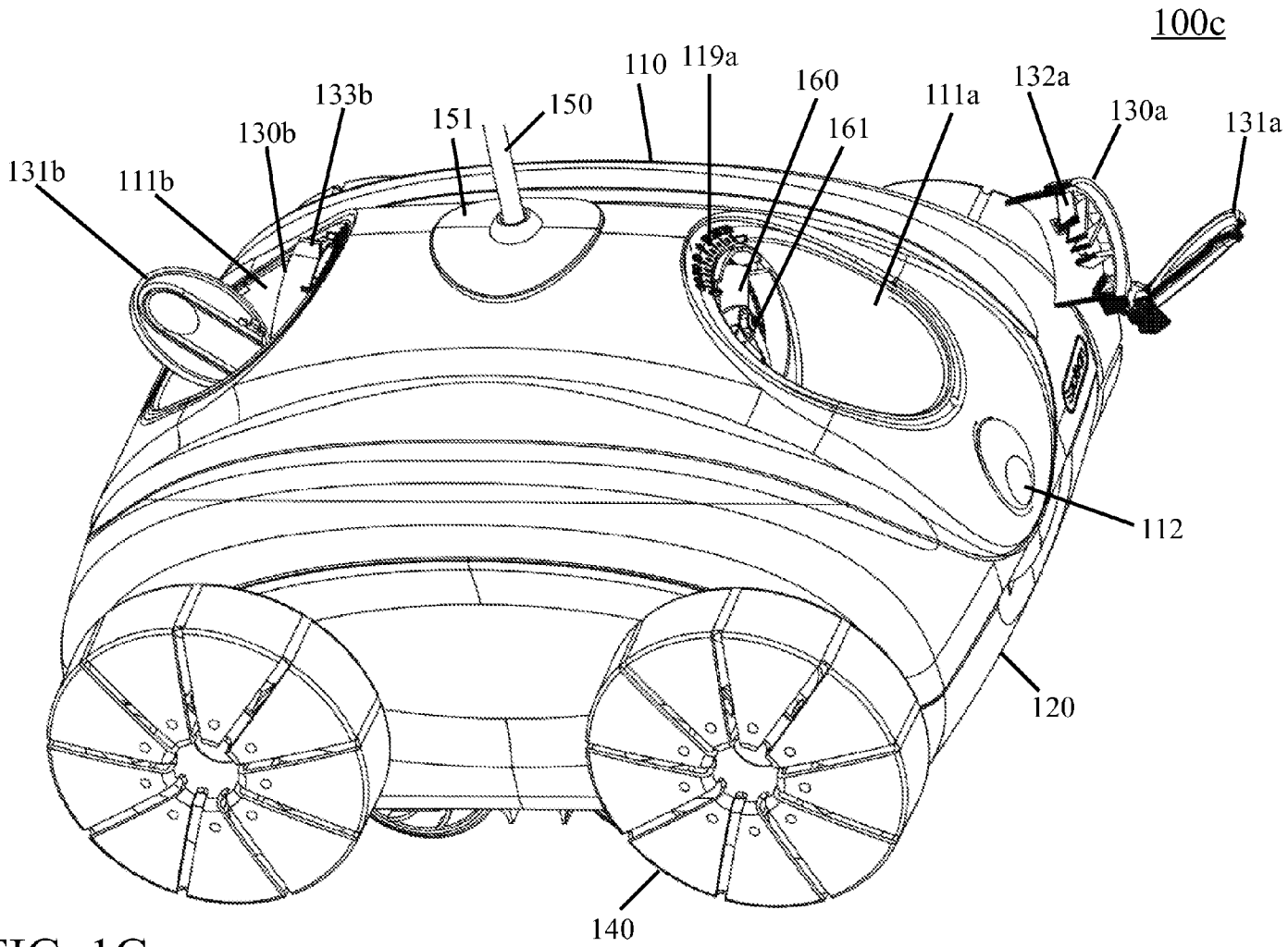
FIG. 1C shows another view of an embodiment of the pool cleaner of FIG. 1A with a cross sectional view of the neck portion and flap.

FIG. 1C shows another view 100*c* of an embodiment of the pool cleaner 100*a* of FIG. 1A with a cross sectional view of the neck portion 130*a* and flap 131*a*. FIG. 1C includes at least head 110, discharge mounts 111*a* and 111*b*, fastener 112, rotation markings 119*a*, base 120, neck portions 130*a* and 130*b*, flaps 131*a* and 131*b*, cover 132*a*, indicator tab 133*b*, wheels 140, power cord 150, and cap 151, which were discussed in conjunction with FIG. 1A. FIG. 1C also propeller 160 and axle 161, which were discussed in conjunction with FIG. 1B. In other embodiments, FIG. 1C may not have all of the elements or features listed and/or may have other elements or features instead of or in addition to those listed.

FIG. 1C shows a cross sectional view of the neck portion 130*a* and flap 131*a*, with spokes of the cover 132*a* tilted forming spaces that are tilted in an angle allowing the water to exit the discharge opening of the neck portion 130*a*. FIG. 1C shows more clearly than FIG. 1B that the spokes are shaped like slats and FIG. 1C shows that the slats are slanted to minimize the rotational motion of the water exiting the pool cleaner 100*a*. In an alternative embodiment, the spokes are not slats or are slat that are parallel to the axis of rotation of the propeller.

Figure 2A:
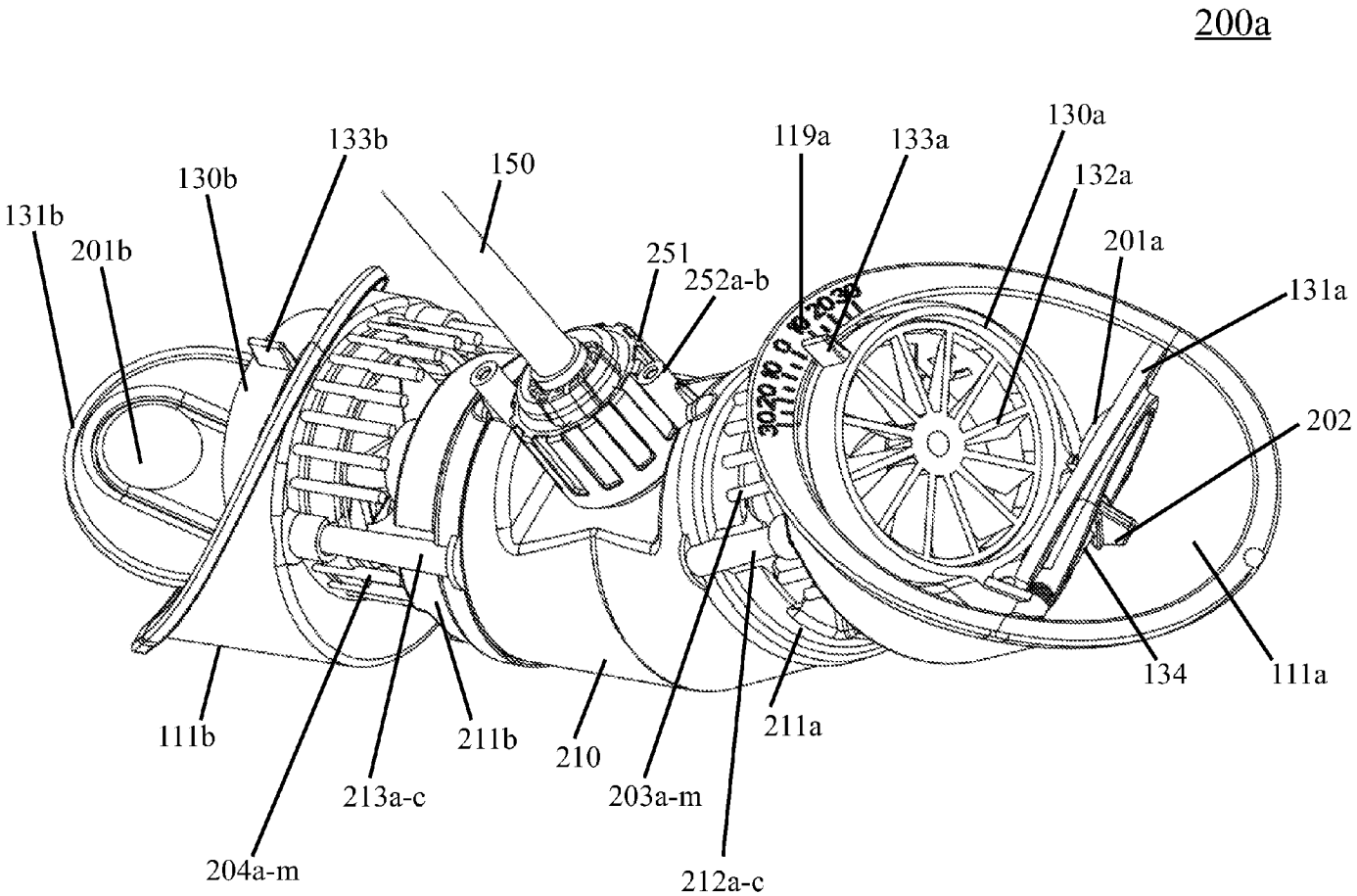
FIG. 2A shows a top front view of an embodiment of a pump assembly having two pumps with the flaps open.

FIG. 2A shows a top front view of an embodiment of a pump assembly 200*a* having two pumps with the flaps open. Pump assembly 200*a* includes at least discharge mounts 111*a* and 111*b*, rotation markings 119*a*, neck portions 130*a* and 130*b*, flaps 131*a* and 131*b*, cover 132*a*, indicator tabs 133*a* and 133*b*, power cord 150, and pivot 134, which were discussed in conjunction with FIGS. 1A and 1B. Pump assembly 200*a* may further include protrusions 201*a* and 201*b*, a sliding stop 202, a plurality of protecting rods 203*a-m* and 204*a-m*, a pump chamber 210, two pumps 211*a* and 211*b*, poles 212*a-c* and 213*a-c*, an electrical connector 251, and a pair of poles 252*a-b*. In other embodiments, pump assembly 200*a* may not have all of the elements or features listed and/or may have other elements or features instead of or in addition to those listed.

FIG. 2A shows the structure of pump assembly 200*a*. Pump assembly 200*a* has two pumps facing proximately opposite directions, which are both tilted upwards at an angle for positioning two propellers in discharge openings of neck portions 130*a* and 130*b*, thereby causing water to be pushed directly out of the pool cleaner 100*a* without traveling through a conduit(s). In at least one embodiment, either of flaps 131*a* and 131*b* may be pushed open by the water exiting the discharge opening of either of neck portions 130*a* and 130*b*, thus providing a driving force in either direction for propelling the pool cleaner 100*a* across the floor of the pool. In at least one embodiment, water that bounces off the flaps 131*a* and/or 131*b* also creates a downward force for keeping the pool cleaner 100*a* staying on the floor of the pool while moving. In at least one embodiment, the speed of the pool cleaner 100*a* may be adjusted by adjusting the angle of opening of the flaps 131*a* and 131*b*, and the direction of the movement of the pool cleaner 100*a* may be adjusted by rotating the neck portions 130*a* and 130*b* which in turn changes the direction in which the flaps 131*a* and 131*b* may open.

Protrusions 201*a* and 201*b* are circular protrusions on flaps 131*a* and 131*b* toward the neck portions 130*a* and 130*b*, respectively. Protrusions 201*a* and 201*b* are optional.

Sliding stop 202 is a tab with a hole for the pivot 134 to pass through for connecting the sliding stop 202 to the flap 131*a*. Sliding stop 202 slides along pivot 134, and at different positions along pivot 134, sliding stop 202 stops flap 131*a* from opening beyond a particular amount. The amount that sliding stop 202 allows flap 131*a* depends on the position along pivot 134 that sliding stop 202 is placed at. In other words, sliding the sliding stop 202 along pivot 134 adjusts the maximum angle to which flap 131*a* opens when pushed open by the water exiting the discharge opening of neck portion 130*a*. In at least one embodiment, the sliding stop 202 may slide on pivot 134 and may stay in a predetermined position that corresponds to a specific angle to which the flap 131*a* is open. In at least one embodiment, a portion of sliding stop 202 rides on a bar at the end of the extended portions of the flap 131*a*. In at least one embodiment, when the flap 131*a* is pushed open, sliding stop 202 contacts the bottom of neck portion 131*a*. At the bottom of neck portion 131*a* may be fins or tabs (or other structures) having different heights, which contact sliding stop 202, preventing flap 130*a* from opening further. In this specification, the terms "fins" and "tabs" may be substituted one for the other to obtain a different embodiment. The heights of the fins may decrease in one direction and increase in the other direction as sliding stop 202 moves along bar 206. The higher the fins the smaller the angle that flap 131*a* can open, and the shorter the fins the larger the angle that flap 131*a* can open. In an embodiment, the fins are only on one side of the bottom of neck portion 130*a* and increase in the direction moving away from the center of the bottom of neck portion 130*a*. A similar set of fins may be located on neck portion 131*b* for contacting another sliding stop that stops flap 131*b* from opening beyond a particular amount. In other embodiments, other structures may be substituted to adjust the open angle of flaps 131*a* and 131*b*.

Protecting rods 203*a-m* and 204*a-m* include a plurality of rods surrounding the circular openings behind discharge mounts 111*a* and 111*b* within pool cleaner 100*a*. Protecting rods 203*a-m* and 204*a-m* are located between discharge mount 111*a* and 111*b* and facing the pump chamber 210. Protecting rods 203*a-m* and 204*a-m* block fingers or other objects from coming in contact with the propellers that are located in the circular openings of discharge mounts 111*a* and 111*b*. Water drawn into the pool cleaner 100*a* is sucked through protecting rods 203*a-m* and 204*a-m* and then into the propellers of the pumps. The water sucked into the propellers then exits the pool cleaner 100*a*.

Pump chamber 210 is a chamber having two cylindrical chambers joined in the middle, while the other ends of the two cylindrical chambers are tilted upward at an angle and are connected to the housings of the two pumps. In at least one embodiment, pump chamber 210 includes a port on the top of pump chamber 210, and the power cord 150 extends through the port and electrically couples to the pumps within the pump chamber 210. In at least one embodiment, a socket is attached below the port inside the pump chamber 210, which is electronically connected to a control circuit, for controlling a power switch that activates the two pumps. In at least one embodiment, pump chamber 210 includes two poles on either side of the port for holding the pump chamber 210 to the roof of head 110 on the inner side of the head 110.

Pumps 211*a* and 211*b* are water pumps that are capable of moving water surrounding the pumps 211*a* and 211*b*. More specifically, pumps 211*a* and 211*b* draw water into the body of pool cleaner 100*a* and push water out of the body. In an embodiment, each of pumps 211*a* and 211*b* may include a propeller to move the water through the pool cleaner 100*a*. In an embodiment having a propeller, the end of each of pumps 211*a* and 211*b* that has the propeller is a discharge end of pumps 211*a* and 211*b*. Pumps 211*a* and 211*b* may be electromechanical pumps that are powered by electric motors. Pumps 211*a* and 211*b* are further described, below, in conjunction with FIGS. 5 and 6B.

Poles 212*a-c* and 213*a-c* are poles that connect pump chamber 210 to discharge mounts 111*a* and 111*b*, respectively. In at least one embodiment, poles 212*a-c* and 213*a-c* include screw holes on top at an end distal from pump chamber 210. The screw holes engage screws that go through holes on discharge mounts 111*a* and 111*b* for connecting pumps 211*a* and 211*b* to discharge mounts 111*a* and 111*b*, respectively. In at least one embodiment, each of the pumps 211*a* and 211*b* includes three poles. In another embodiment, other numbers of poles or other fasteners may be substituted for connecting pumps 211*a* and 211*b* to the discharge mounts 111*a* and 111*b*.

Electrical connector 251 is an electrical connector that engages the socket inside the pump chamber 210. In at least one embodiment, electrical connector 251 has screw threads that engage screw threads on the port on top of the pump chamber 210, forming a hermetic seal, and may include leads that make electrical contact with leads in the socket inside the pump chamber 210.

Poles 252*a-b* are poles on the top of pump chamber 210 at either side of the electrical connector 251, for connecting the pump chamber 210 to the cap 151. In at least one embodiment, holes 252*a-b* are threaded and engage screws located on the bottom of cap 151, so that the pump chamber 210 is affixed to the cap 151 while the cap 151 is attached to the head 110. Alternatively, the screws and screw holes may be replaced with tabs that engage in slots and/or other fasteners.

Figure 2B:
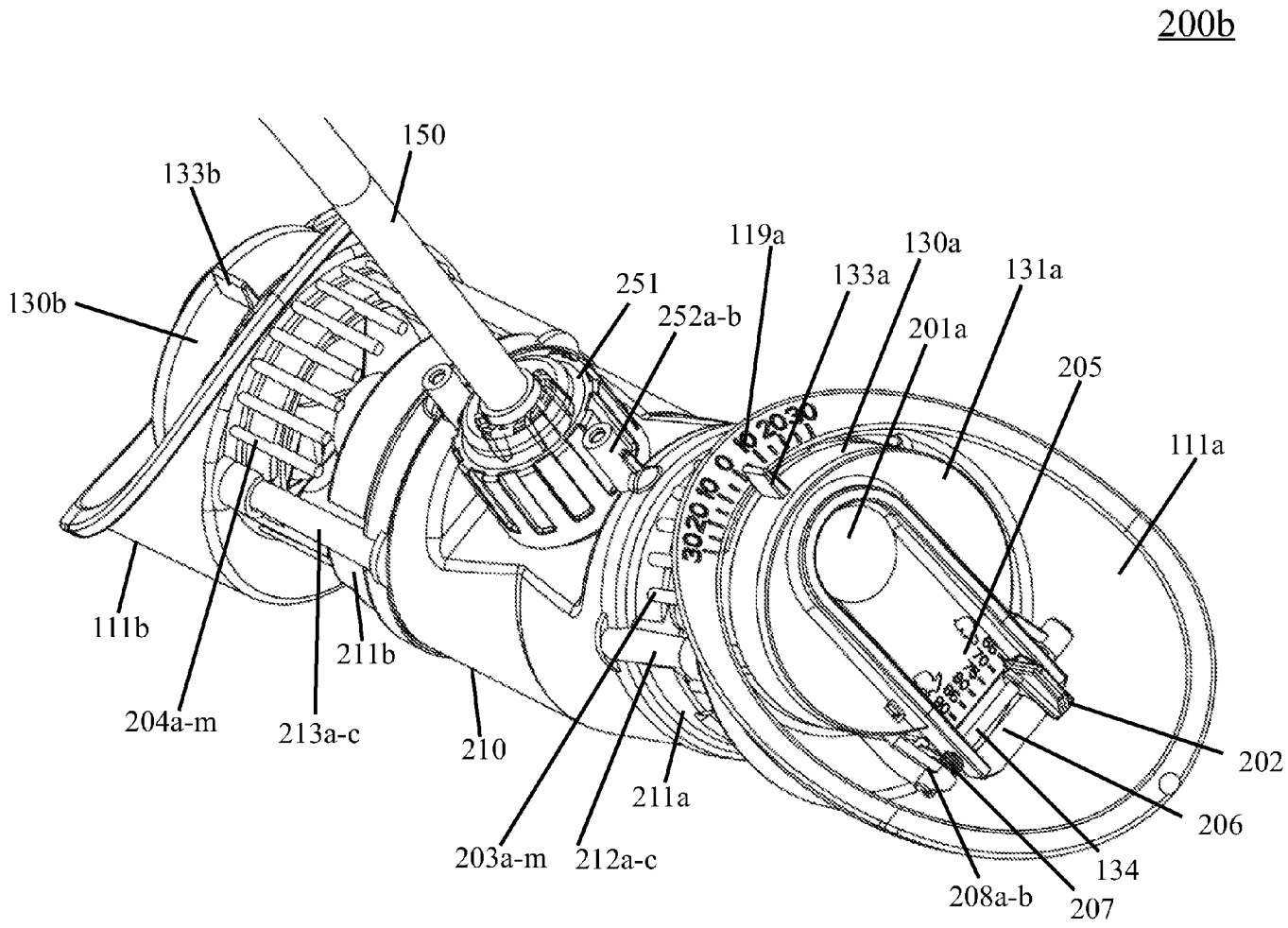
FIG. 2B shows the top front view of the pump assembly of FIG. 2A with the flaps closed.

FIG. 2B shows the top front view 200*b* of the pump assembly 200*a* of FIG. 2A with the flaps 131*a* and 131*b* closed. FIG. 2B includes at least discharge mounts 111*a* and 111*b*, rotation markings 119*a*, neck portions 130*a* and 130*b*, flap 131*a*, indicator tabs 133*a* and 133*b*, power cord 150, and pivot 134, which were discussed in conjunction with FIGS. 1A and 1B. FIG. 2B further includes protrusion 201*a*, sliding stop 202, protecting rods 203*a-m* and 204 *a-m*, pump chamber 210, pumps 211*a* and 211*b*, poles 212*a-c* and 213*a-c*, electrical connector 251, and poles 252*a-b*, which were discussed in conjunction with FIG. 2A. FIG. 2B may further include flap markings 205, a bar 206, spring 207, and a pair of pivot mounts 208*a-b*. In other embodiments, FIG. 2B may not have all of the elements or features listed and/or may have other elements or features instead of or in addition to those listed.

FIG. 2B shows the top front view of FIG. 2A in which the flaps 131*a* and 131*b* are closed and cover the discharge openings of neck portions 130*a* and 130*b*.

Flap markings 205 are markings located on the side of flap 131*a* facing away from the neck portion 130*a*, adjacent to the pivot 134. Flap markings 205 in combination with the sliding stop 202 indicate the angle at which the flap 131*a* is open. In at least one embodiment, flap markings 205 include numerical markings that range from 65 degrees to 90 degrees. For example, when the sliding stop 202 points to 70 degrees on the flap markings 205, the flap 131*a* may be opened to at most 70 degrees with respect to the opening of the neck portion 130*a*. In at least one embodiment, flap markings 205 may include other numbers and/or letters. In at least one embodiment, flap markings 205 may be in other locations.

Bar 206 is a bar that connects the ends of two extended portions of the flap 131*a*. Bar 206 guides the sliding stop 202. Sliding stop 202 slides along bar 206. In at least one embodiment, bar 206 includes depressions that engage sliding stop 202, causing sliding stop 202 to ratchet from depression to depression, so that sliding stop 202 stays in a predetermined position that corresponds to a specific angle that the flap 131*a* can open to. In at least one embodiment, bar 206 also provides support for the sliding stop 202.

Spring 207 is attached to pivot 134, mechanically biasing the flap 131*a* to stay closed to cover the discharge opening of the neck portion 130*a* until the flap 131*a* is pushed open by water that is pushed out of pool cleaner 100*a* by propeller 160. In at least one embodiment, another spring is used to bias the flap 131*b* to stay closed to cover the neck portion 130*b*.

Pivot mounts 208*a-b* are a pair of tabs that are attached to the neck portion 130*a*, having holes in the ends that are further away from the neck portion 130*a*. Pivot 134 is placed in pivot mounts 208*a-b*.

Figure 3A:
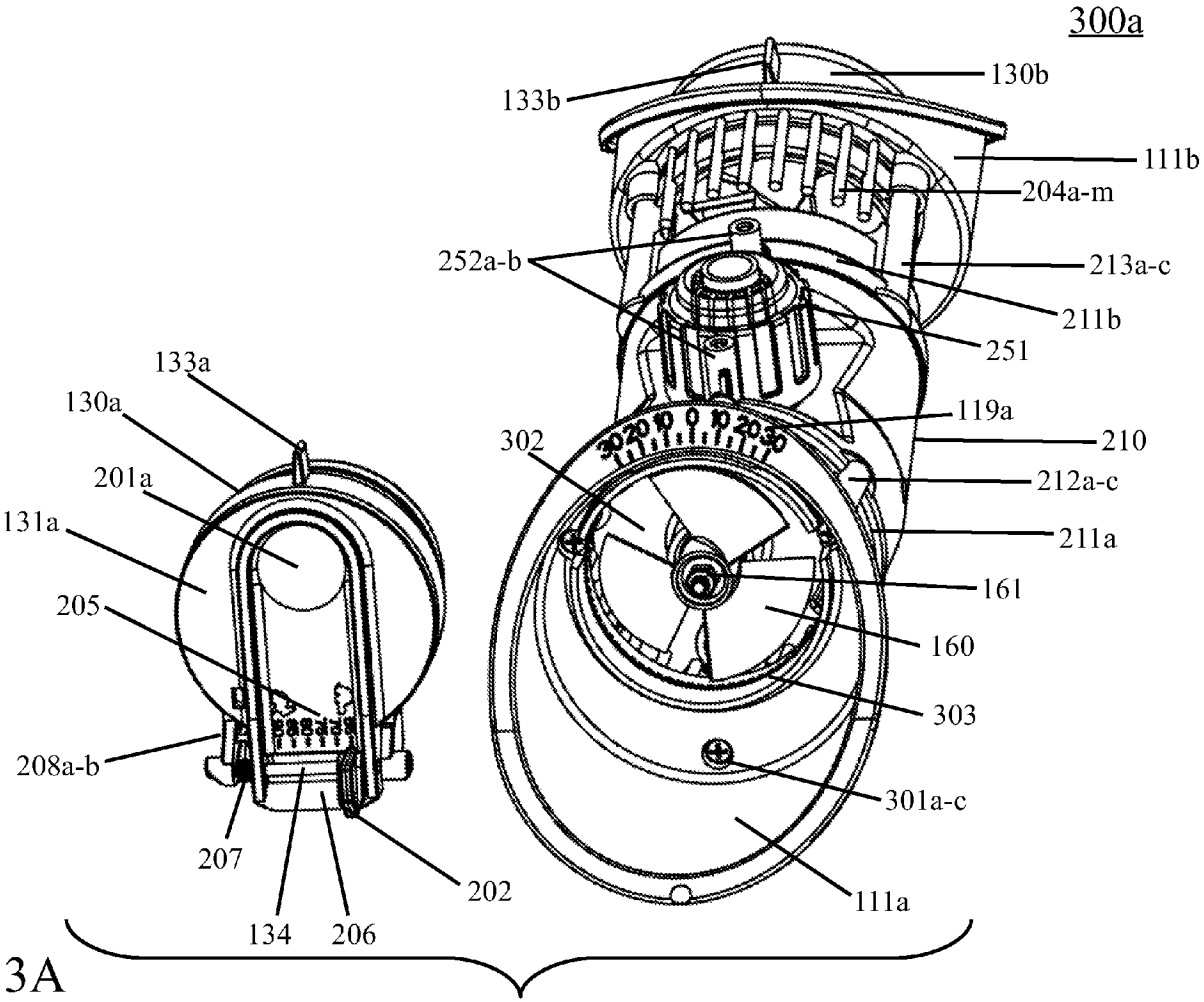
FIG. 3A shows a front view of an embodiment of the pump assembly of FIG. 2A with the neck portion disconnected from the pump assembly.

FIG. 3A shows a front view 300*a* of an embodiment of the pump assembly 200*a* of FIG. 2A with the neck portion 130*a* disconnected from the pump assembly 200*a*. FIG. 3A includes at least discharge mounts 111*a* and 111*b*, rotation markings 119*a*, neck portions 130*a* and 130*b*, flap 131*a*, indicator tabs 133*a* and 133*b*, pivot 134, propeller 160, and axle 161, which were discussed in conjunction with FIGS. 1A and 1B. FIG. 3A also includes protrusion 201*a*, sliding stop 202, protecting rods 204 *a-m*, pump chamber 210, pumps 211*a* and 211*b*, poles 212*a-c* and 213*a-c*, electrical connector 251, and poles 252*a-b*, which were discussed in conjunction with FIG. 2A. FIG. 3A further includes flap markings 205, a bar 206, spring 207, and a pair of pivot mounts 208*a-b*, which were discussed in conjunction with FIG. 2B. FIG. 3A may further include screws 301*a-c*, a circular opening 302, and a plurality of bumps 303. In other embodiments, FIG. 3A may not have all of the elements or features listed and/or may have other elements or features instead of or in addition to those listed.

FIG. 3A shows a front view of the pump assembly 200*a* when the neck portion 130*a* is disconnected from the circular opening of discharge mount 111*a*. FIG. 3A shows that the propeller 160 is located inside the circular opening of discharge mount 111*a* for pushing water directly out of the pool cleaner 100*a*.

Screws 301*a-c* are three screws that affix the housing of pump 211*a* to the discharge mount 111*a* so that the propeller 160 of the pump 211*a* is positioned inside the circular opening of discharge mount 111*a*. Each of screws 301*a-c* screws into a hole at the end of one of poles 212*a-c*, thereby holding discharge mount 111*a* to poles 212*a-c* of pump 211*a*. In other embodiments, other fasteners may be substituted to obtain a different embodiment.

Circular opening 302 is an opening in the discharge mount 111*a* into which the neck portion 130*a* is attached. In at least one embodiment, the propeller 160 is positioned in the circular opening 302 for pushing water directly out of pool cleaner 100*a* (without traveling through any conduits). In at least one embodiment, inner surface of circular opening 302 includes bumps that engage groove 136 and tab 135 for interlocking the neck portion 130*a*. In at least one embodiment, neck portion 130*a* may rotate within circular opening 302. In other embodiments, circular opening 302 may include other structures and/or shapes.

Bumps 303 are a plurality of bumps on the inner surface of the circular opening 302 of discharge mount 111*a*, which form a circle in alignment with the groove 136 and tab 135 for interlocking the neck portion 130*a* in a predetermined position. In at least one embodiment, two of the bumps 303 trap the tab 135 in-between, so that the neck portion 130*a* stays in a predetermined rotational angle until the user rotates the neck portion 130*a* to another angle, ratcheting neck portion 130*a* from angle to angle. In an alternative embodiment bumps 303 may be replaced with depression that catch tab 135.

Figure 3B:
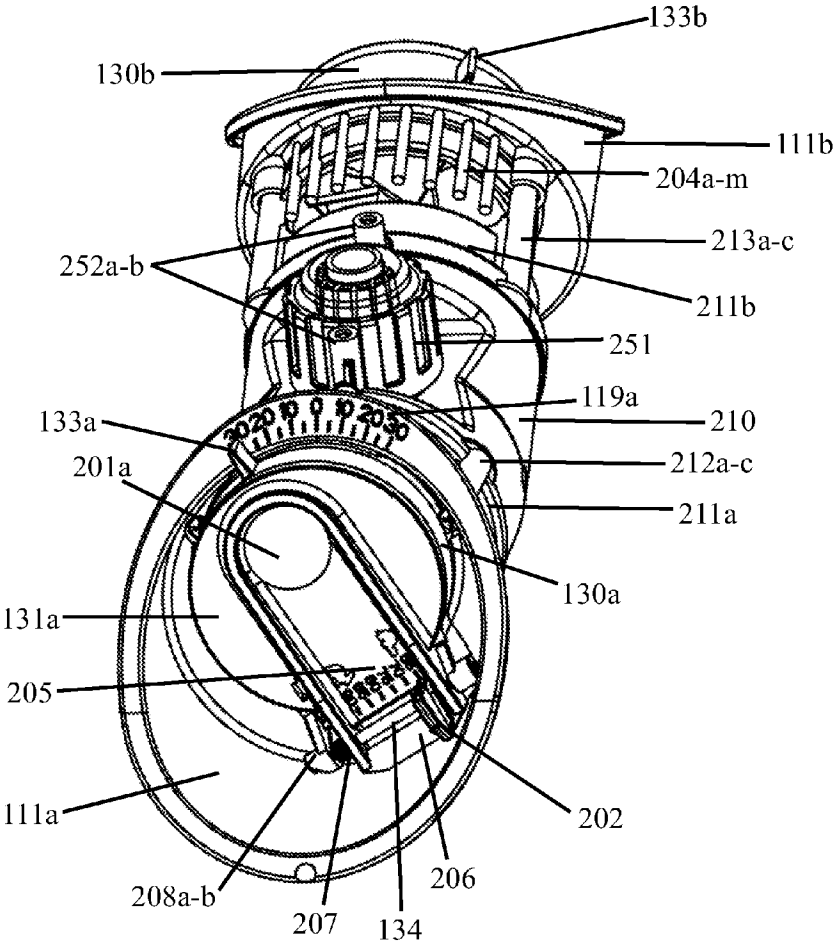
FIG. 3B shows a front view of an embodiment of the pump assembly of FIG. 2A with the flap closed and the neck portion rotated 30 degrees.
Figure 3C:
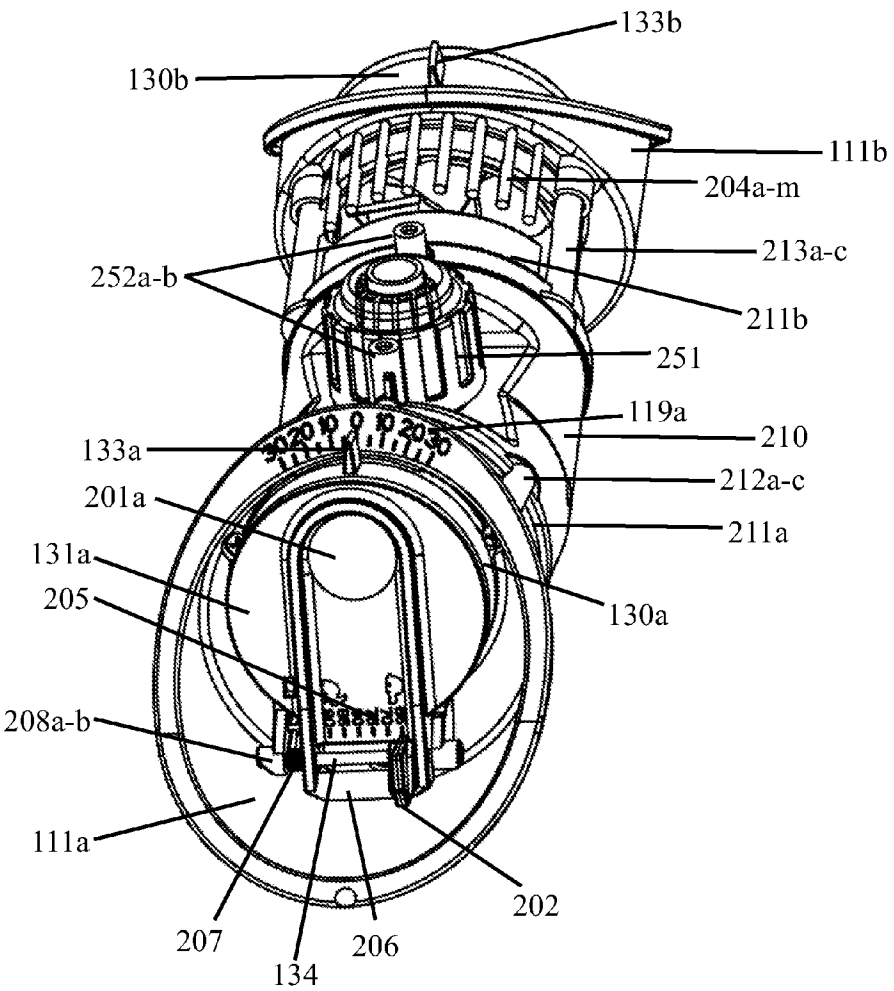
FIG. 3C shows a front view of an embodiment of the pump assembly of FIG. 2A with the flap closed and the neck portion at zero degrees.

FIGS. 3B and 3C show front views 300*b* and 300*c* of an embodiment of the pump assembly 200*a* of FIG. 2A with the flap closed and the neck portion 130*a* rotated 30 degrees and at zero degrees, respectively. FIGS. 3B and 3C include at least discharge mounts 111*a* and 111*b*, rotation markings 119*a*, neck portions 130*a* and 130*b*, flap 131*a*, indicator tabs 133*a* and 133*b*, and pivot 134, which were discussed in conjunction with FIGS. 1A and 1B. FIGS. 3B and 3C also include protrusion 201*a*, sliding stop 202, protecting rods 204 *a-m*, pump chamber 210, pumps 211*a* and 211*b*, poles 212*a-c* and 213*a-c*, electrical connector 251, and poles 252*a-b*, which were discussed in conjunction with FIG. 2A. FIGS. 3B and 3C further include flap markings 205, bar 206, spring 207, and pivot mounts 208*a-b*, which were discussed in conjunction with FIG. 2B. In other embodiments, FIGS. 3B and 3C may not have all of the elements or features listed and/or may have other elements or features instead of or in addition to those listed.

FIGS. 3B and 3C show front views of FIG. 3A when the flaps are closed and the neck portion 131*a* is connected in the circular opening of discharge mount 111*a*. In FIG. 3B, the neck portion 131*a* is rotated 30 degrees while the sliding stop 202 is positioned so that flap 131*a* may be opened up to 65 degrees when pushed by the water (the flap 131*a* is in closed position in FIG. 3B). In FIG. 3C, the neck portion 131*a* is not rotated with the indicator tab 133*a* pointing to zero degrees, while, similar to FIG. 3B, the sliding stop 202 points to 65 degrees.

Figure 4:
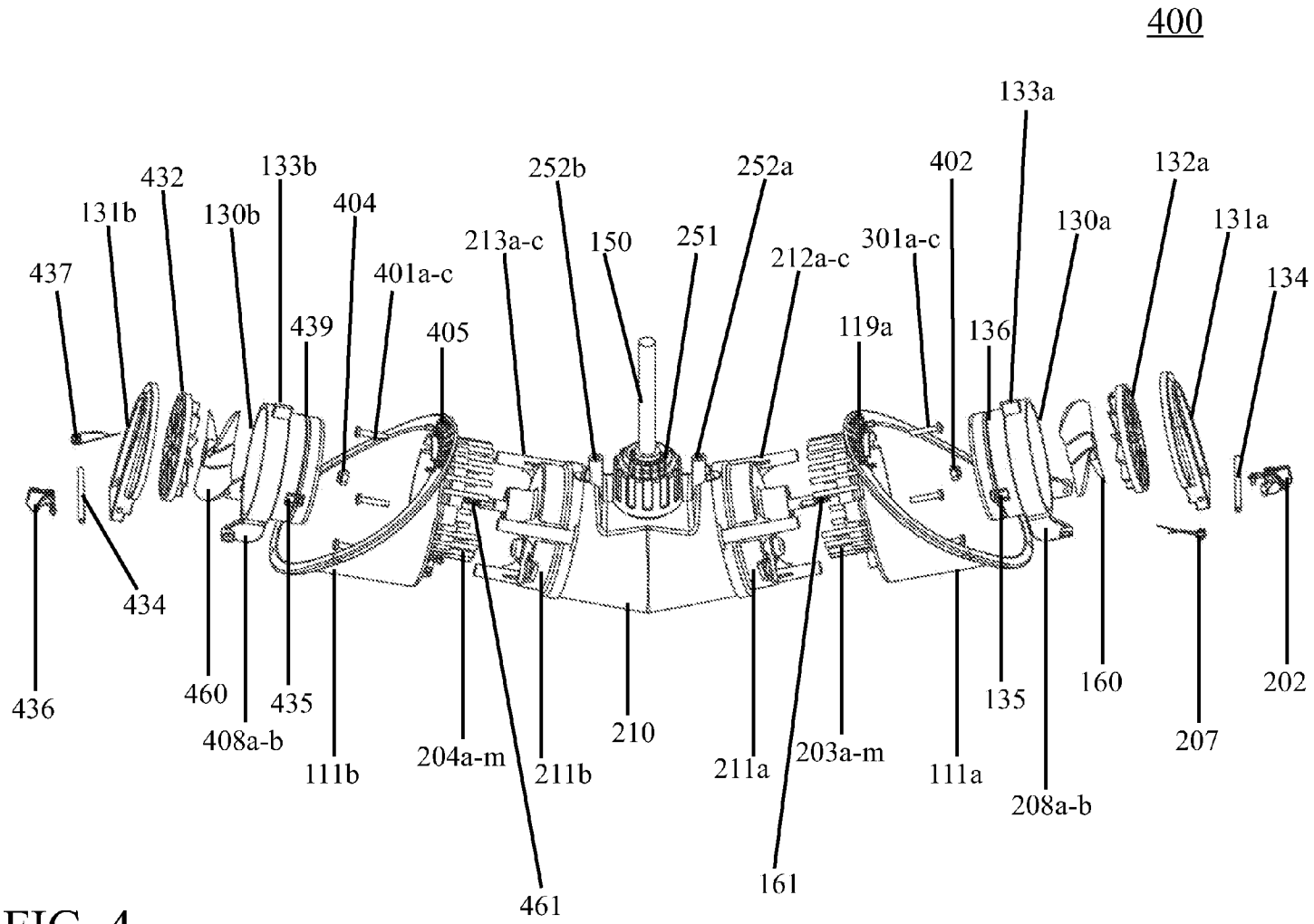
FIG. 4 shows an exploded view of an embodiment of the pump assembly of FIG. 2A.

FIG. 4 shows an exploded view 400 of an embodiment of the pump assembly 200*a* of FIG. 2A. FIG. 4 includes at least discharge mounts 111*a* and 111*b*, rotation markings 119*a*, neck portions 130*a* and 130*b*, flaps 131*a* and 131*b*, cover 132*a*, indicator tabs 133*a* and 133*b*, pivot 134, tab 135, groove 136, power cord 150, propeller 160, and axle 161, which were discussed in conjunction with FIGS. 1A and 1B. FIG. 4 also includes sliding stop 202, protecting rods 203*a-m* and 204 *a-m*, pump chamber 210, pumps 211*a* and 211*b*, poles 212*a-c* and 213*a-c*, electrical connector 251, and poles 252*a-b*, which were discussed in conjunction with FIG. 2A. FIG. 4 further includes spring 207 and pivot mounts 208*a-b*, which were discussed in conjunction with FIG. 2B. FIG. 4 further includes screws 301*a-c*, which were discussed in conjunction with FIG. 3A. FIG. 4 may further include a nut 402, screws 403*a-c*, a nut 404, rotation markings 405, pivot mounts 408*a-b*, a cover 432, a pivot 434, a tab 435, a sliding stop 436, a spring 437, a groove 439, a propeller 460, and an axle 461. In other embodiments, FIG. 4 may not have all of the elements or features listed and/or may have other elements or features instead of or in addition to those listed.

Nut 402 is a fastener with a threaded hole that engage with screw threads on the end of axle 161 for fastening the propeller 160 onto the axle 161. In other embodiments, other fasteners may be substituted for fastening propeller 160 onto axle 161.

Screws 401*a-c* are similar to the screws 301*a-c*. Screws 401*a-c* serve to fasten pump 211*b* to discharge mount 111*b*. Nut 404 is similar to the nut 402. Nut 402 fastens a propeller to an axle of the pump 211*b*. Rotation markings 405 are similar to the rotation markings 119*a*. Rotation markings 405 are on discharge mount 111*b* to be viewed in conjunction with indicator tab 133*b* for indicating the rotational angle of the neck portion 130*b*. Pivot mounts 408*a-b* are similar to the pivot mounts 208*a-b*. Pivot mounts 408*a-b* are connected to neck portion 130*b*, to which a pivot is mounted to connect flap 131*b* to neck portion 130*b*. Cover 432 is similar to the cover 132*a*. Cover 432 is fitted in the discharge opening of neck portion 130*b*. Pivot 434 is similar to the pivot 134. Pivot 434 serves to connect flap 131*b* to neck portion 130*b*, such that flap 131*b* pivots on pivot 434. Tab 435 is similar to the tab 135. Tab 435 is on the neck portion 130*b* and is inserted into circular opening of discharge mount 111*b*. Sliding stop 436 is similar to the sliding stop 202. Sliding stop 436 is attached to pivot 434 for adjusting and indicating the angle to which flap 131*b* can open. Sliding stop 436 may ratchet from location to location having bumps or depressions similar to neck portion 130*a* that form the ratcheting mechanism. Spring 437 is similar to the spring 207. Spring 437 is attached to pivot 434 for biasing flap 131*b* to stay closed to cover neck portion 130*b*. Groove 439 is similar to the groove 136. Groove 439 is on the neck portion 130*b* for interlocking neck portion 130*b* inside circular opening of discharge mount 111*b*, while allowing the rotation of neck portion 130*b*. Propeller 460 is similar to the propeller 160. Propeller 460 is installed on the pump 211*b* causing water to move out of the discharge opening of the neck portion 130*b*. Axle 461 is similar to the axle 161. Axle 461 is in a housing of pump 211*b*, on which propeller 460 is mounted.

Figure 5:
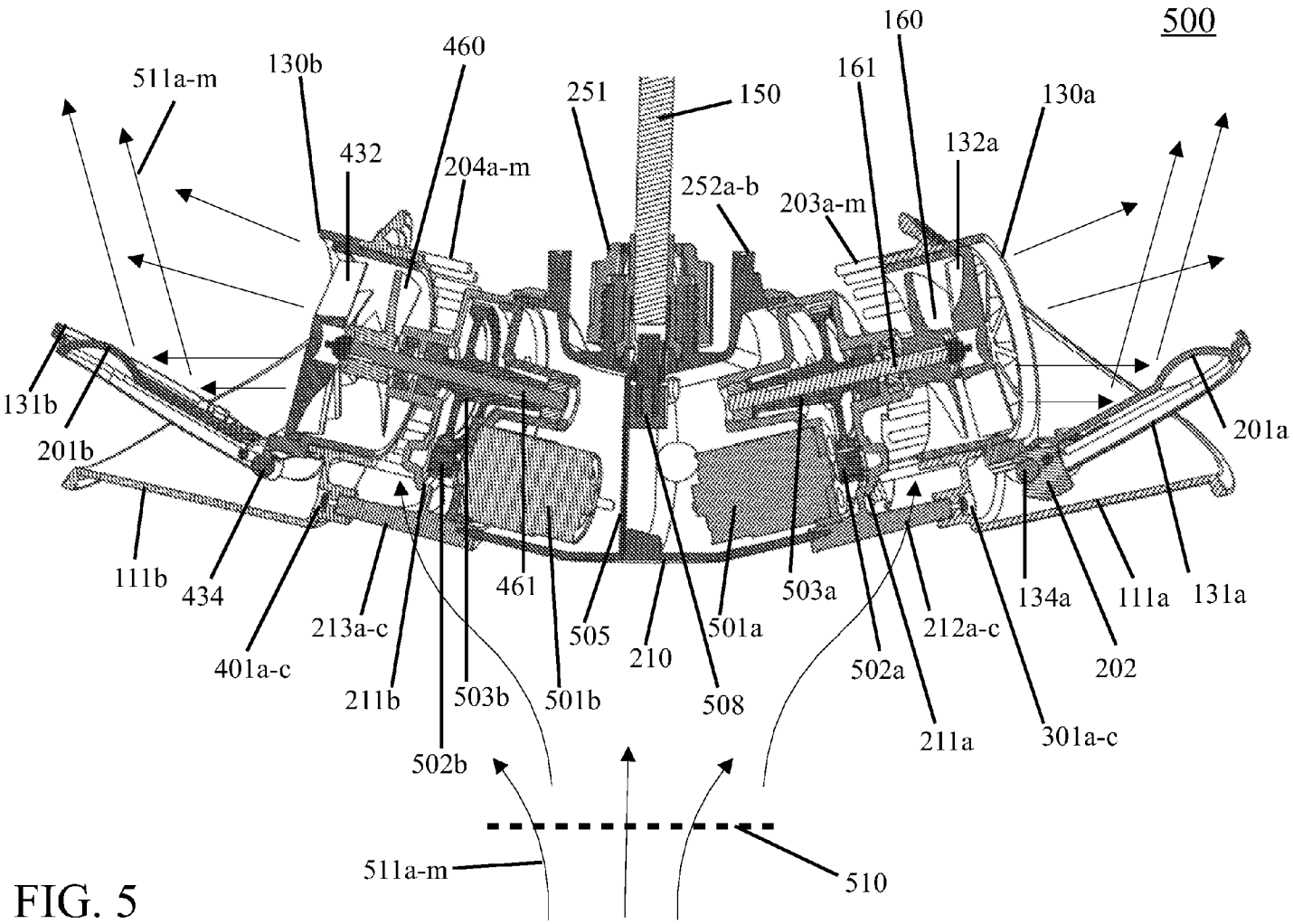
FIG. 5 shows a cross sectional view of an embodiment of the pump assembly of FIG. 2A.

FIG. 5 shows a cross sectional view 500 of an embodiment of the pump assembly 200A of FIG. 2A. FIG. 5 includes at least discharge mounts 111*a* and 111*b*, neck portions 130*a* and 130*b*, flaps 131*a* and 131*b*, cover 132*a*, pivot 134, power cord 150, propeller 160, and axle 161, which were discussed in conjunction with FIGS. 1A and 1B. FIG. 5 also includes protrusions 201*a* and 201*b*, sliding stop 202, protecting rods 203*a-m* and 204 *a-m*, pump chamber 210, pumps 211*a* and 211*b*, poles 212*a-c* and 213*a-c*, electrical connector 251, and poles 252*a-b*, which were discussed in conjunction with FIG. 2A. FIG. 5 further includes screws 301*a-c*, which were discussed in conjunction with FIG. 3A. FIG. 5 further includes screws 401*a-c*, cover 432, pivot 434, propeller 460, and axle 461, which were discussed in conjunction with FIG. 4. FIG. 5 may further includes motors 501*a* and 501*b*, motor gears 502*a* and 502*b*, axle gears 503*a* and 503*b*, control circuit 505, socket 508, filter 510, and flow directions 511*a-m*. In other embodiments, FIG. 5 may not have all of the elements or features listed and/or may have other elements or features instead of or in addition to those listed.

Motors 501*a* and 501*b* are electric motors located within the housing of pumps 211*a* and 211*b*, respectively, for turning propellers 160 and 460 when electricity is provided. In at least one embodiment, motors 501*a* and 501*b* rotate shafts and motor gears that are mounted on the shafts. In an embodiment, motors 501*a* and 501*b* are electric motors. When the user connects the power cord 150 of pool cleaner 100*a* to the power outlet, the electricity travels through the power cord 150 to either of the motors 501*a* and 501*b*, powering motors 501*a* and 501*b*, one at a time, for example. In at least one embodiment, a control circuit is included in pool cleaner 100*a* for controlling which of the motors 501*a* and 501*b* receives electricity during a particular period of time.

Motor gears 502*a* and 502*b* are gears mounted on the shafts of the motors 501*a* and 501*b*, respectively.

Axle gears 503*a* and 503*b* engage motor gears 502*a* and 502*b*, and turn axles 161 and 461, respectively. As the motors 501*a* and 501*b* rotate the axle shafts, motor gears 502*a* and 502*b* rotate, which in turn rotate axle gears 503*a* and 503*b*, which in turn rotate axles 161 and 461, thereby rotating propellers 160 and 460, respectively. The ratio of the diameter of axle gears 503*a* and 503*b* and motor gears 502*a* and 502*b* determines the ratio of the speed of rotation of the motor shafts of the motors 501*a* and 501*b* and the propellers 160 and 460, respectively.

Control circuit 505 includes an electronically controlled switch connected to a timer circuit for switching electricity flow to either of motors 501*a* and 501*b* in order to activate pumps 211*a* and 211*b* alternatively, one at a time, to change the direction of travel. In at least one embodiment, control circuit 505 switches transmission of electricity at random time points, or after one pump is working for a period that is randomly set (e.g., after pump 211*a* is on for 15 seconds, electricity is switched to pump 211*b*, which then stays on for 11 seconds). In at least one embodiment, the pumps 211*a* and 211*b* is alternatively turned on under the control of control circuit 505 causing pool cleaner 100*a* to move in zigzag routes. In other embodiments, control circuit 505 may include other settings or other structures for controlling the electricity for powering pumps 211*a* and 211*b*.

Socket 508 is located inside the pump chamber 210 under the port that is on the top of the pump chamber 210. In at least one embodiment, socket 508 engages with a plug within the electrical connector 251 and transmits electricity from the power cord 150 to the control circuit 505 and to the motors 501*a* and 501*b*. In at least one embodiment, the port above socket 508 has screw threads on the outer surface for hermetically engaging electrical connector 251.

Filter 510 is a filter that is installed within the body of pool cleaner 100*a* and blocks any debris in the water from passing through as the water flows in and out of the body, thereby filtering the water. Filter 510 may include materials such as a fabric that allows water to pass and blocks large particles. In an embodiment, filter 510 may be attached to the head 110 or base 120 of the pool cleaner 100*a*. In at least one embodiment, filter 510 may also include structures for supporting the fabric or other materials through which the water passes when under hydraulic pressure (e.g., as a result of pumps 211*a* and/or 211*b* being turned on). In at least one embodiment, when at least one of pumps 211*a* and 211*b* is turned on and pushes water out of the pool cleaner 100*a*, a negative pressure is created inside the body to draw water into the body and through the filter, and then water exits the pool cleaner 100*a*.

Flow directions 511*a-m* include a plurality of arrows showing the directions of flow of water as if both pumps 211*a* and 211*b* were on (although in practice it may be that only one pump is on at a time). In at least one embodiment, pumps 211*a* and 211*b* are turned on alternatively, one at a time, to discharge water out of the pool cleaner 100*a* through the discharge opening that the pump that is on faces. FIG. 5 shows the directions of water flow propelled by both pumps 211*a* and 211*b*. It should be understood by people skilled in the art that when one pump is turned on, water that is drawn into the body and through the filter exits the pool cleaner 100*a* via the discharge opening that the pump that is on faces, while the other discharge opening that the pump that is off faces is closed as a result of the negative pressure created by the pump that is on.

Figure 6A:
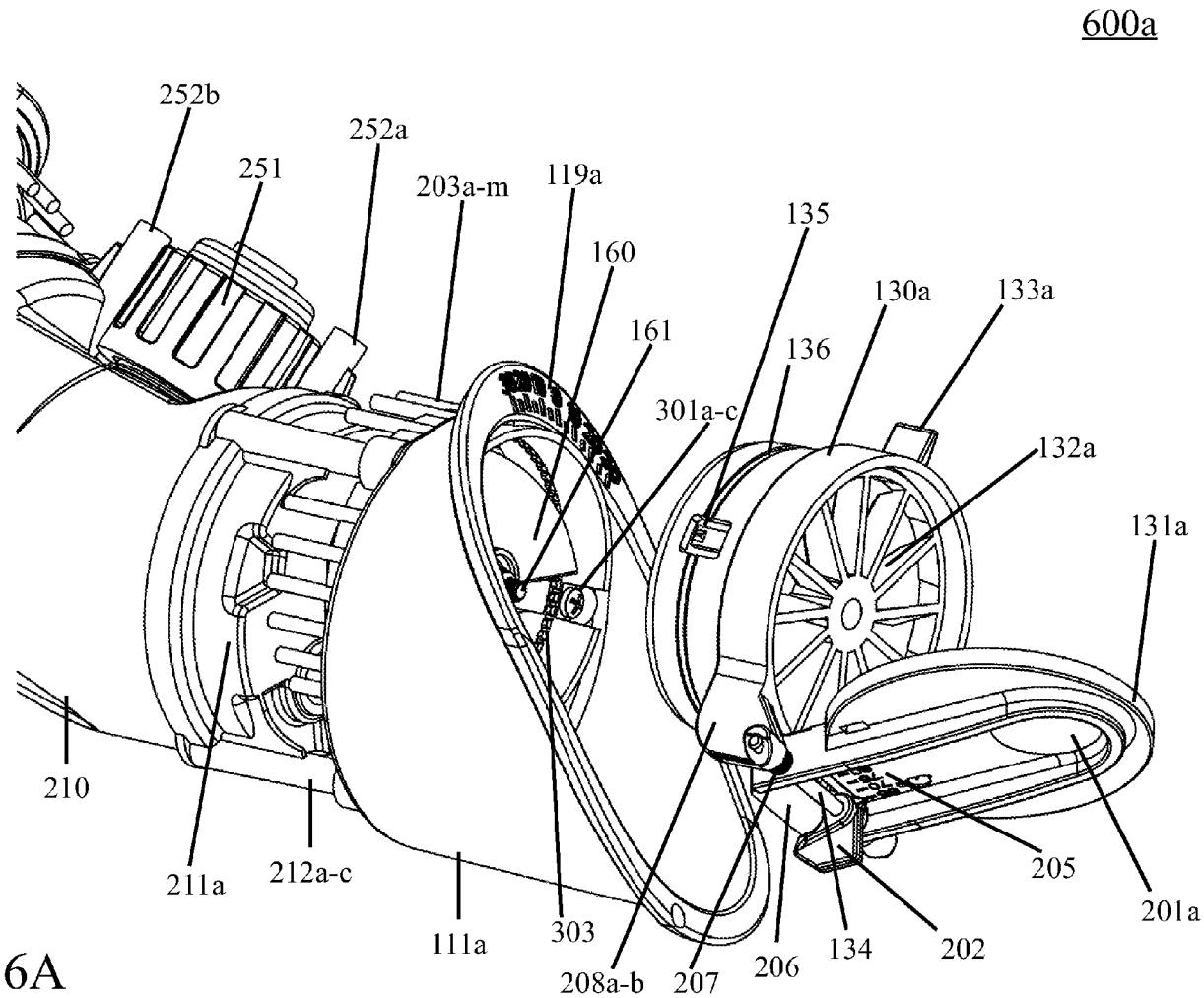
FIG. 6A shows an enlarged view of an embodiment of a portion of the pump assembly of FIG. 2A with the neck portion disconnected from the pump assembly.

FIG. 6A shows an enlarged view 600*a* of an embodiment of a portion of the pump assembly 200*a* of FIG. 2A with the neck portion 130*a* disconnected from the pump assembly 200*a*. FIG. 6A includes at least discharge mount 111*a*, rotation markings 119*a*, neck portion 130*a*, flap 131*a*, cover 132*a*, indicator tab 133*a*, pivot 134, tab 135, groove 136, propeller 160, and axle 161, which were discussed in conjunction with FIGS. 1A and 1B. FIG. 6A also includes protrusion 201*a*, sliding stop 202, protecting rods 203*a-m*, pump chamber 210, pump 211*a*, poles 212*a-c*, electrical connector 251, and poles 252*a-b*, which were discussed in conjunction with FIG. 2A. FIG. 6A further includes flap markings 205, bar 206, spring 207, and pivot mounts 208*a-b*, which were discussed in conjunction with FIG. 2B. FIG. 6A further includes screws 301*a-c* and bumps 303, which were discussed in conjunction with FIG. 3A. In other embodiments, the assembly of FIG. 6A may not have all of the elements or features listed and/or may have other elements or features instead of or in addition to those listed.

FIG. 6A shows an enlarged view of a portion of FIG. 2A when the neck portion 131*a* is disconnected from the circular opening of discharge mount 111*a*.

Figure 6B:
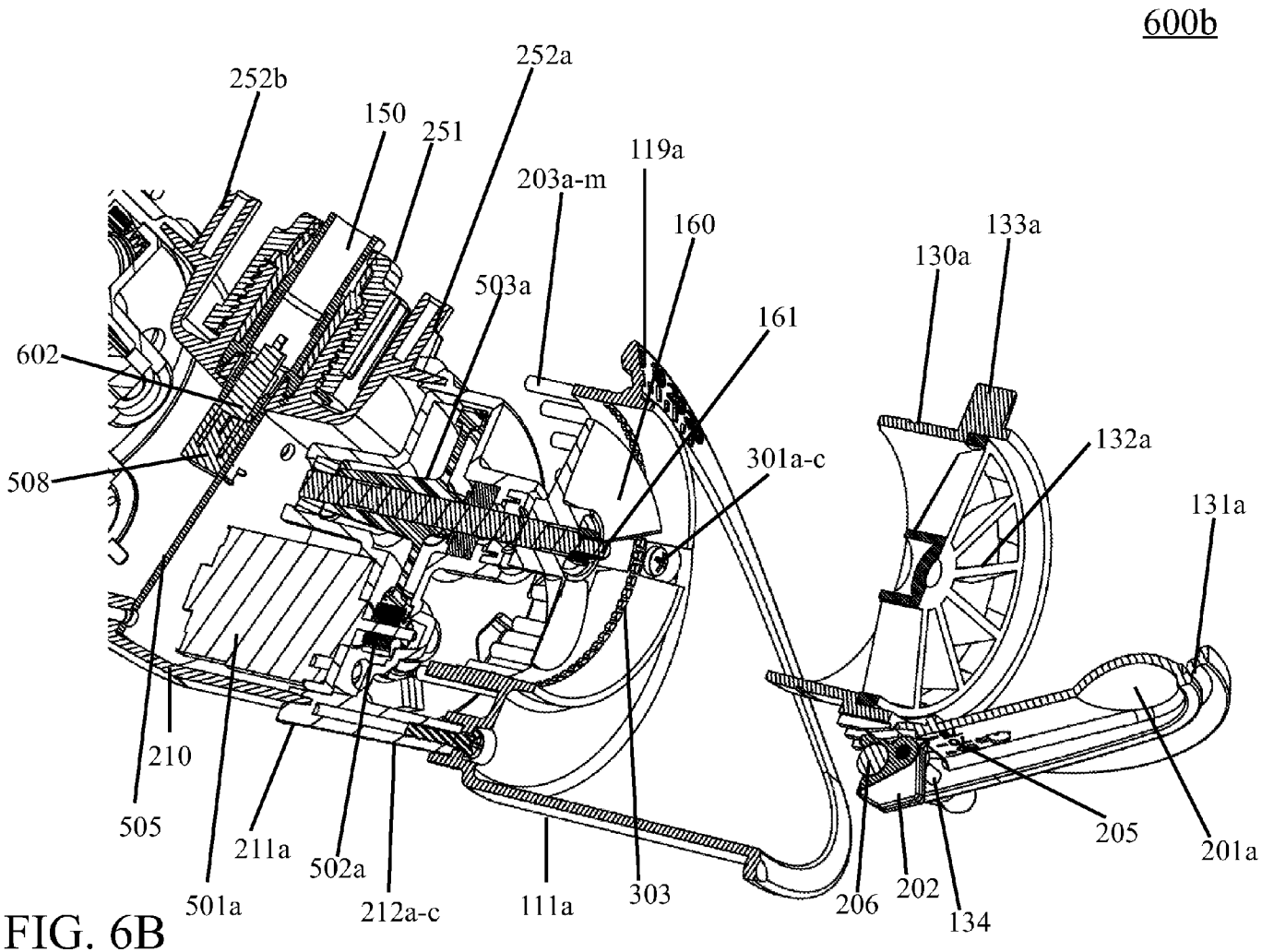
FIG. 6B shows a cross sectional enlarged view of an embodiment of a portion of the pump assembly of FIG. 2A with the neck portion disconnected from the pump assembly.

FIG. 6B shows a cross sectional enlarged view 600*b* of an embodiment of a portion of the pump assembly 200*a* of FIG. 2A with the neck portion 130*a* disconnected from the pump assembly 200*a*. FIG. 6B includes at least discharge mount 111*a*, rotation markings 119*a*, neck portion 130*a*, flap 131*a*, cover 132*a*, indicator tab 133*a*, pivot 134, power cord 150, propeller 160, and axle 161, which were discussed in conjunction with FIGS. 1A and 1B. FIG. 6B also includes protrusion 201*a*, sliding stop 202, protecting rods 203*a-m*, pump chamber 210, pump 211*a*, poles 212*a-c*, electrical connector 251, and poles 252*a-b*, which were discussed in conjunction with FIG. 2A. FIG. 6B further includes flap markings 205 and bar 206, which were discussed in conjunction with FIG. 2B. FIG. 6B further includes screws 301*a-c* and bumps 303, which were discussed in conjunction with FIG. 3A. FIG. 6B further includes motor 501*a*, motor gear 502*a*, axle gear 503*a*, control circuit 505, and socket 508, which were discussed in conjunction with FIG. 5. FIG. 6B may further include a plug 602. In other embodiments, the assembly of FIG. 6B may not have all of the elements or features listed and/or may have other elements or features instead of or in addition to those listed.

FIG. 6B shows a cross sectional view of FIG. 6A when the neck portion 131*a* is disconnected from the circular opening of discharge mount 111*a*.

Plug 602 is an electrical plug structure that is attached in the electrical connector 251 for connecting the power cord 150 to the socket 508 that is below the port of the pump chamber 210. In at least one embodiment, plug 602 includes three electrical plug pins (e.g., one pin for a positive electrical line, one pin for a negative electrical line, and one pin for a ground line). In other embodiments, plug 602 includes another number of prongs, blades, or pins. In another embodiment, other types of electrical plug or socket structures may be substituted for the plug 602.

Figure 7A:
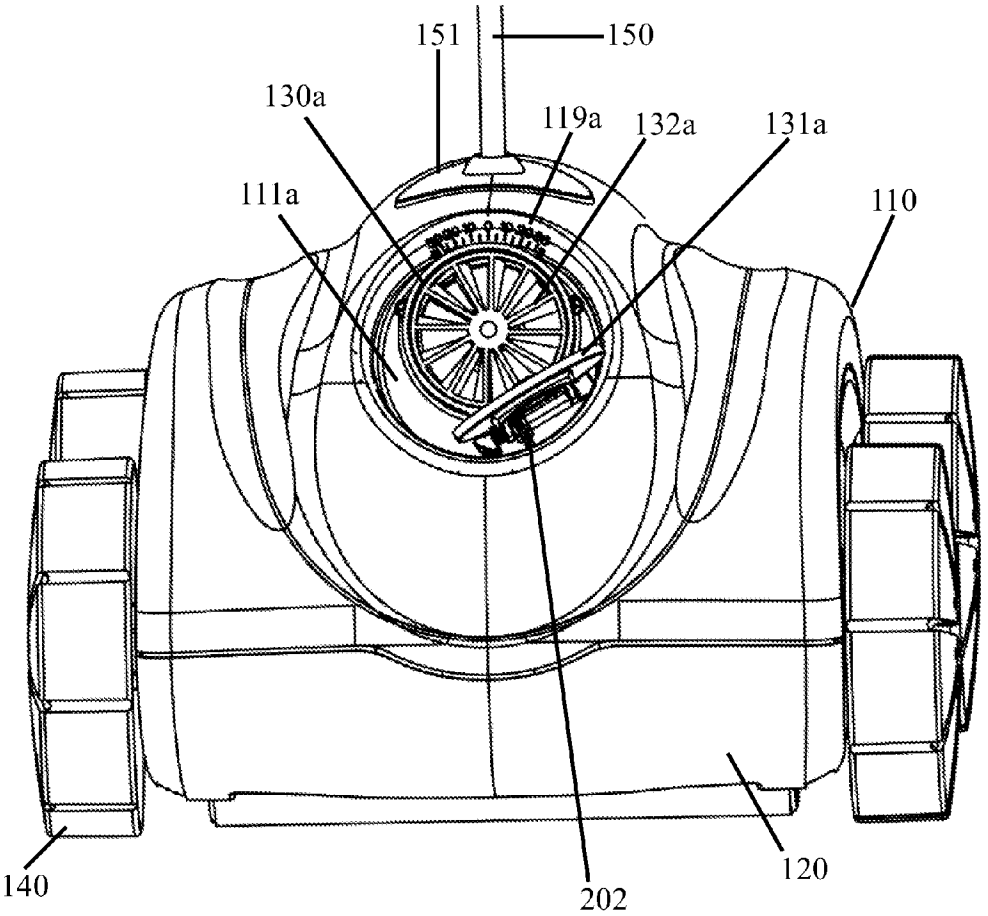
FIGS. 7A and 7B show a front view and a side view of an embodiment of the pool cleaner of FIG. 1A with the neck portions rotated 30 degrees and the flap open 90 degrees, respectively.
Figure 7B:
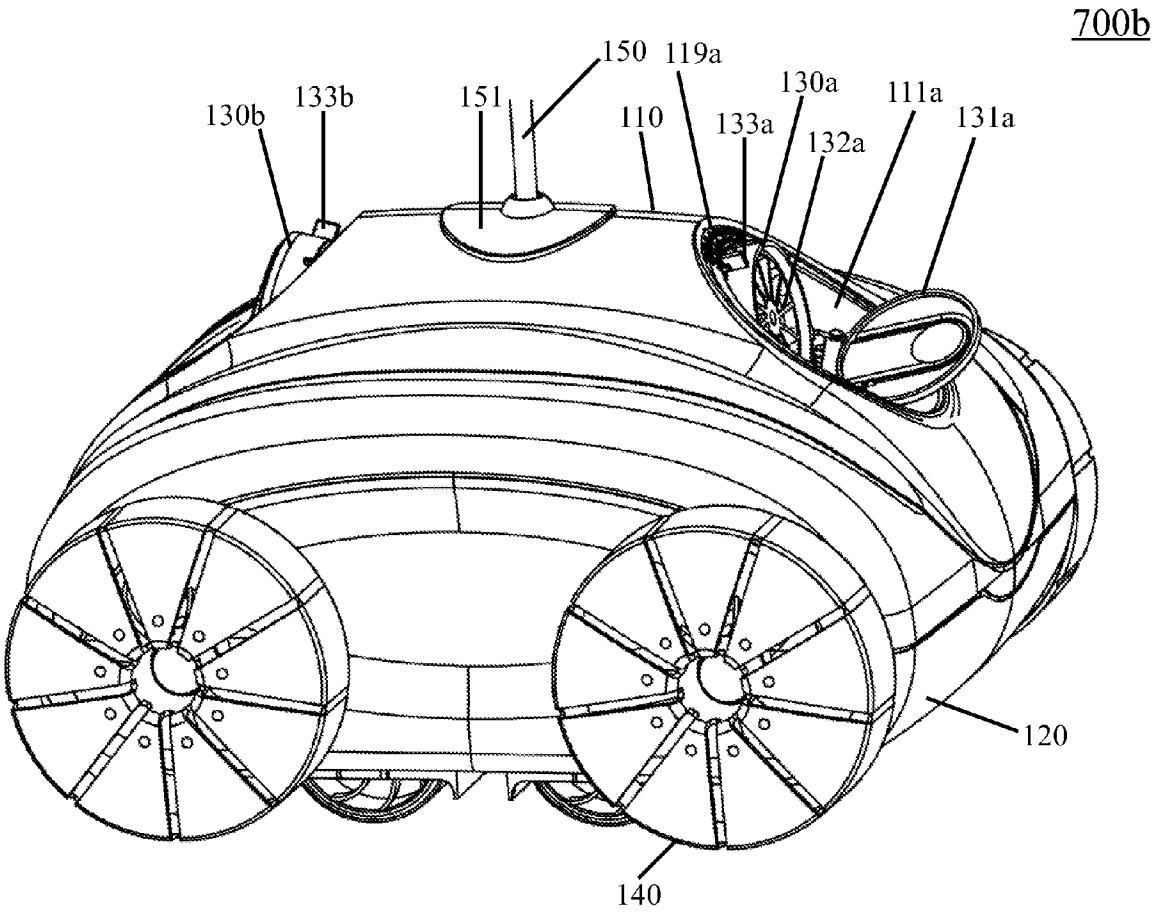

FIGS. 7A and 7B show a front view 700*a* and a side view 700*b* of an embodiment of the pool cleaner 100*a* of FIG. 1A with the neck portions 130*a* and 130*b* rotated 30 degrees and the flap 131*a* open 90 degrees, respectively. FIGS. 7A and 7B include at least head 110, discharge mount 111*a*, rotation markings 119*a*, base 120, neck portion 130*a* (and 130*b* in FIG. 7B), flap 131*a*, cover 132*a*, indicator tab 133*a* (and 133*b* in FIG. 7B), wheels 140, power cord 150, and cap 151, which were discussed in conjunction with FIG. 1A. FIG. 7A further includes sliding stop 202, which was discussed in conjunction with FIG. 2A. In other embodiments, FIGS. 7A and 7B may not have all of the elements or features listed and/or may have other elements or features instead of or in addition to those listed.

FIGS. 7A and 7B show a front view and a side view of pool cleaner 100*a*, with the neck portion 130*a* and flap 131*a* adjusted to a rotational angle of 30 degrees and an open angle of 90 degrees, respectively. In at least one embodiment, the pool cleaner 100*a* as in FIGS. 7A and 7B has the highest speed, because the water discharged through discharge opening of neck portion 130*a* shoots directly out with minimum blockage by the flap 131*a*, and because a larger component of the force generated by the exiting water is directed towards horizontal motion, as compared to other angles at which the water may be deflected. In at least one embodiment, the direction of movements of pool cleaner 100*a* as in FIGS. 7A and 7B may be changed as a result of the rotation of the neck portions 130*a* and 130*b*.

Figure 8A:
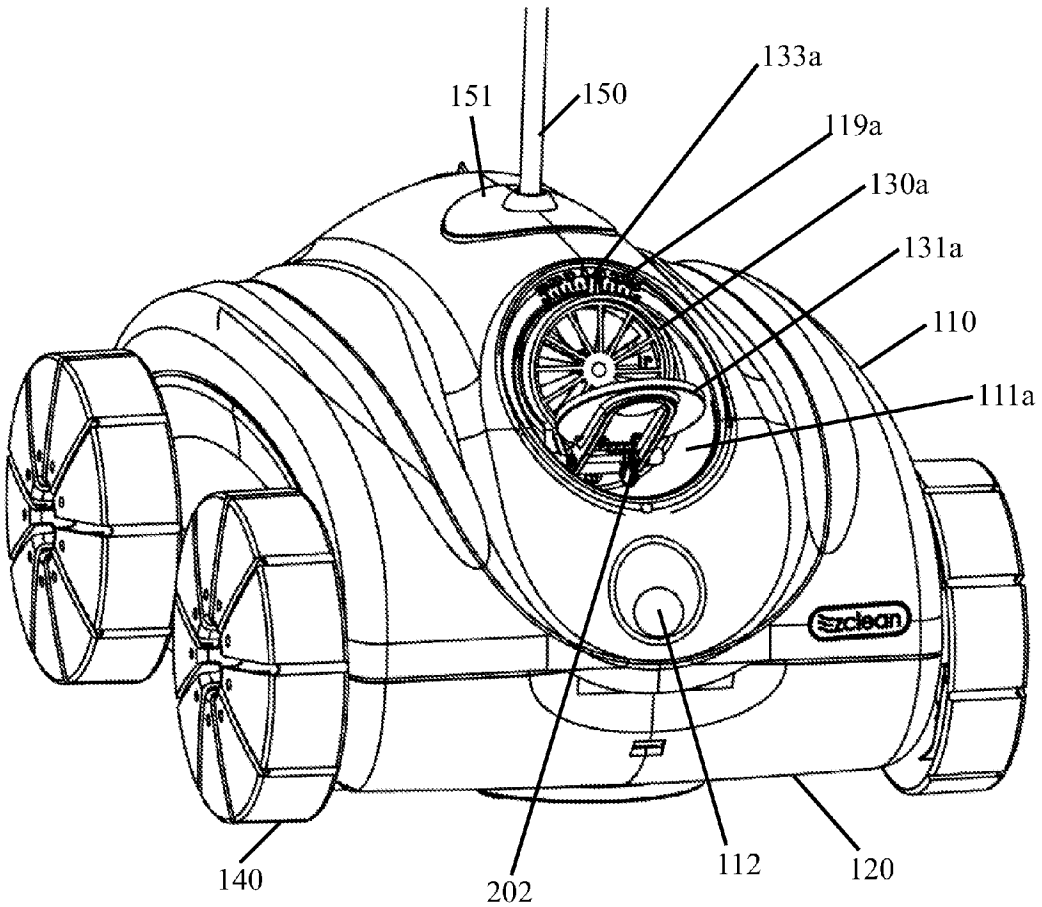
FIGS. 8A and 8B show a font view and a side view of an embodiment of the pool cleaner of FIG. 1A with the flap open 60 degrees, respectively.
Figure 8B:
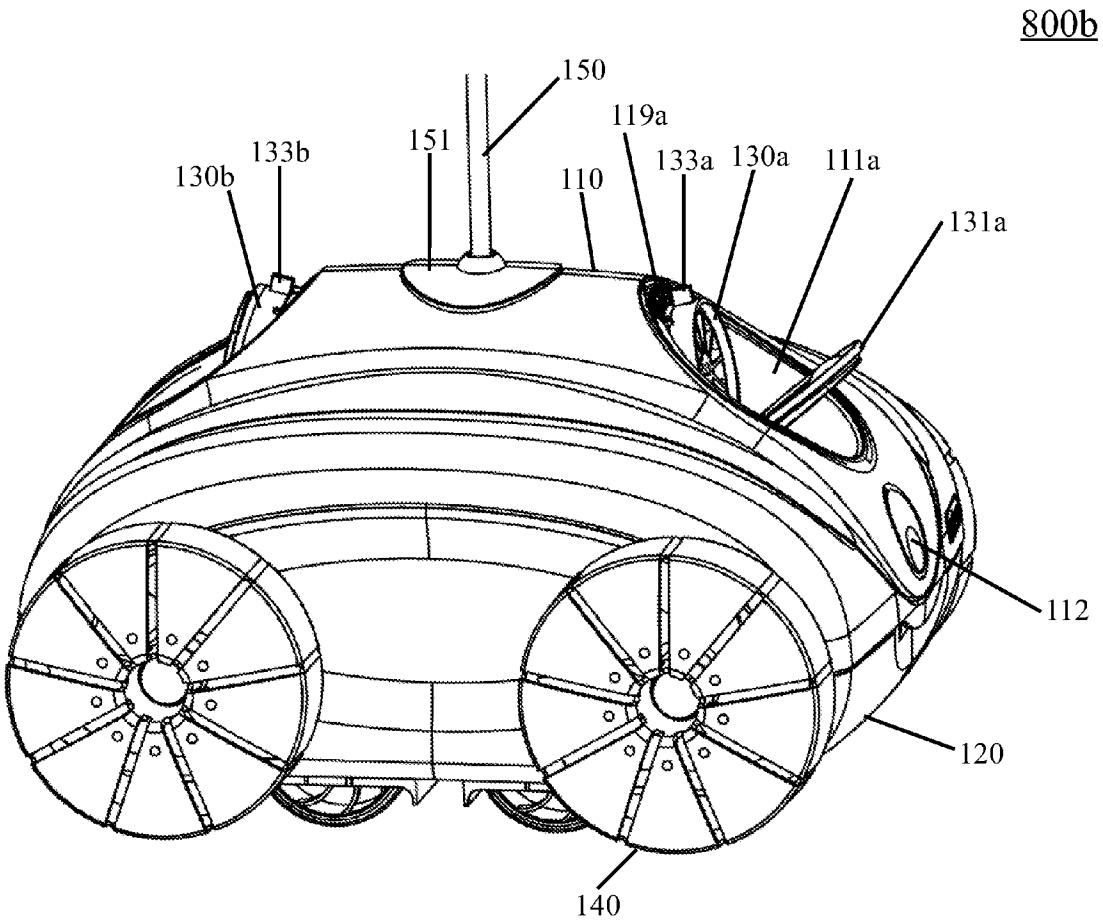

FIGS. 8A and 8B show a front view 800*a* and a side view 800*b*, respectively, of an embodiment of the pool cleaner 100*a* of FIG. 1A with the flap 131*a* open 60 degrees. FIGS. 8A and 8B include at least head 110, discharge mount 111*a*, rotation markings 119*a*, fastener 112, base 120, neck portion 130*a* (and 130*b* in FIG. 8B), flap 131*a*, indicator tab 133*a* (and 133*b* in FIG. 8B), wheels 140, power cord 150, and cap 151, which were discussed in conjunction with FIG. 1A. FIG. 8A further includes sliding stop 202, which was discussed in conjunction with FIG. 2A. In other embodiments, the assemblies of FIGS. 8A and 8B may not have all of the elements or features listed and/or may have other elements or features instead of or in addition to those listed.

FIGS. 8A and 8B show a front view and a side view of pool cleaner 100*a*, with the neck portion 130*a* and flap 131*a* adjusted to a rotational angle of zero degrees and an open angle of 60 degrees, respectively. In at least one embodiment, the pool cleaner 100*a* as in FIGS. 8A and 8B has the lowest speed because the water discharged out of the neck portion 130*a* bounces against the flap 131*a* and then runs approximately upward, therefore creating a force to push the pool cleaner 100*a* downward, without creating much force to push the pool cleaner 100*a* forward.

Figure 8C:
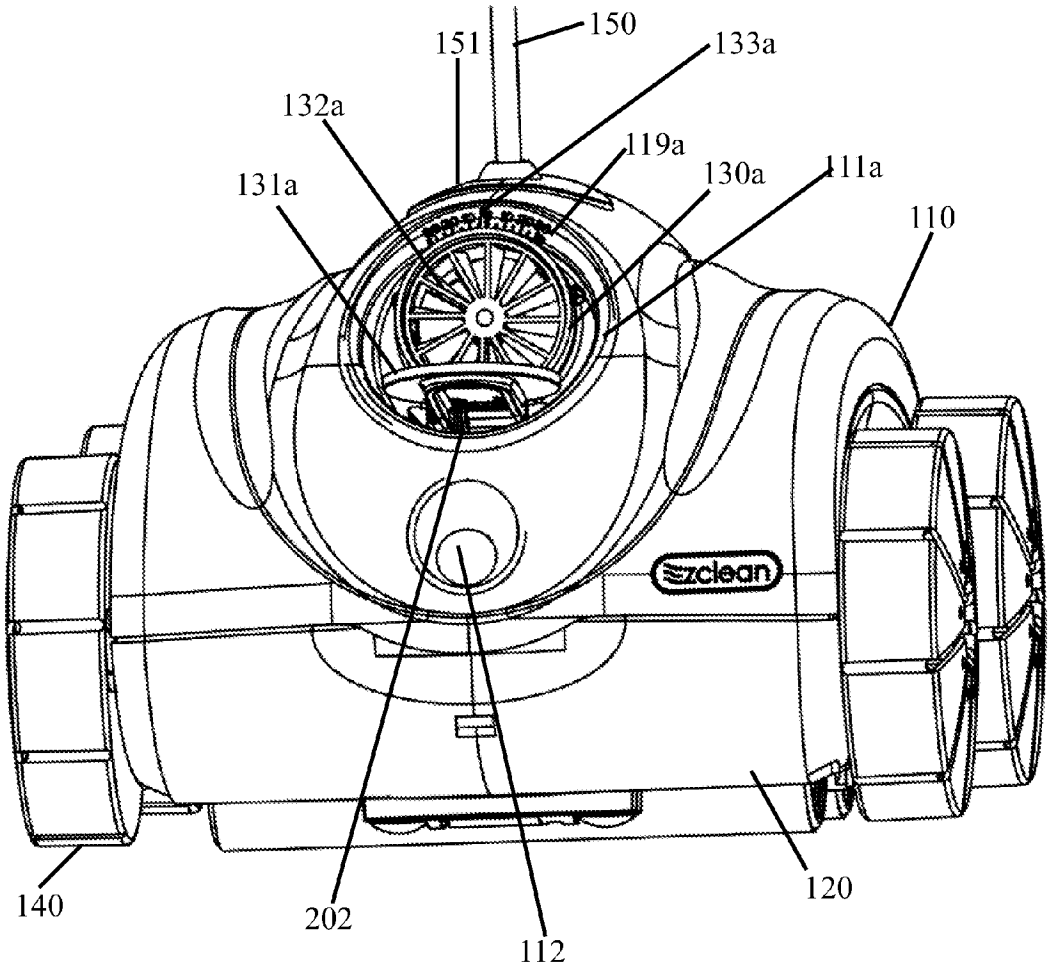
FIGS. 8C and 8D show a font view and a side view of an embodiment of the pool cleaner of FIG. 1A with the flap open 90 degrees, respectively.
Figure 8D:
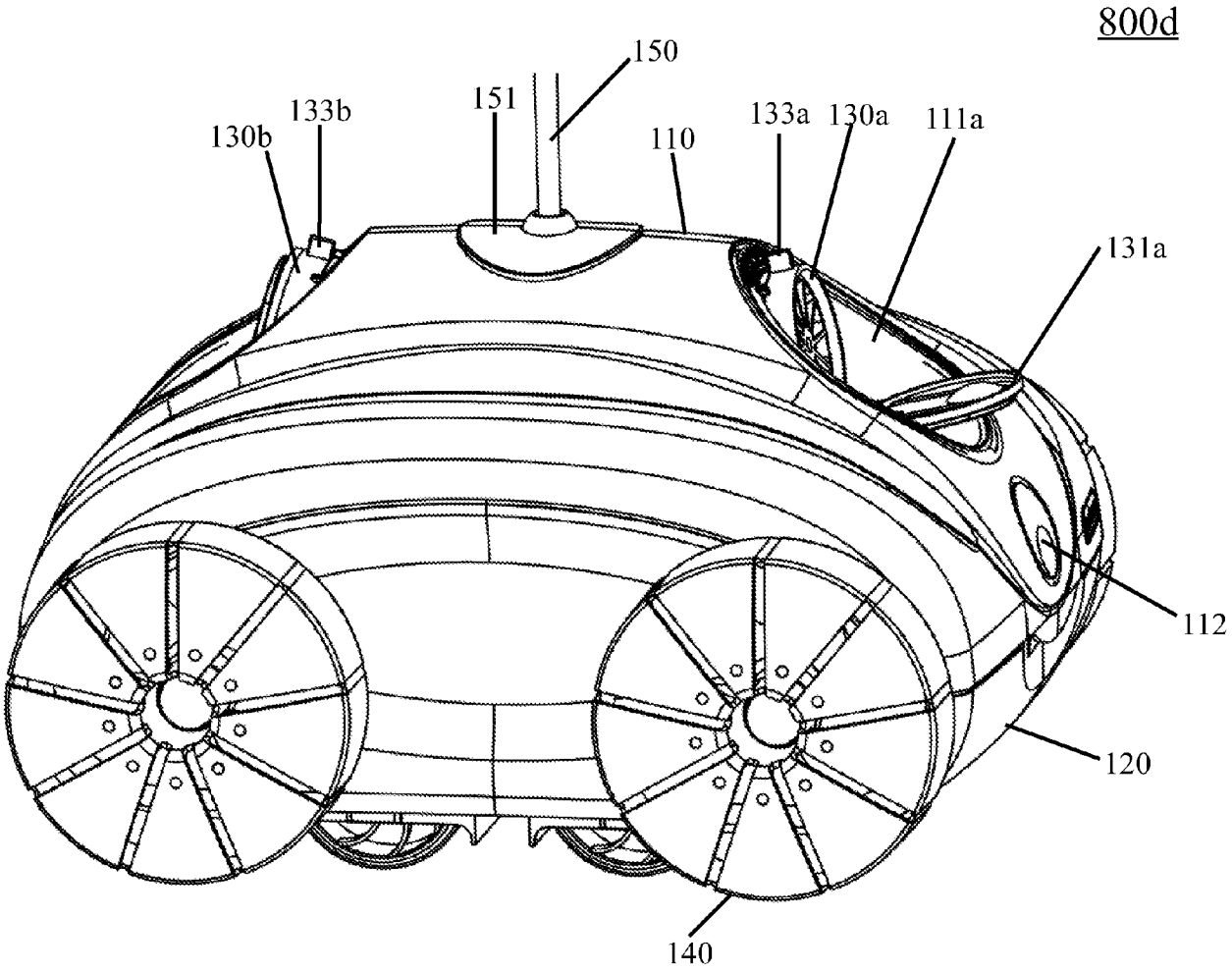

FIGS. 8C and 8D show a front view 800*c* and a side view 800*d*, respectively, of an embodiment of the pool cleaner 100*a* of FIG. 1A with the flap 131*a* open 90 degrees. FIGS. 8C and 8D include at least head 110, discharge mount 111*a*, rotation markings 119*a*, fastener 112, base 120, neck portion 130*a* (and 130*b* in FIG. 8D), flap 131*a*, indicator tab 133*a* (and 133*b* in FIG. 8D), wheels 140, power cord 150, and cap 151, which were discussed in conjunction with FIG. 1A. FIG. 8C further includes sliding stop 202, which was discussed in conjunction with FIG. 2A. In other embodiments, the assembly of FIGS. 8C and 8D may not have all of the elements or features listed and/or may have other elements or features instead of or in addition to those listed.

FIGS. 8C and 8D show a front view and a side view of pool cleaner 100*a*, respectively, with the neck portion 130*a* and flap 131*a* adjusted to a rotational angle of zero degrees, while flap 131*a* is open to angle of 90 degrees. In at least one embodiment, the pool cleaner 100*a* as in FIGS. 8C and 8D has the highest speed because the water discharged out of the neck portion 130*a* shoots directly out with minimum blockage by the flap 131*a*.

Figure 9:
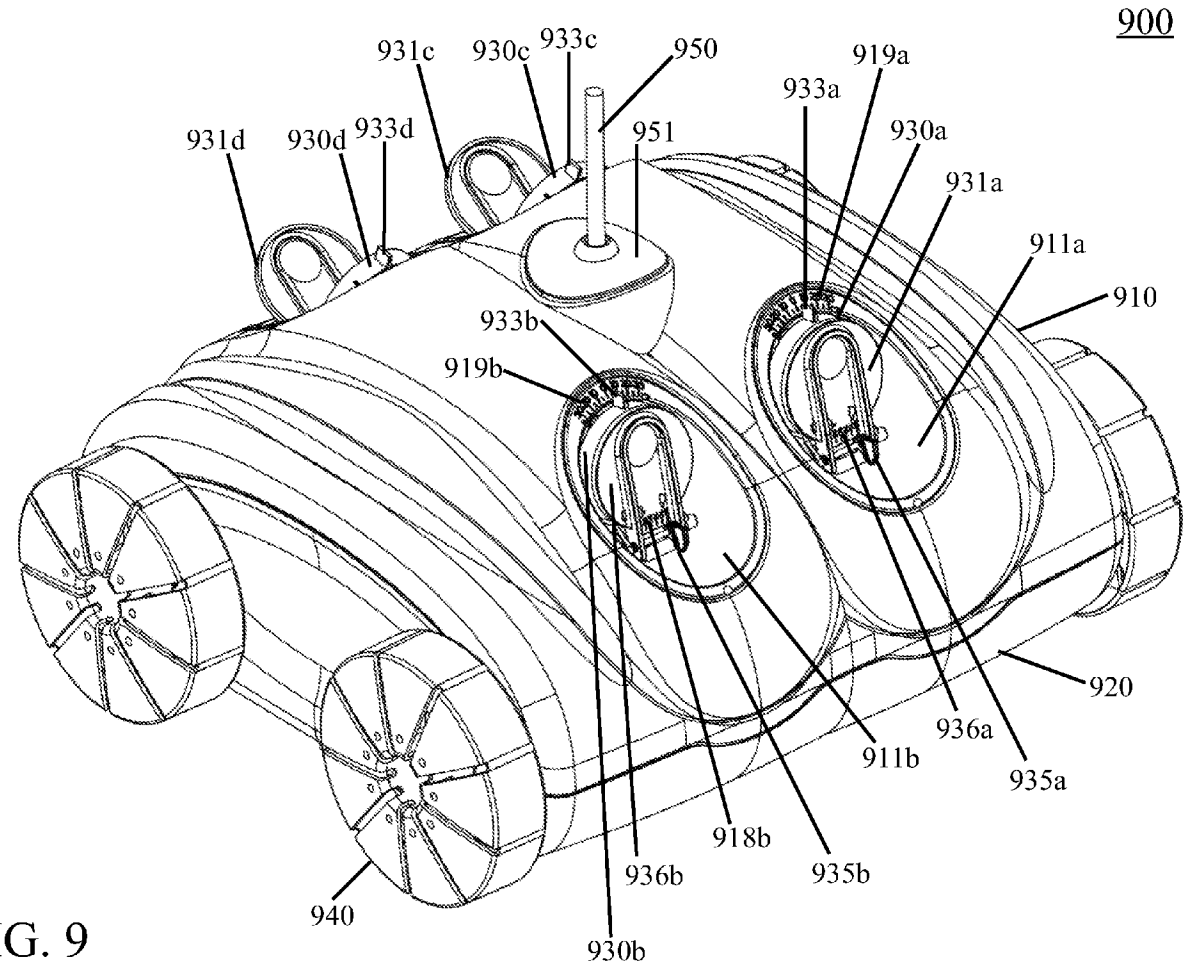
FIG. 9 shows a diagram of an embodiment of a pool cleaner having four pumps.

FIG. 9 shows a diagram of an embodiment of a pool cleaner 900 having four pumps. Pool cleaner 900 includes at least a head 910, discharge mounts 911*a* and 911*b*, rotation markings 919*a* and 919*b*, a base 920, neck portions 930*a-d*, flaps 931*a-d*, indicator tabs 933*a-d*, sliding members 935*a* and 935*b*, flap markings 936*a* and 936*b*, wheels 940, a power cord 950, and a cap 951. In other embodiments, pool cleaner 900 may not have all of the elements or features listed and/or may have other elements or features instead of or in addition to those listed.

FIG. 9 shows that pool cleaner 900 includes four pumps, two at each side, for discharging water out through discharge openings thus creating propulsion to move pool cleaner 900 across the floor of the pool. In at least one embodiment, the pair of pumps on one end and the other pair of pumps on the other end are turned on alternatively, one pair at a time, causing pool cleaner 900 to reverse direction every time the pair of pumps that is on is changed. In at least one embodiment, pool cleaner 900 includes two pump assemblies in which each pump assembly has two pumps. Each of the pump assemblies of FIG. 9 is similar to the pump assembly 200 (discussed in conjunction with FIG. 2), and each of the two pump assemblies is positioned parallel with the other with two pump assemblies. Each pump assembly includes two pumps facing a proximately opposite direction to each other. Each end of pool cleaner 900 are a pair of parallel pumps in which each pump of the pair is part of a different pump assembly. In at least one embodiment, each of the four pumps faces a neck portion that is pivotally connected to a flap, similar to the neck portion 130*a* and flap 131*a* as discussed in conjunction with FIG. 1A. In at least one embodiment, the speed and/or direction of pool cleaner 900 may be adjusted by adjusting the angles that the four flaps may be opened, and/or the rotational angles of the four neck portions. In at least one embodiment, pool cleaner 900 creates stronger propulsion compared to the pool cleaner 100*a* as a result of there always being two pumps being on at the same time.

Head 910 is similar to the head 110 except that head 110 includes two oval shaped openings while head 910 includes four oval shaped openings, two at either end, through which water is discharged out of the pool cleaner 910. Head 910 also houses two pump assemblies, in parallel with each other, with four pumps, each of the four pumps facing one of the four oval shaped openings for propelling water out of pool cleaner 910.

Discharge mounts 911*a* and 911*b* are mounting structures, each of which is similar to the discharge mount 111*a* as discussed in conjunction with FIG. 1A. In at least one embodiment, discharge mounts 911*a* and 911*b* are at the same side of the head 910 for mounting to two oval shaped openings of the head 910, while another two discharge mounts are at the opposite side of the head 910 mounted to the other two oval shaped openings of the head 910. In at least one embodiment, a neck portion is connected into each of the discharge mounts.

Rotation markings 919*a* and 919*b* are markings that are similar to the rotation markings 119*a*.

Base 920 is similar to the base 120 in at least one embodiment. Base 920 is connected to head 910 to form a body that houses four pumps.

Neck portions 930*a-d* are four neck portions, each of which is similar to the neck portion 130*a*. Neck portions 930*a-d* are connected into four discharge mounts, two at each side of head 910. In at least one embodiment, each of neck portions 930*a-d* is able to rotate with respect to the discharge mount in which the neck portion is connected, separately from one another (e.g., each of the neck portions 930*a-d* may be in a different rotational angle).

Flaps 931*a-d* are four flaps, each of which is similar to the flap 131*a*. Flaps 931*a-d* are pivotally connected to neck portions 930*a-d*, respectively. In at least one embodiment, each of flaps 931*a-d* is adjustable and may be opened to a predetermined angle, separately from one another (e.g., each of the flaps 931*a-d* may be opened in a different angle).

Indicator tabs 933*a-d* are tabs protruding from the neck portions 930*a-d*, each of which is similar to the indicator tab 133*a* for indicating the rotational angle of the neck portions 930*a-d*, respectively.

Sliding stops 935*a* and 935*b* are tabs that may slide on the pivots that connect flaps 931*a* and 931*b* to neck portions 930*a* and 930*b*, each of which is similar to the sliding stop 202. Sliding stops 935*a* and 935*b* adjust the angles to which flaps 931*a* and 931*b* are open, respectively. In at least one embodiment, another two sliding stops are included for adjusting the angles to which flaps 931*c* and 931*d* open. In at least one embodiment, the four sliding stops may be separately adjusted so that flaps 931*a-d* may be pushed open to different angles by exiting water.

Flap markings 936*a* and 936*b* are markings on flaps 931*a* and 931*b*, each of which is similar to flap markings 205, to be used in conjunction with sliding member 935*a* and 935*b* for indicating the angles to which flaps 931*a* and 931*b* opens, respectively.

In at least one embodiment, wheels 940 may be the same as the wheels 140 as discussed in conjunction with FIG. 1A. In at least one embodiment, power cord 950 and cap 951 may be the same as the power cord 150 and the cap 151, respectively, as discussed in conjunction with FIG. 1A.

Method of Use

Figure 10:
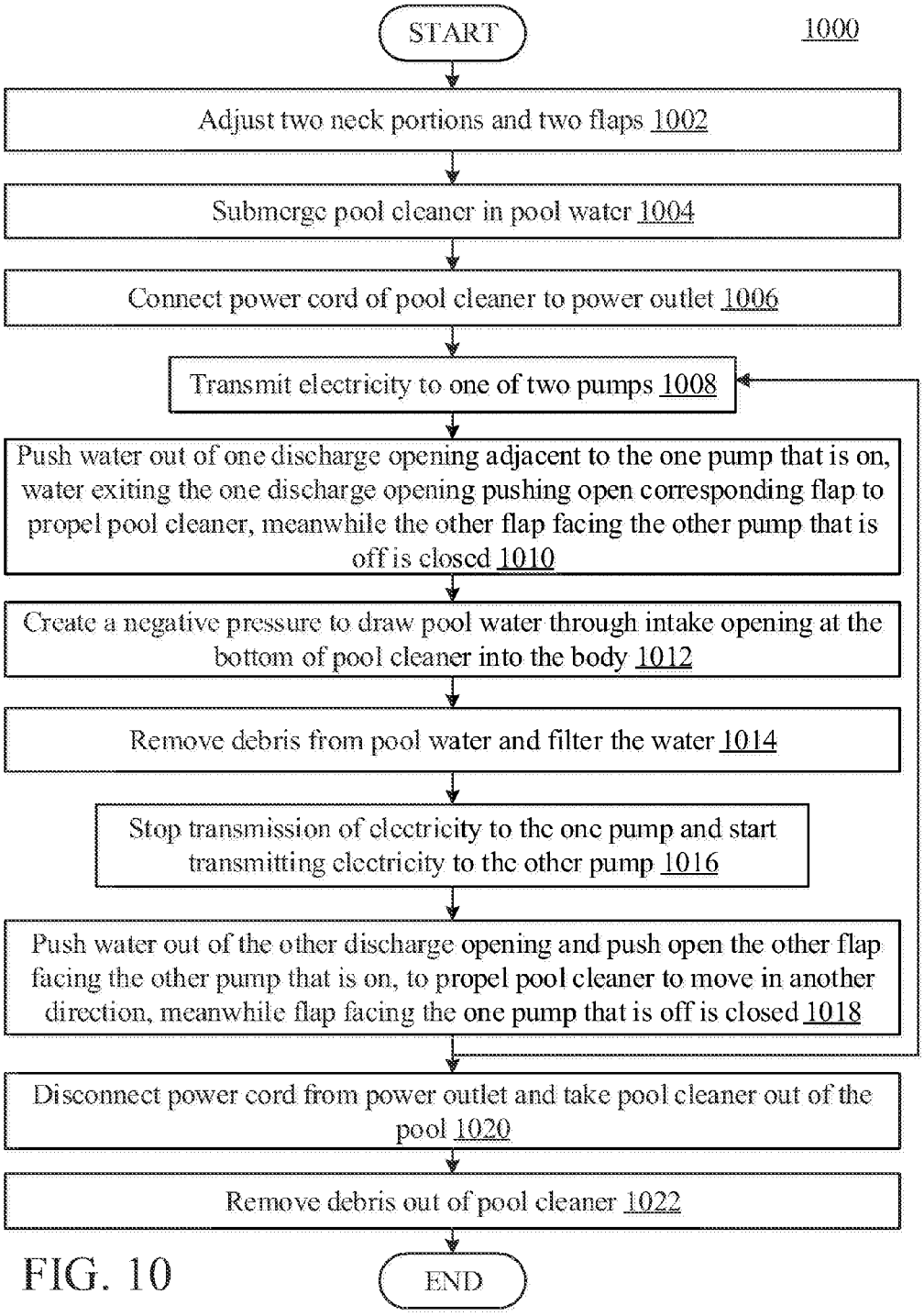
FIG. 10 shows a flowchart of an embodiment of a method of using the pool cleaner of FIG. 1A.

FIG. 10 shows a flowchart of an embodiment of a method 1000 of using the pool cleaner 100*a* of FIG. 1A.

In step 1002, the flaps 131*a* and 131*b* are adjusted by rotating the neck portions 130*a* and 130*b* until the indicator tabs 133*a* and 133*b* point to desired angles, respectively, in order to adjust the direction of movements of the pool cleaner

100*a*. In at least one embodiment, step 1002 also includes sliding the sliding members 202 and 436 on the pivots 134 and 434 until the sliding members 202 and 436 point to the desired angles to which the flaps 131*a* and 131*b* may be opened, respectively. Optionally, the user may be able to input one or more settings into control circuit 505, such as one or more dimensions of the pool (which may be used to compute how long, or how long on average, to keep the pool cleaner 100*a* moving in a particular direction prior to switching directions and how long to spend cleaning the pool). Optionally, the user may be able to directly input the average length of time that each pump should remain on prior to switching directions by changing which pump is on and which pump is off and may be able to input how long to keep the pool cleaner 100*a* moving before shutting off the pool cleaner 100*a*.

In step 1004, the pool cleaner 100*a* is submerged in pool water.

In step 1006, the power cord 150 is connected to a power outlet at the end that is not connected to the pool cleaner 100*a*.

In step 1008, electricity is transmitted to control circuit 505, which determines which motor to power and the duration of time for which the motor will be powered. Then as a result of control circuit 505, electricity is transmitted to the motor 501*a* of pump 211*a* (for example) in order to rotate the propeller 160. Alternatively, step 1008 may include transmitting electricity to the motor 501*b* of pump 211*b* to rotate the propeller 460. In at least one embodiment, the control circuit 505 controls which one of the pumps 211*a* and 211*b* is activated. In at least one embodiment, the pumps 211*a* and 211*b* are activated alternatively, one at a time. The determination of the amount of time that the pump 211*a* is left on may be based in-part of random value, and may involve determining random number that is used for the duration of time that the pump 211*a* will stay on or adding a random number to another number, and the resulting number may be the amount of time that the pump 211*a* is left on. Alternatively, the amount of time that pump 211*a* is left on may be a fixed value that is set by the user.

In step 1010, as a result of the rotation of the propeller 160, water inside the body of pool cleaner 100*a* is pushed out of the discharge opening of neck portion 130*a* and the flap 131*a* is pushed open. Water exiting the discharge opening bounces against the flap 131*a* and creates propulsion for moving the pool cleaner 100*a* in a direction that is proximately opposite to the flow of water that has bounced off the flap 131*a*. Meanwhile, the flap 131*b* is closed due to the negative pressure inside the body of pool cleaner 100*a*.

In step 1012, concurrent with and as a result of the water leaving the pool cleaner 100*a* in step 1010, a negative pressure is created inside the pool cleaner 100*a*, and the negative pressure draws pool water through an intake opening at the bottom of pool cleaner 100*a* into the body of pool cleaner 100*a*.

In step 1014, as a result of step 1012, as the water flows through the pool cleaner 100*a*, the water is forced through filter 510 that obstructs the flow of water through the pool cleaner 100*a*. Debris is removed from pool water as the pool water is filtered as a result of the water flowing through the filter 510 inside the body of pool cleaner 100*a*.

In step 1016, control circuit 505 determines that the duration of time for which pump 211*a* is kept on has ended, and the transmission of electricity to pump 211*a* is stopped. Optionally, if the duration of time for powering each pump varies, control circuit 505 determines the duration of time that pump 211*b* is to be powered. The determination of the duration of time for which the pump is kept on may be made based on a random variable as explained in conjunction with step 1008. Then, under the control of the control circuit 550, electricity is transmitted to pump 211*b* and the propeller 460 starts to rotate.

In step 1018, as a result of the rotation of propeller 460, water inside the body of pool cleaner 100*a* is pushed out of the discharge opening of neck portion 130*b*, and flap 131*b* is pushed open. Water exiting the discharge opening of neck portion 130*b* bounces against flap 131*b* and creates propulsion for moving the pool cleaner 100*a* in a direction that is proximately opposite to the flow of water that has bounced off flap 131*b*. Meanwhile, flap 131*a* is closed due to the negative pressure inside the body of pool cleaner 100*a*. Step 1018 is essentially the same as step 1010. The only difference is which pump is on and which pump is off and the resulting flow of the water.

Steps 1008-1018 are repeated until the user stops the process. Alternatively, control unit 505 may have a user adjustable setting for ending the process and shutting off both pumps 211*a* and 211*b*.

In step 1020, the power cord 150 is disconnected from the power outlet, and the pool cleaner 100*a* is taken out of the pool. In at least one embodiment, a user may pull the power cord 150 to get the pool cleaner 100*a* out of the pool.

In step 1022, debris is removed out of the filter of pool cleaner 100*a*, optionally by releasing the fastener 112 of head 110 to open the pool cleaner 100*a* and removing the filter 510 for cleaning. Optionally, step 1022 may include, before opening the body of pool cleaner 100*a*, draining water out of the body of pool cleaner 100*a* by opening a quick drain door at the bottom of the pool cleaner 100*a*.

In an embodiment, each of the steps of method 1000 is a distinct step. In another embodiment, although depicted as distinct steps in FIG. 1000, steps 1002-1022 may not be distinct steps. In other embodiments, method 1000 may not have all of the above steps and/or may have other steps in addition to or instead of those listed above. The steps of method 1000 may be performed in another order. Subsets of the steps listed above as part of method 1000 may be used to form their own method.

Method of Assembly

Figure 11:
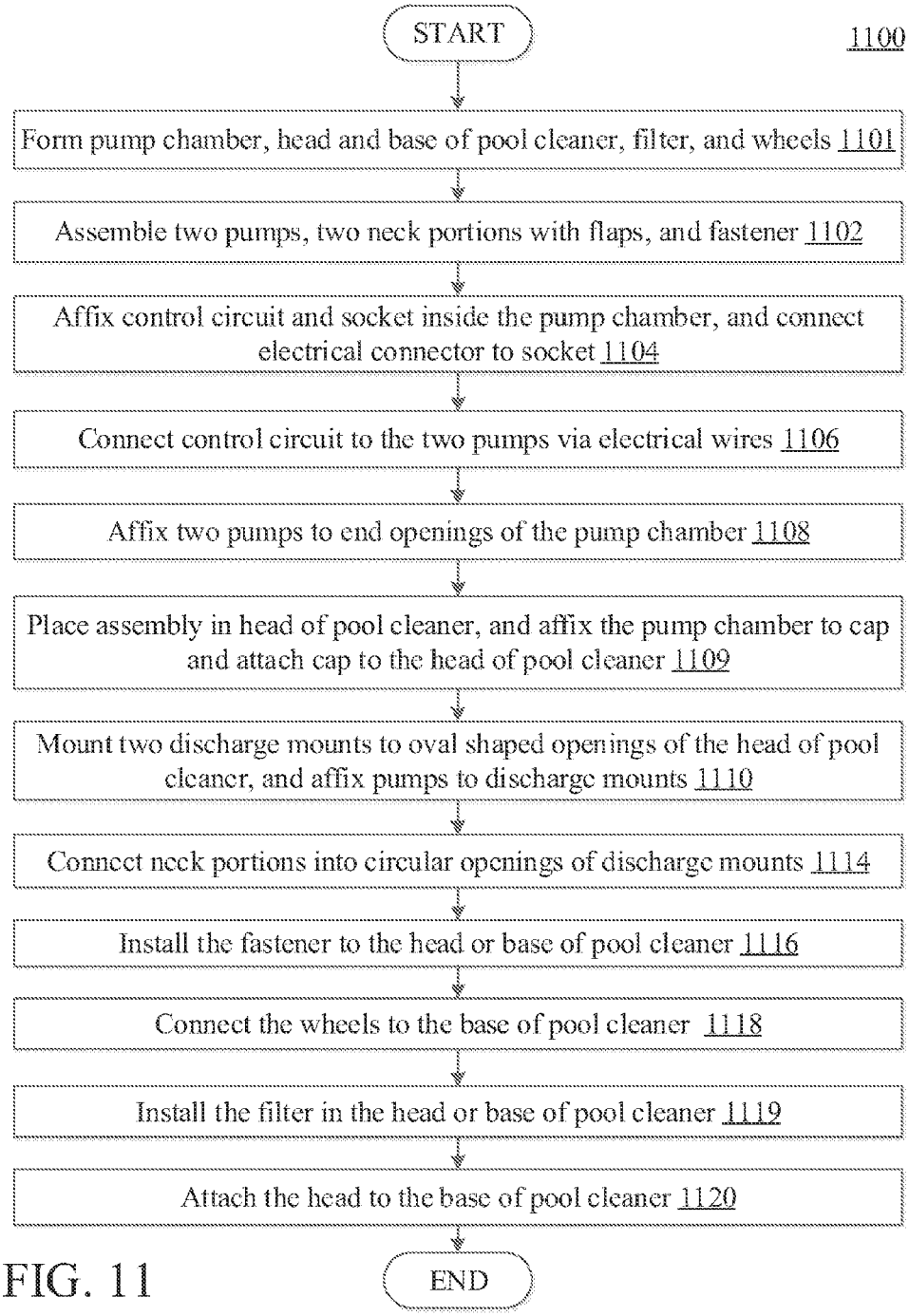
FIG. 11 is a flowchart of an embodiment of a method of making the pool cleaner of FIG. 1A.

FIG. 11 is a flowchart of an embodiment of a method 1100 of making the pool cleaner 100*a* of FIG. 1A.

In step 1101, the parts of the walls of pump chamber 210 are formed. Optionally, pump chamber 210 may be left open so that the motors (e.g., 501*a* and 501*b*), gears (e.g., 502*a-b* and 503*a-b*), axles (e.g., 161 and 461), electrical connectors 251 and/or control circuit 505 may be more easily mounted to and/or within pump chamber 210. As part of step 1101, the head 110 and base 120 of the pool cleaner 100*a* are formed. As part of step 1101, filter 510 is formed. As part of step 1101, wheels 140 are also formed.

In step 1102, pumps 211*a* and 211*b* are assembled, which may include forming the parts of the housing of pumps 211*a* and 211*b*, which may be left open so that the motors, gears and axles may be mounted within the housing. Gears 502*a* and 502*b* may be attached to the shafts of motors 501*a* and 502*b*, respectively. Axles 161 and 461 may be connected to gears 503*a* and 503*b*, respectively. The two assemblies having axles 161 and 461 and gears 503*a* and 503*b* are mounted to a wall of pump 211*a* and 211*b*, respectively, and the two assemblies having gears 502*a* and 502*b* and motors 501*a* and 501*b* are also mounted to a housing of pump 211*a* and 211*b*, respectively, such that gears 502*a* and 502*b* engage gears 503*a* and 503*b*, respectively (so that when motors 501*a* and 501*b* are turned on, gears 502*a* and 502*b* rotate, which in turn cause gears 503*a* and 503*b* to rotate, which then rotate axles 161 and 461, and which in turn rotate propellers 160 and 460, respectively). The parts of the housing of pumps 211*a* and 211*b* that are not already attached to one another are attached to one another, closing the housing. In at least one embodiment, step 1102 also includes connecting the propellers 160 and 460 to the axles 161 and 461 of pumps 211*a* and 211*b*, respectively, prior to or after closing the housings of pumps 211*a* and 211*b*. As part of step 1102, neck portions 130*a* and 130*b* with flaps 131*a* and 131*b* are constructed and assembled, respectively. In at least one embodiment, step 1102 also includes using pivots 134 and 434 to connect flaps 131*a* and 131*b*, sliding members 202 and 436, and springs 207 and 437, and further to neck portions 130*a* and 130*b*, respectively. In at least one embodiment, step 1102 also includes attaching covers 132*a* and 432 inside discharge openings of neck portions 130*a* and second connector 130*b*, respectively. As part of step 1102, fastener 112 is also assembled.

In step 1104, the control circuit 505 and socket 508 is affixed inside the pump chamber 210. In at least one embodiment, the control circuit 505 and the socket 508 are electrically connected. In at least one embodiment, step 1104 may include connecting the plug 602 of electrical connector 251 to the socket 508 by screwing the electrical connector 251 onto the port on the top of the pump chamber 210.

In step 1106, control circuit 550 is electrically connected to motor 501*a* of pump 211*a*, and motor 501*b* of pump 211*b* via electrical wires. In at least one embodiment, control circuit 505 controls the transmission of electricity to activate which one of the pumps 211*a* and 211*b* and when to switch.

In step 1108, pumps 211*a* and 211*b* are affixed to the end openings of pump chamber 210. In at least one embodiment, step 1108 may include providing a water-proof seal between the pump chamber 210 and the housings of pumps 211*a* and 211*b*, for preventing water from coming in contact with the electrical elements inside pump chamber 210 when the pool cleaner 100*a* is in use. Alternatively, pumps 211*a* and 211*b* may be connected to a wall of pump chamber 210 prior to electrically connecting circuit control 505 to pumps 211*a* and 211*b*.

In step 1109, the assembly above is placed inside the head 110 of pool cleaner 100*a*, with the power cord 150 going out of head 110 through an opening on top of the head 110 and further through a hole in cap 151. In at least one embodiment, step 1109 also includes affixing the poles 252*a-b* of pump chamber 210 to the cap 151 and attaching cap 151 to the head 110, thus allowing the pump chamber 210 to stay attached inside the head 110 with the propellers 160 and 460 located in two oval shaped openings of the head 110.

In step 1110, the discharge mounts 111*a* and 111*b* are mounted and/or sealed to the two oval shaped openings of head 110. In at least one embodiment, step 1110 also includes affixing discharge mounts 111*a* and 111*b* to the poles 212*a-c* of pump 211*a*, and poles 213*a-c* of pump 211*b*, respectively. As a result, pumps 211*a* and 211*b* are stabilized and propeller 160 and 460 are positioned inside circular openings of discharge mounts 111*a* and 111*b*.

In step 1114, neck portions 130*a* and 130*b* are connected into the circular openings of the discharge mounts 111*a* and 111*b*, respectively. In at least one embodiment, neck portions 130*a* and 130*b* are positioned so that the flaps 131*a* and 131*b* may open facing upwards.

In step 1116, fastener 112 is installed on the head 110 of pool cleaner 100*a*. Alternatively in step 1116, fastener 112 may be installed on the base 120 of the pool cleaner 100*a*.

In step 1118, wheels 140 are connected to the base 120.

In step 1119, filter 510 is installed inside the head 110 or base 120 for filtering pool water. In at least one embodiment, step 1119 may include connecting a quick drain door to the bottom of the base 120 for draining water out of the pool cleaner 100*a* after the pool cleaner 100*a* is taken out of the pool.

In step 1120, the head 110 is attached to the base 120 to form the pool cleaner 100*a*. In at least one embodiment, the head 110 may be pivotally connected to the base 120 and may be locked via fastener 112.

In an embodiment, each of the steps of method 1100 is a distinct step. In another embodiment, although depicted as distinct steps in FIG. 11, steps 1101-1120 may not be distinct steps. In other embodiments, method 1100 may not have all of the above steps and/or may have other steps in addition to or instead of those listed above. The steps of method 1100 may be performed in another order. Subsets of the steps listed above as part of method 1100 may be used to form their own method.

Dimensions of Discharge Mount and Neck Portion

Figure 12A:
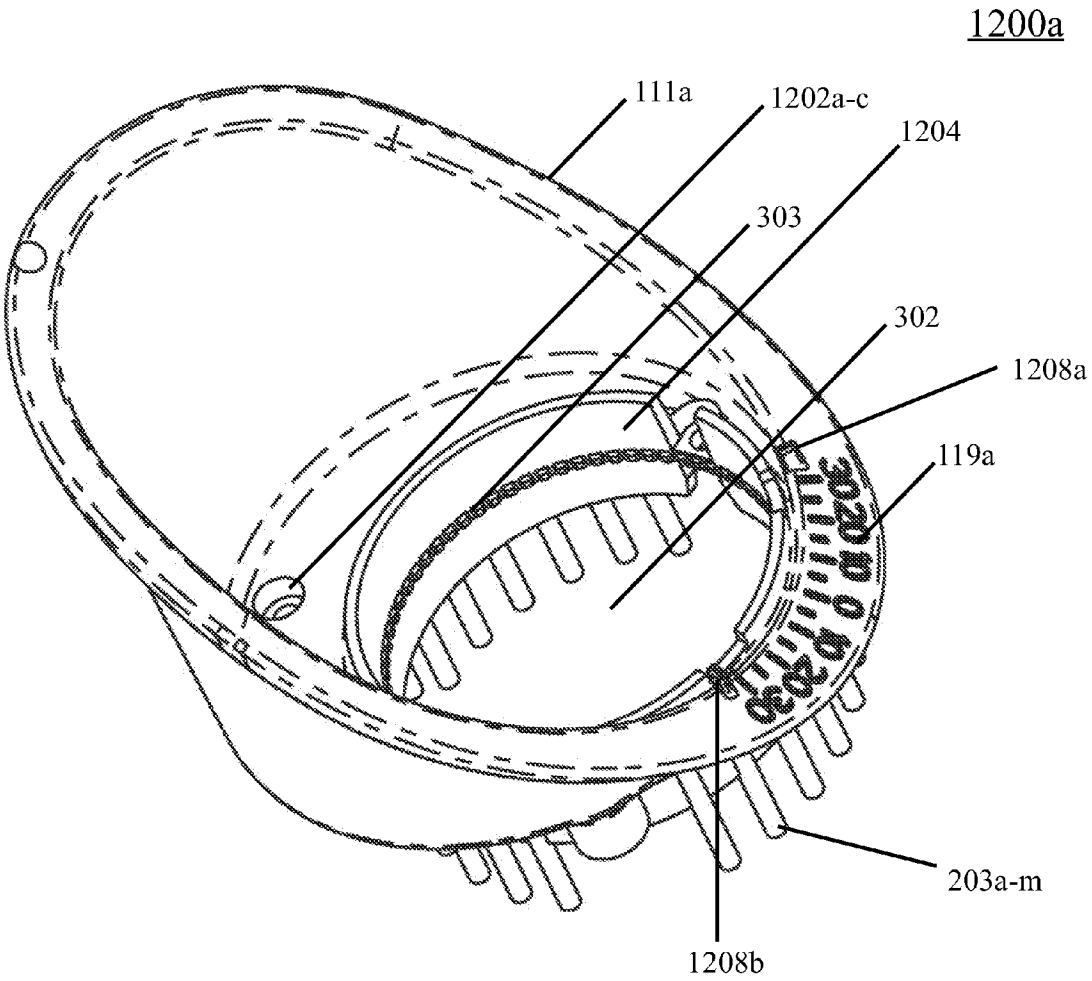
FIGS. 12A and 12B show a front view and a back view of an embodiment of the discharge mount of FIG. 1A, respectively.
Figure 12B:
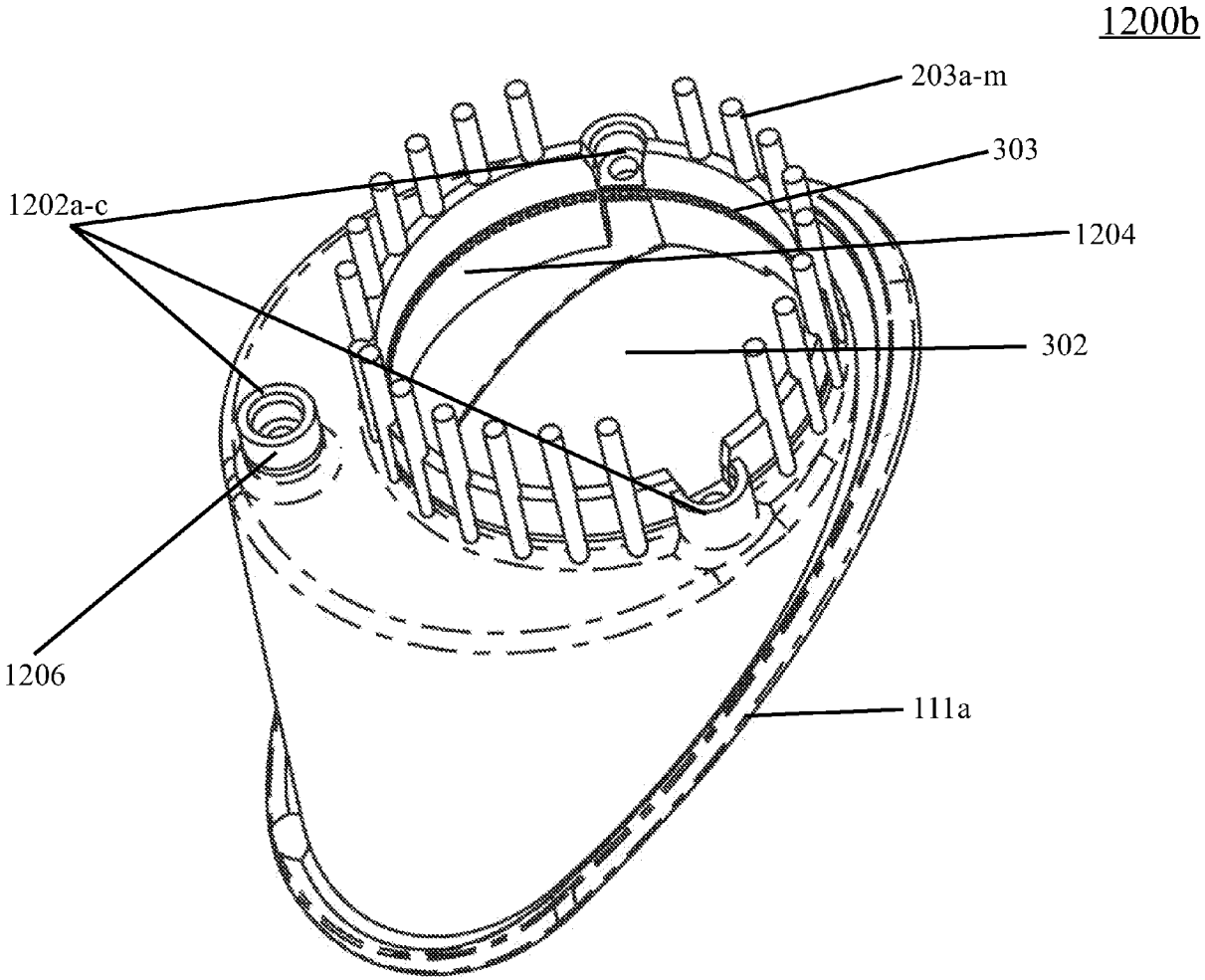

FIGS. 12A and 12B show a front view 1200*a* and a back view 1200*b* of an embodiment of the discharge mount 111*a* of FIG. 1A, respectively. FIGS. 12A and 12B include at least discharge mount 111*a*, protecting rods 203*a-m*, circular opening 302, and bumps 303, which were discussed in conjunction with FIGS. 1A, 2A, and 3A, respectively. FIG. 12A also includes rotation markings 119*a*, which was discussed in conjunction with FIG. 1A. FIGS. 12A and 12B further include screw holes 1202*a-c*, a collar 1204, a post 1206, and tabs 1208*a-b*. In other embodiments, FIGS. 12A and 12B may not have all of the elements or features listed and/or may have other elements or features instead of or in addition to those listed.

FIG. 12A-B show the features of discharge mount 111*a* that are shown in the prior FIGs (discharge mount 111*b* may have the same features as discharge mount 111*a*). FIG. 12A shows the side of discharge mount 111*a* that faces outside and away from the pump. FIG. 12B shows the side of discharge mount 111*a* that faces inside and towards the pump.

Screw holes 1202*a-c* are three screw holes for the screws 301*a-c* to go through and further engage poles 212*a-c* to connect the discharge mount 111*a* and the housing of the pump 211*a*. Collar 1204 is a ring shaped structure that forms the circular opening 302 in the discharge mount 111*a*. In at least one embodiment, bumps 303 protrude from the inside surface of collar 1204. Post 1206 is a post within which screw hole 1202*c* is located, for connecting the discharge mount 111*a* and the housing of the pump 211*a*. Tabs 1208*a-b* are a pair of tabs on the sides of the rotation marking 119*a*, acting as stops limiting the angle that neck portion 130*a* can rotate.

FIGS. 12C-F show diagrams of an embodiment of the dimensions of different elements of the discharge mount 111*a*. Each of FIGS. 12C-F may include at least one of the discharge mount 111*a*, rotation markings 119*a*, protecting rods 203*a-m*, circular opening 302, bumps 303, screw holes 1202*a-c*, collar 1204, post 1206, and tabs 1208*a-b*. In other embodiments, FIGS. 12C-F may not have all of the elements or features listed and/or may have other elements or features instead of or in addition to those listed.

In general, the dimensions of the elements shown in FIGS. 12C-F and in FIGS. 13B-G are in millimeters and the angles are in degrees. It will be understood by those skilled in the art that FIGS. 12C-F and FIGS. 13B-G show an example of the embodiments of the invention, and the invention is not limited to the example and dimensions shown in FIGS. 12C-F and FIGS. 13B-G.

Figure 12C:
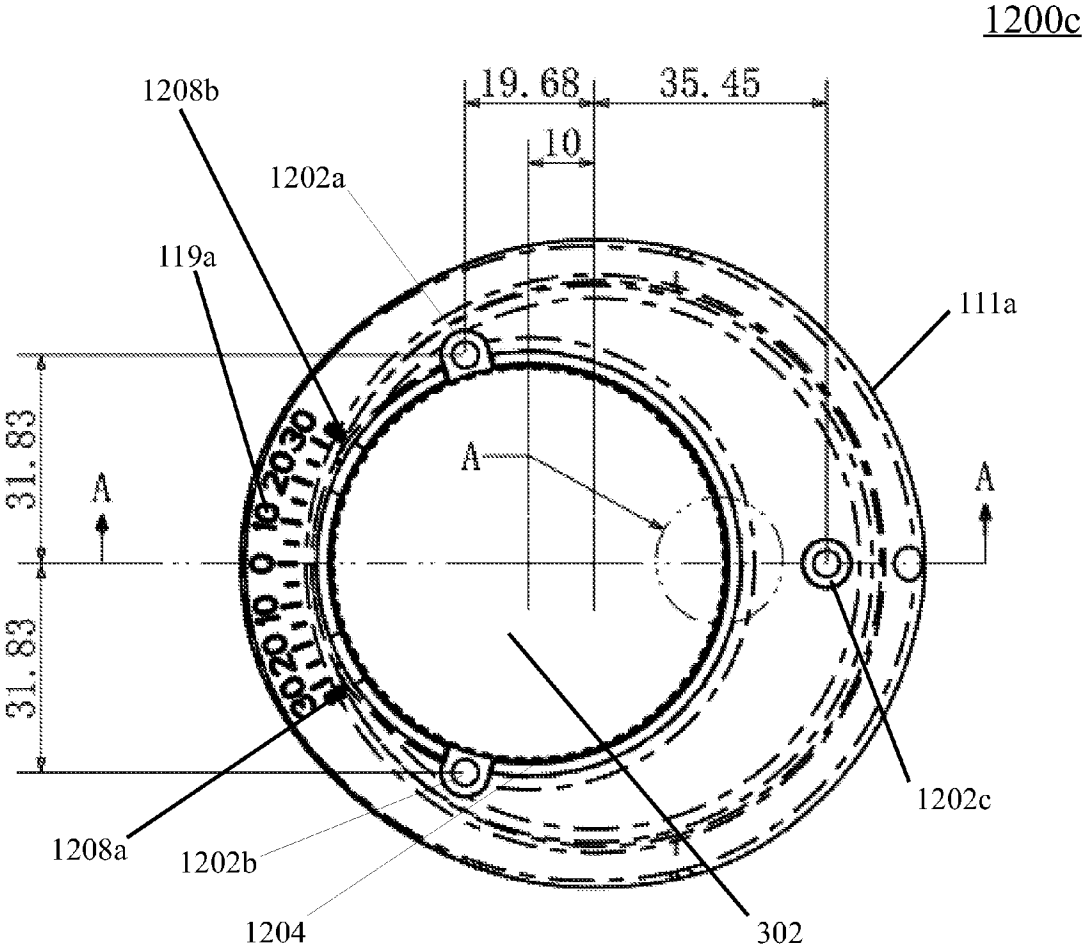
FIGS. 12C-F show diagrams of an embodiment of the dimensions of different elements of the discharge mount of FIG. 1A.

FIG. 12C shows a front view 1200*c* of discharge mount 111*a*. Screw holes 1202*a* and 1202*b* are (31.83+31.83=63.66 mm) 63.66 mm apart from one another. Circular opening 302 is not concentric with the perimeter of discharge mount 111*a*. Circular opening 302 is formed by collar 1204. The center of circular opening 302 is 10 mm off from the center of the perimeter of discharge mount 111*a* along cutline A-A. Cutline A-A passes through the zero marking and screw hole 1202*c*. A straight line connecting the centers of screw holes 1202*a* and 1202*b* would be perpendicular to cutline A-A, and would intersect cutline A-A at 19.68 mm from the center of the perimeter of discharge mount 111*a*. Screw hole 1202*c* is 35.45 mm from the center of the perimeter of charge mount 111*a*.

Figure 12D:
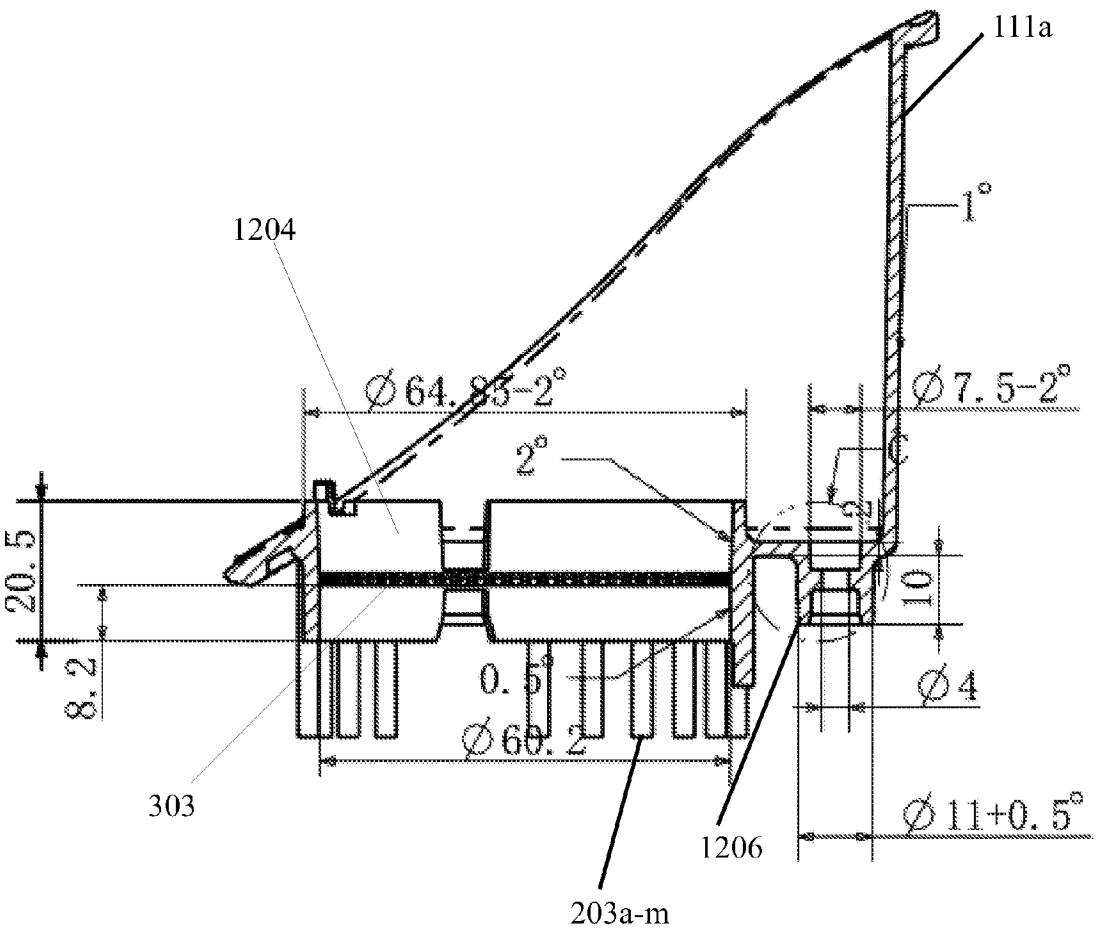

FIG. 12D is a cross-sectional view 1200*d* of discharge mount 111*a* taken along cutline A-A. The width of the collar 1204 (which forms opening 302) is 20.5 mm. The distance from the edge of bumps 303 to the edge of the collar 1204 is 8.2 mm. The inner diameter of the collar 1204 is 60.2 mm. The outer diameter of the collar 1204 is 64.83 mm. The inner diameter of the well for the screw head of screw hole 1202*c* is 7.5 mm. The inner diameter of the channel that accepts the stem of the screw is 4 mm. The outer diameter of the post of screw hole 1202*c* is 11 mm. The height of the post 1206 of screw hole 1202*c* is 10 mm.

Figure 12E:
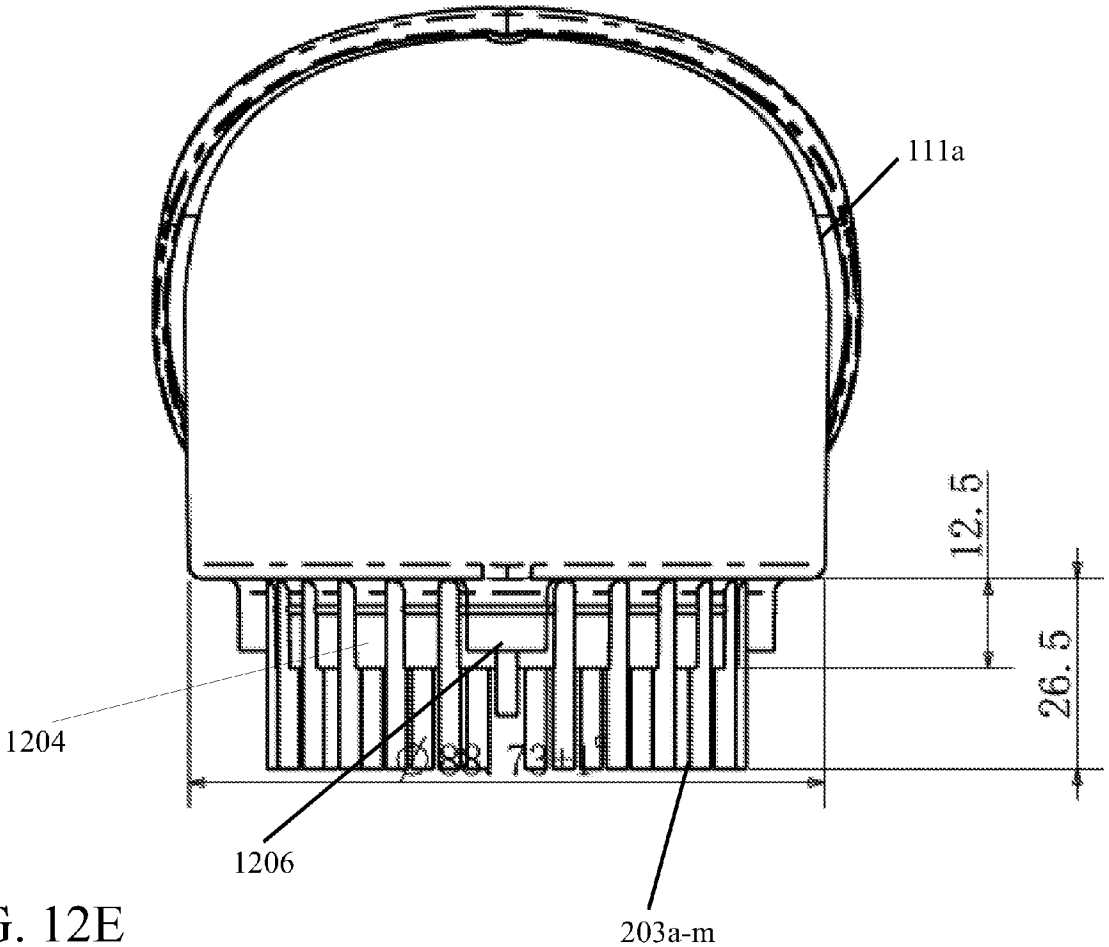

FIG. 12E is a bottom view 1200*e* of an embodiment of discharge mount 111*a*. The outer width of the end of discharge mount 111*a* that faces the pump is 88.73 mm. The protective rods 203*a-m* extend 26.5 mm behind the back of discharge mount 111*a*. The base of protective rods 203*a-m* may be attached to collar 1204. Collar 1204 may protrudes 12.5 mm behind the back of discharge mount 111*a*.

Figure 12F:
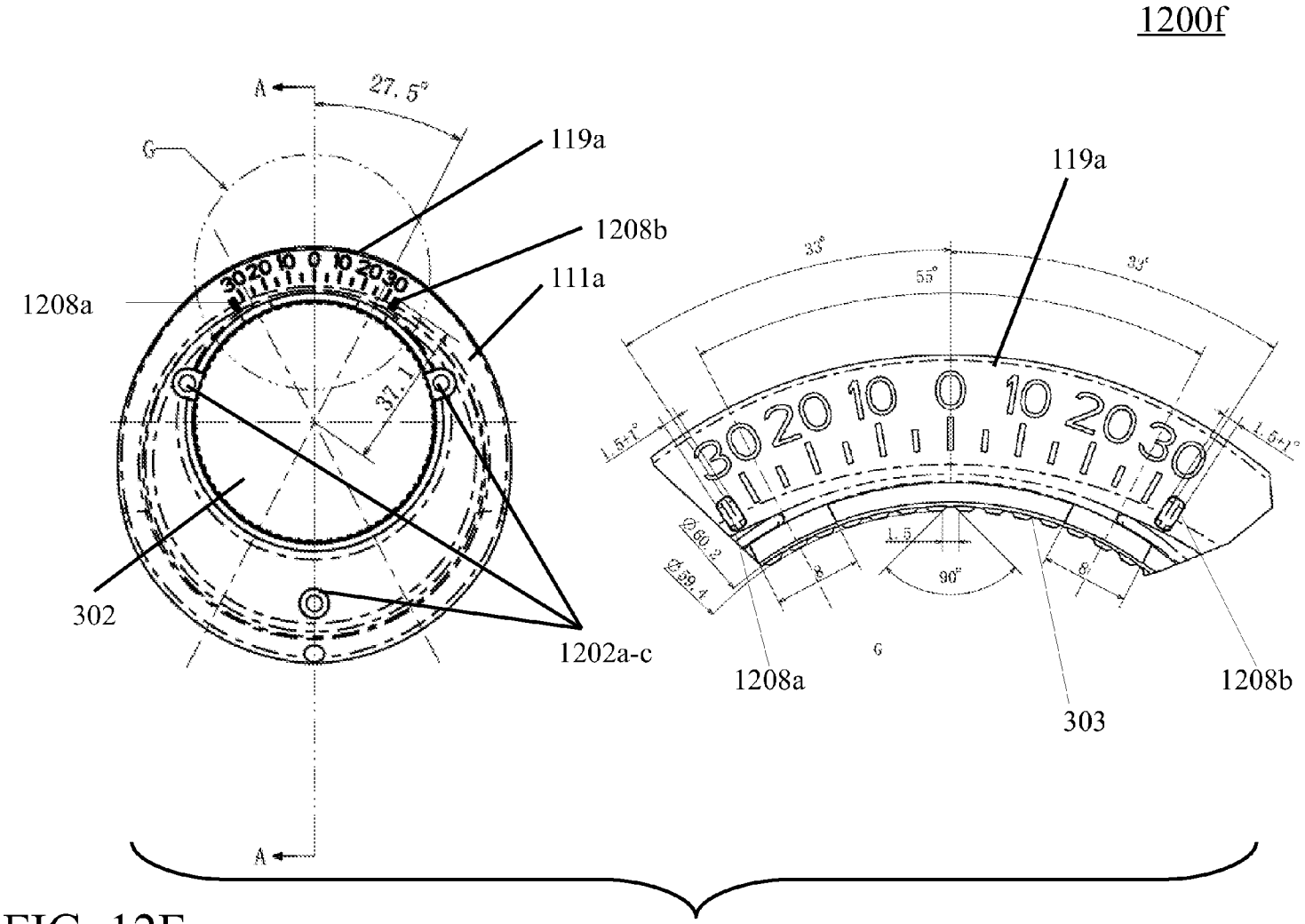

FIG. 12F shows details associated with rotation markings 119*a*. Tabs 1208*a* act as stops limiting the angle that neck portion 130*a* can rotate. The end of tabs 1208*a* and 1208*b* that is distal from the center of opening 302 are each 37.1 mm from the center of opening 302. The right side of FIG. 12F shows an enlarged view of detail G of the left side of FIG. 12F. The Tabs 1208*a* and 1208*a* may be 1.5 mm wide. The angle between the edges of tab 1208*a* and 1208*b* that are closest to the zero marking and the center of the zero marking is 33 degrees. The angle between the center of the zero of the marking "30" on the left and center of the 3 of "30" on the right is 55 degrees. The gap between the tops of the bumps 303 is 1.5 mm. The inner radius of opening 302 to the bottom of bumps 303 is 60.2 mm. The inner radius of opening 302 to the top of bumps 303 is 59.4 mm. In other words each bump 303 may be (60.2 mm-59.4 mm)/2=0.4 mm high. The angle formed by the two sidewalls that face one another of two adjacent bumps (of bumps 303) is 90 degrees.

Figure 13A:
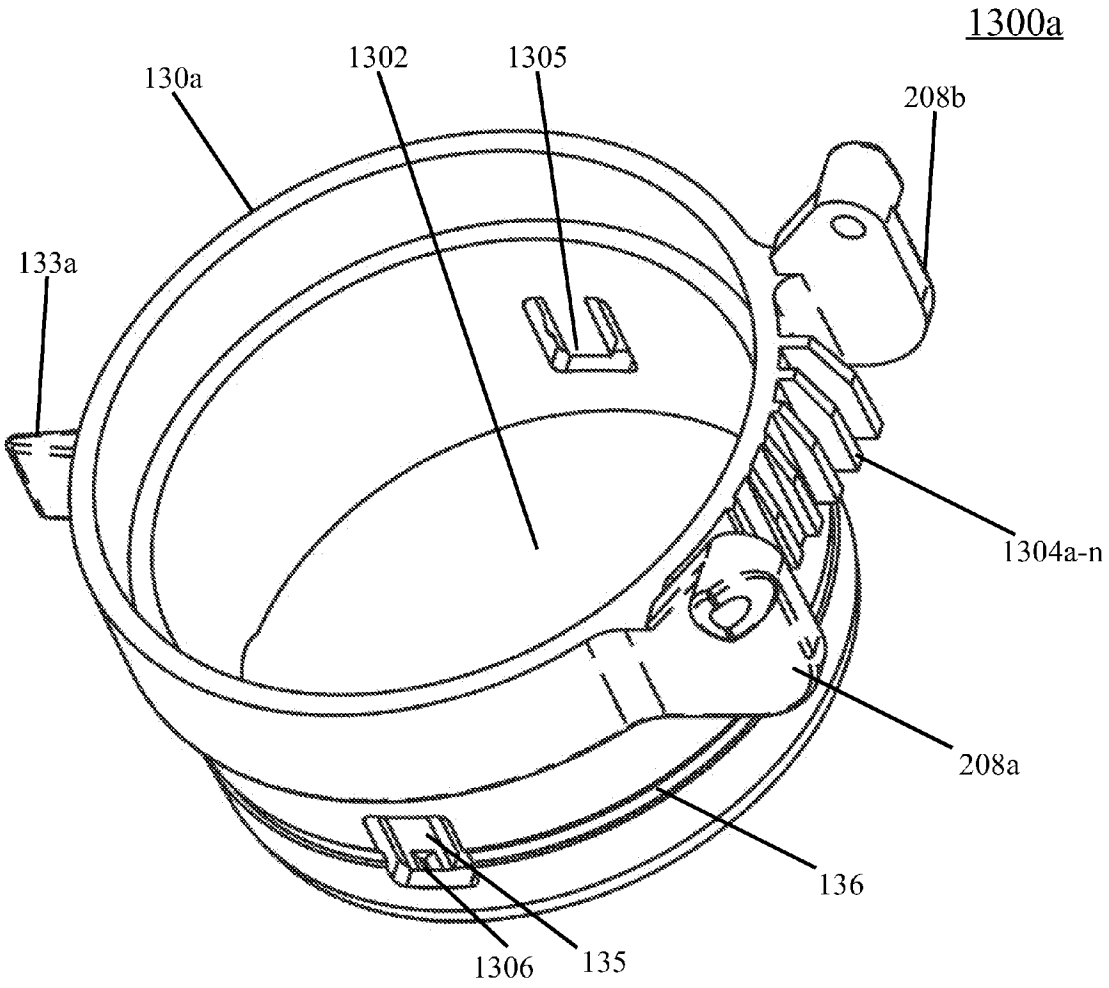
FIG. 13A shows a diagram of an embodiment of the neck portion of FIG. 1A.

FIG. 13A shows a diagram 1300*a* of an embodiment of the neck portion 130*a* of FIG. 1A. FIG. 13A includes at least neck portion 130*a*, indicator tab 133*a*, tab 135, groove 136, and pivot mounts 208*a* and 208*b*, which were discussed in conjunction with FIGS. 1A and 1B. FIG. 13A may also include at least discharge opening 1302, a plurality of tabs 1304*a-n*, a tab 1305, and a bump 1306. In other embodiments, FIG. 13A may not have all of the elements or features listed and/or may have other elements or features instead of or in addition to those listed.

Discharge opening 1302 is the opening of neck portion 130*a* through which water is pushed out of the pool cleaner 100*a*. In at least one embodiment, discharge opening 1302 is kept closed by flap 133*a* until flap 133*a* is pushed open by water when the propeller 160 starts rotating.

Tabs 1304*a-n* are tabs or fins located between the pivot mounts 208*a* and 208*b*, protruding from the outside wall of neck portion 130*a* and parallel to the axis of the neck portion 130*a*. In at least one embodiment, tabs 1304*a-n* are of different heights for blocking the sliding stop 202 in different extends so that to allow the flap 131*a* to open in different angles. In at least one embodiment, the location of each of the tabs 1304*a-n* corresponds to the location of each number in the flap markings 205. For example, the tab with smallest height thus least blockage corresponds to the largest open angle (90 degrees) in the flap markings 205, while the tab with largest height thus maximum blockage corresponds to the smallest open angle (65 degrees). In other embodiments, other structures may be substituted to allow adjusting the flap 131*a* to open in different angles. Tab 1305 is similar to the tab 135. Tab 1305 is on the other side across the neck portion 130*a*.

Bump 1306 is a bump protruding from the tab 135 facing away from the discharge opening 1302. In at least one embodiment, the bump 1306 of the tab 135 is mechanically biased to insert bump 1306 between two of the bumps 303 on the inside surface of the collar 1204, so that the neck portion 130*a* stays in a predetermined rotational angle until the user rotates the neck portion 130*a* to another angle, ratcheting neck portion 130*a* from one angle to another angle. In at least one embodiment, tab 1305 also includes a bump facing away from the discharge opening 1302.

FIGS. 13B-G show diagrams showing the dimensions of different elements of an embodiment 1300 of the neck portion 130*a*. Embodiment 1300 may include at least one of neck portion 130*a*, indicator tab 133*a*, tab 135, groove 136, pivot mounts 208*a* and 208*b*, discharge opening 1302, tabs 1304*a-n*, and tab 1305. Embodiment 1300 may further include a spring stop 1308. In other embodiments, neck portion 130*a* may not have all of the elements or features listed and/or may have other elements or features instead of or in addition to those listed.

Figure 13B:
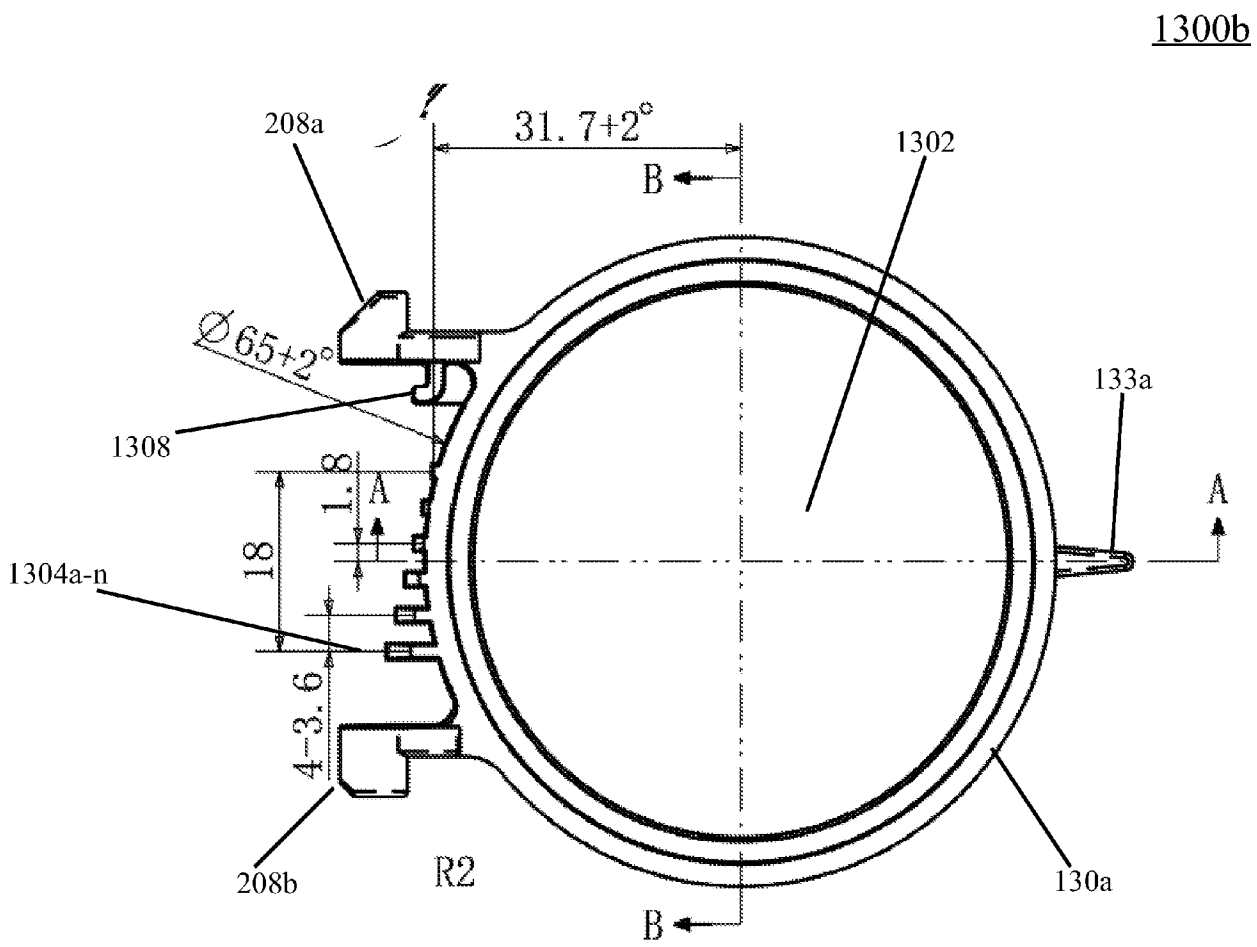
FIGS. 13B-G show diagrams of an embodiment of the dimensions of different elements of the neck portion of FIG. 1A.

FIG. 13B shows a front view 1300*b* of the neck portion 130*a*. The outside diameter of the neck portion 130*a* is 65 mm. The distance from the center of the shortest tab to the center of the tallest tab is 18 mm. The centers of two adjacent tabs are about 4 mm to 3.6 mm apart. The top edge of the shortest tab is 31.7 mm away from the cutline B-B. The cutline A-A is 1.8 mm from the center of the tab adjacent to the cutline A-A.

FIG. 13B may further include a spring stop 1308. Spring stop 1308 is a tab for holding the spring 207 in place and stopping spring 207 from sliding towards the flap 131*a*. Spring 207 pushes against spring stop 1308, mechanically biasing spring 207 to hold flap 131*a* closed until water exiting pool cleaner 100*a* pushes flap 131*a* open.

Figure 13C:
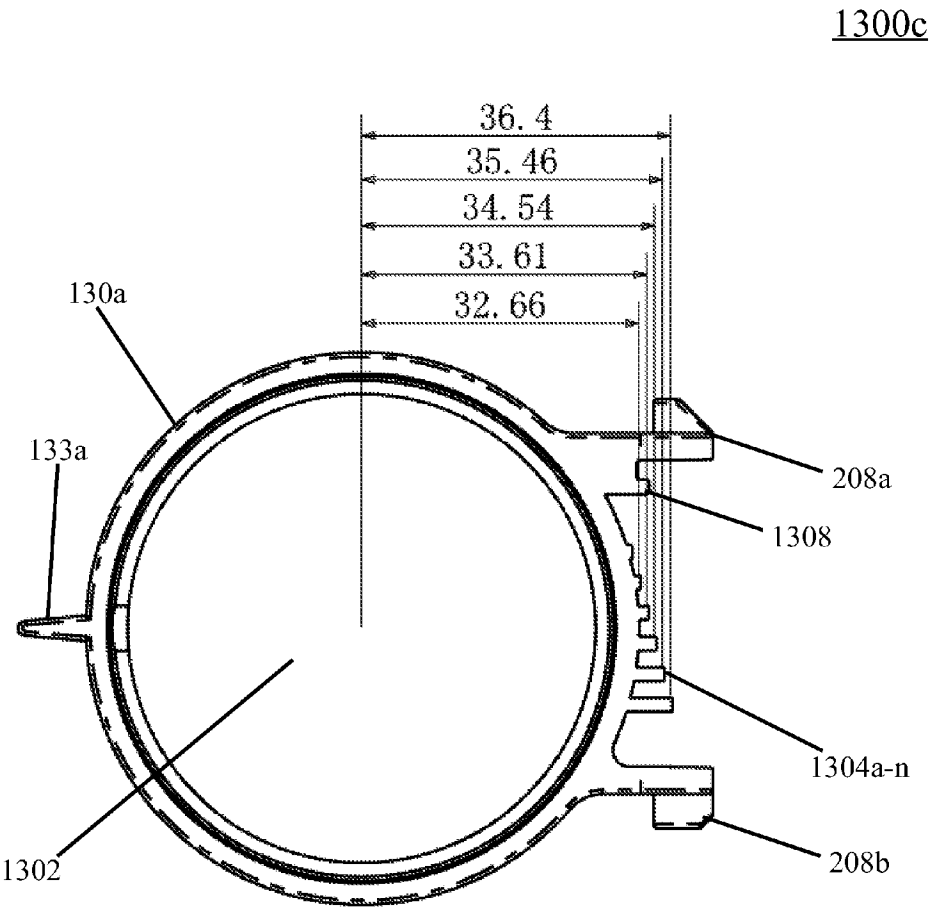

FIG. 13C shows a back view 1300*c* of the neck portion 130*a*. The distances from cut line B-B (as shown in FIG. 13B) to the top edges of the tabs 1304*a-n*, from the second shortest to the tallest, are 32.66 mm, 33.61 mm, 34.54 mm, 35.46 mm, and 36.4 mm, and have a period of 1.8 mm. In an embodiment, the distance between the center of the first and tallest of tabs 1304*a-n* and the center of the last and shortest of tabs 1304*a-n* is 18 mm. In an embodiment, the distance between the centers of the two tallest of tabs 1304*a-n* is 4 mm.

Figure 13D:
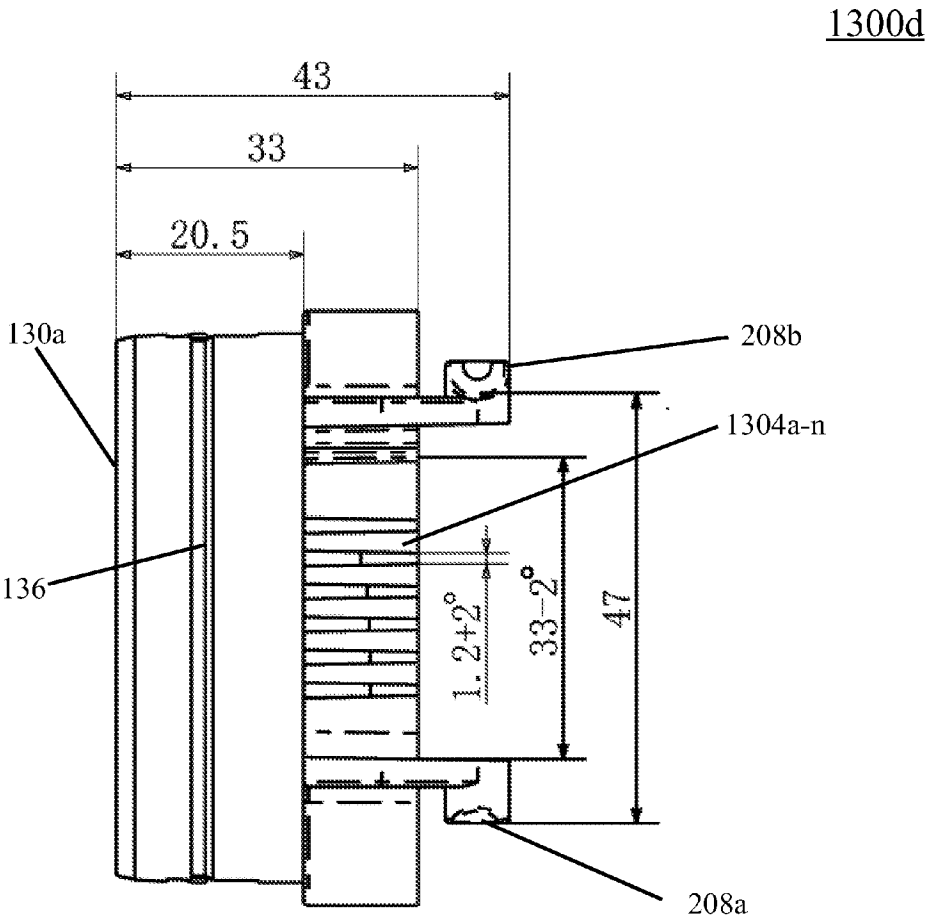

FIG. 13D shows a side view 1300*d* of the neck portion 130*a* parallel to the cutline B-B. The tabs 1304*a-n* are 1.2 mm wide at the top, and have a half period of 1.8 mm (and are thus 1.2 mm apart at the top of tabs 1304*a-n*). The portion of the neck portion 130*a* that fits into the circular opening 302 of discharge mount 111*a* is 20.5 mm tall. The portion of the neck portion 130 that meets the circular opening 302 is (33−20.5=12.5 mm) 12.5 mm tall. The distance from the distal edge of pivot mount 208*b* to the edge of the neck portion 130*a* facing away from the pivot mounts 208*a-b* is 43 mm.

The inner side of pivot mount 208*a* is 33 mm apart from the spring stop 1308. The pivot mounts 208*a* and 208*b* are 47 mm apart.

Figure 13E:
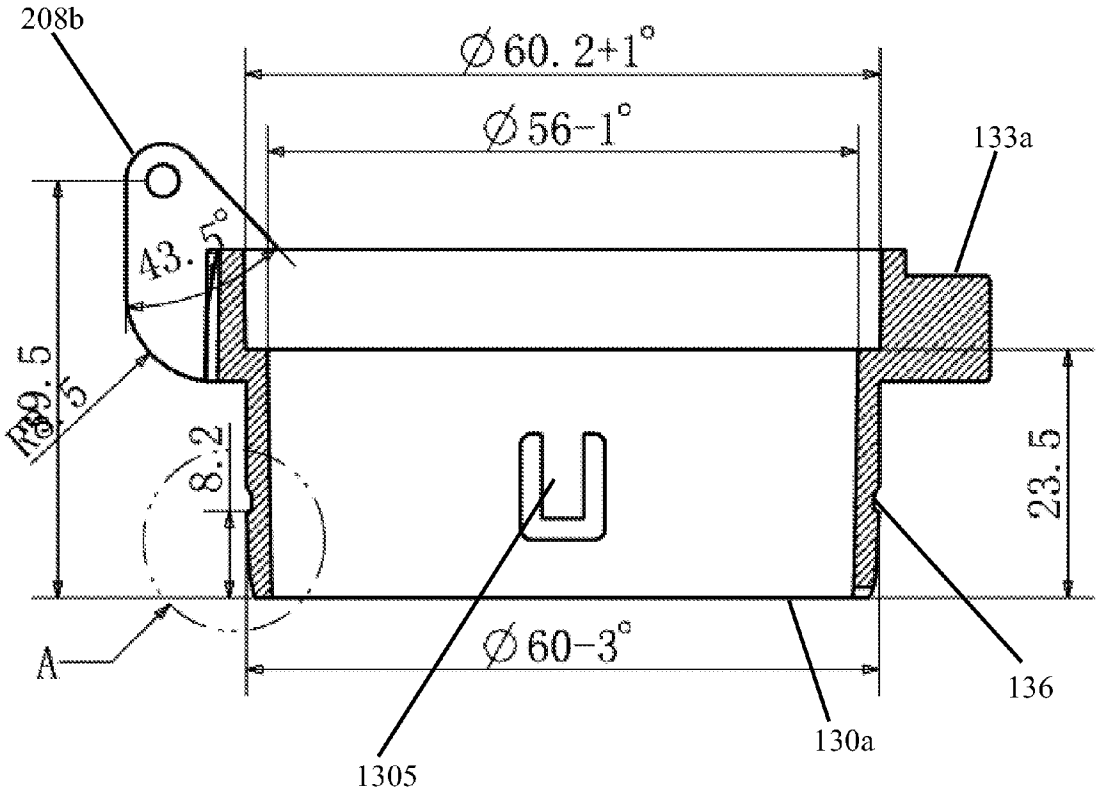

FIG. 13E shows a cross sectional side view 1300*e* of the neck portion 130*a* taken along cutline A-A. The portion of neck portion 130*a* that fits into the discharge mount 111*a* has an outer diameter of 60 mm and an inner diameter of 56 mm. The portion of neck portion 130*a* that meets circular opening 302 of discharge mount 111*a* has an inner diameter of 60.2 mm. The inner edge of the portion that fits into the discharge mount 111*a* is 23.5 mm away from the side of the neck portion 130*a* facing away from the pivot mount 208*b*. The angle of the rounded distal edge of pivot mount 208*b* is 43.5 degrees. The hole of pivot mount 208*b* through which the pivot 134 goes is 39.5 mm away from the side of the neck portion 130*a* facing away from the pivot mount 208*b*. The edge of the groove 136 is 8.2 mm away from the side of the neck portion 130*a* facing away from the pivot mount 208*b* (as shown in detail A).

Figure 13F:
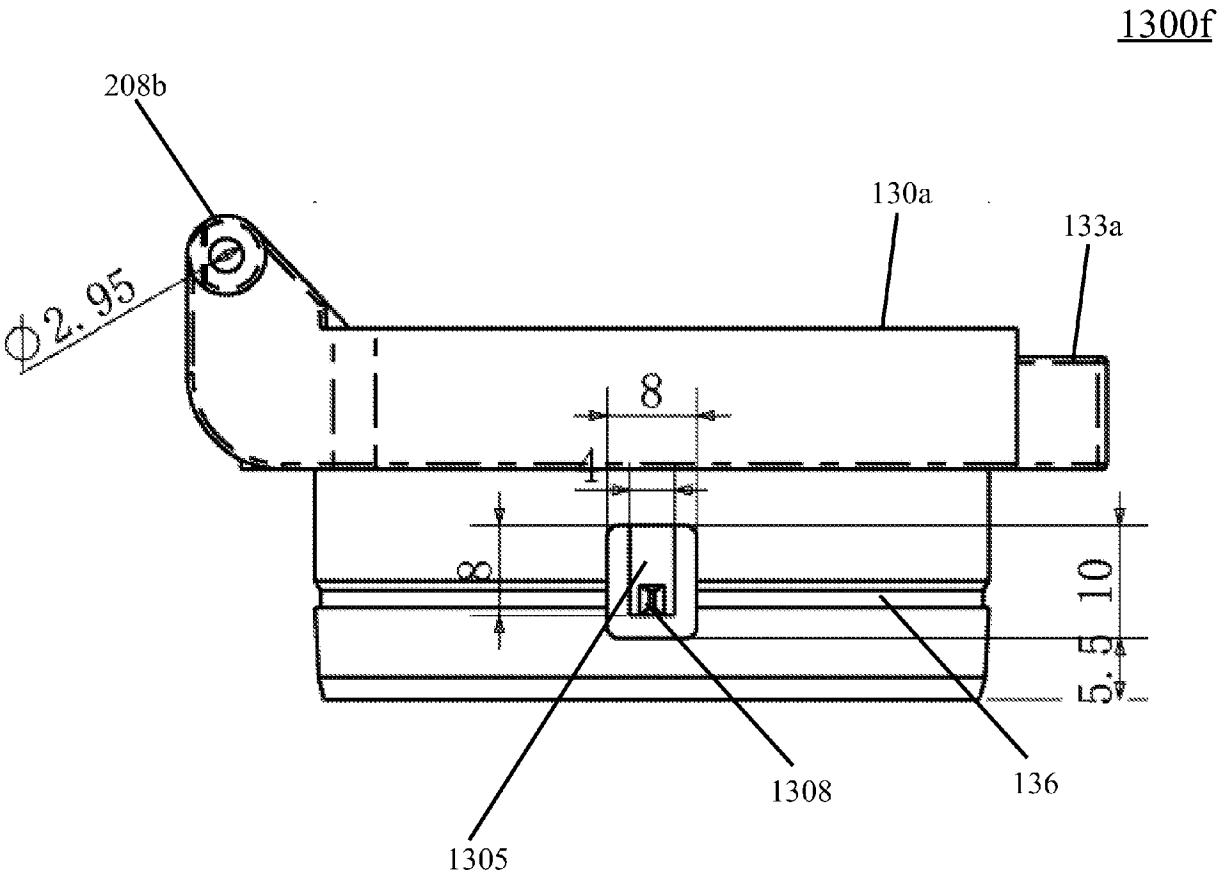

FIG. 13F shows a side view 1300*f* of the neck portion 130*a* parallel to the cutline A-A. The diameter of the hole in pivot mount 208*b* is 2.95 mm. The tab 1305 is 8 mm tall and 4 mm wide. Tab 1305 is located in a rectangular opening that is 10 mm tall and 8 mm wide, the bottom edge of which is 5.5 mm apart from the side of neck portion 130*a* facing away from the pivot mount 208.

Figure 13G:
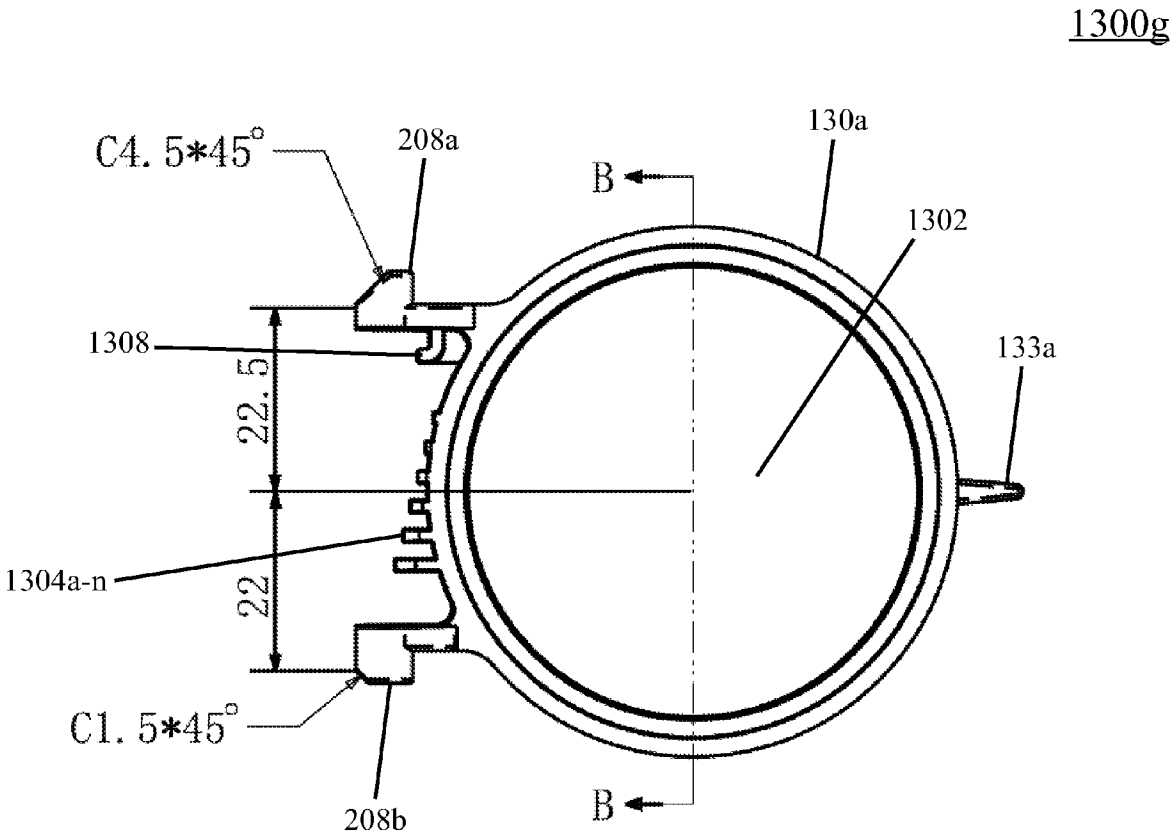

FIG. 13G shows another top view 1300*g* of neck portion 130*a*. The pivot mount 208*a* has a slant edge of 4.5 mm wide and 45 degrees from the plane of pivot mount 208*a*. The pivot mount 208*b* has a slant edge of 1.5 mm wide and 45 degrees from the plane of pivot mount 208*b*. The distance between the slant edges of pivot mounts 208*a* and 208*b* is (22+22.5=44.5 mm) 44.5 mm.

It should be understood that modifications may be made without departing from the essential teachings of the invention. The dimensions shown in FIGS. 12C-F and FIGS. 13B-G may have a tolerance of 10%. Of course, components that are intended to fit snugly within one another need to vary together so that those components still fit within one another, snugly. In other embodiments other dimensions may be used that are outside of the 10% tolerances of the dimensions.

Figure 14:
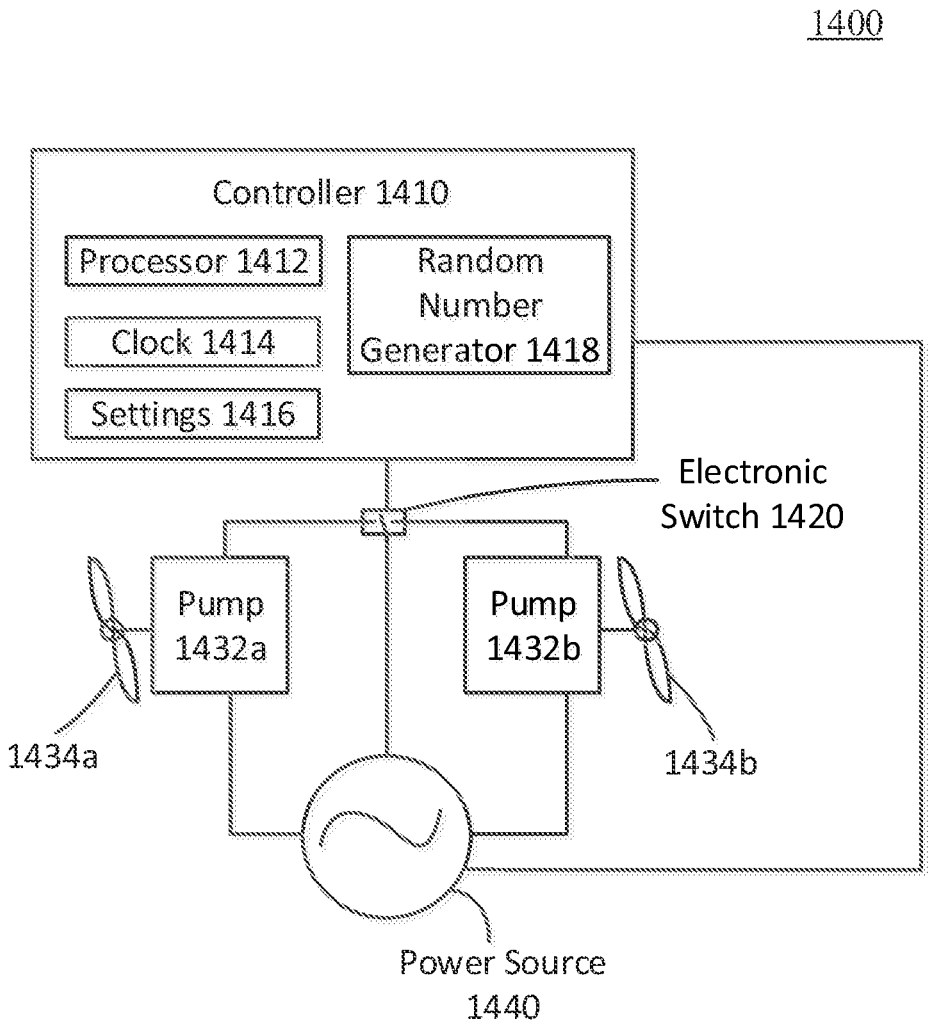
FIG. 14 shows a diagram of an embodiment of a circuit for powering the two pumps of FIG. 1A.

FIG. 14 shows a diagram 1400 of an embodiment of a circuit for powering the two pumps. FIG. 14 includes at least a controller 1410, which includes at least a processor 1412, a clock 1414, settings 1416, and a random number generator 1418. FIG. 14 may further include an electronic switch 1420, two pumps 1432*a* and 1432*b*, two propellers 1434*a* and 1434*b*, and a power source 1440. In other embodiments, FIG. 14 may not have all of the elements or features listed and/or may have other elements or features instead of or in addition to those listed.

FIG. 14 shows a system for controlling an electronically controlled switch connected to a controller for switching electricity flow to either of two pumps alternatively, one at a time, to change the direction of travel of the pool cleaner 100*a*. In at least one embodiment, at least one of the elements shown in FIG. 14 is included in the control circuit 505.

Controller 1410 includes one or more circuits and/or algorithms for controlling switching transmission of electricity at random times, or after one pump is working for a period that is randomly set. In at least one embodiment, the two pumps are alternatively turned on under the control of controller 1410 causing pool cleaner 100*a* to move in zigzag routes. In other embodiments, controller 1410 may include other settings or other structures for controlling the electricity for powering the two pumps.

Processor 1412 may include any one of, some of, any combination of, or all of multiple parallel processors, a single processor, a system of processors having one or more central processors and/or one or more specialized processors dedicated to specific tasks. In at least one embodiment, processor 1412 may implement machine instructions stored in a memory system, such as determining when to switch the transmission of electricity from one pump to the other based on current time and numbers generated randomly, or based on user chosen settings.

Clock 1414 is a circuit that produces a timing signal that may be used by the processor 1412 to determine, in combination with settings and/or a random number generator, the time to switch the transmission of electricity.

Settings 1416 include various settings and/or parameters that may be input and/or chosen by the user (or preset prior to giving pool cleaner 100*a* to the user) for controlling switching the transmission of electricity. In at least one embodiment, the user and/or manufacturer may input one or more settings into controller 1410, such as one or more dimensions of the pool (which may be used to compute how long, or how long on average, to keep the pool cleaner 100*a* moving in a particular direction prior to switching directions and how long to spend cleaning the pool). Optionally, the user may be able to directly input or choose from settings 1416 the average length of time that each pump should remain on prior to switching directions by changing which pump is on and which pump is off and may be able to input how long to keep the pool cleaner 100*a* before shutting off the pool cleaner 100*a*.

Random number generator 1418 is a computational or physical device designed to generate a sequence of numbers that lack any pattern. In at least one embodiment, random number generator 1418 may be used to determine the period of time for which a pump is kept on prior to switching directions.

Electronic switch 1420 is an electronic component or device that can switch an electrical circuit, diverting electric current from one conductor to another, such as a transistor, relay, avalanche diode, or other threshold device. In at least one embodiment, electronic switch 1420 serves to switch the transmission of electricity to either of the two pumps, under the control of controller 1410.

Pumps 1432*a* and 1432*b* are similar to pumps 211*a* and 211*b*, which were discussed in conjunction with FIG. 2A. Propellers 1434*a* and 1434*b* are similar to propellers 160 and 460, which were discussed in conjunction with FIGS. 1B and 4. Power source 1440 serves to provide electrical power to the motors of the two pumps 1434*a* and 1434*b*. In at least one embodiment, power source 1440 may include an AC outlet or storage devices such as a batteries and fuel cells.

Alternatives and Extensions

In an alternative embodiment, pool cleaner 100*a* maybe battery powered. In an embodiment, a power supply may be carried within pool cleaner 100*a*, and pool cleaner 100*a* may not have a power cord 150. In an alternative embodiment, the wheels are not in the corners, but elsewhere. In another embodiment, there are more than 4 wheels. In an embodiment, instead of there being 4 wheels, there are 2 wheels on each side of pool cleaner 100*a*, there may be one wheel on each end of the pool cleaner 100*a*. In an embodiment, wheels 140 may be replaced with rollers, ball bearings, or treads. In an alternative embodiment, instead of always keeping one of pumps 211*a* and 211*b* off and the other on, and alternating which is off and which is on to change directions, both pumps 211*a* and 211*b* are always on. However, one of the two pumps 211*a* and 211*b* is set to a higher setting (e.g., by sending a higher current or by applying a higher voltage to that pump)

than the other, so that there is a net force pushing the pool cleaner 100*a* in the opposite direction as the water discharging from the pump with the higher setting. Which pump has the higher setting is changed to change the direction of travel of the pool cleaner 100*a*. In an alternative embodiment of FIG. 9, any one or any combination of the four pumps of pool cleaner 900 may be turned on at any given time.

Each embodiment disclosed herein may be used or otherwise combined with any of the other embodiments disclosed. Any element of any embodiment may be used in any embodiment.

Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention. Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps; and a filter for filtering out debris in water;

wherein when the first pump is turned on, water passes through the filter, filtering the water creating filtered water within the device, the filtered water from within the device exiting the device in a vicinity of the first discharge opening, the exiting filtered water creating propulsion, pushing the device in a first direction, wherein when the second pump is turned on, water passes through the filter, filtering the water, the filtered water exiting the device in a vicinity of the second discharge opening, the exiting filtered water creating propulsion, pushing the device in a second direction, the first direction being different from the second direction;

wherein what direction the filtered water exits at least one of the first discharge opening and second discharge opening is adjustable; wherein a direction and speed of the device are adjustable by adjusting what direction the filtered water exits the device, wherein the direction the filtered water exits the device is partly upward with respect to a plane parallel to a surface that the device travels upon.

2. The device of claim 1, further comprising a pump chamber having two ends, each end being connected to a housing of one of the two pumps, the controller being located inside the pump chamber, and each pump includes a propeller that is located outside of the pump chamber, the two pumps facing different directions.

3. The device of claim 2, wherein the pump chamber is water-tight preventing water from coming inside the pump chamber.

4. The device of claim 1, wherein the controller being configured to turn each of the two pumps on for random periods of time.

5. The device of claim 1, wherein the first discharge opening is associated with a first adjustable surface; the direction of the filtered water exiting the first discharge opening being adjustable by adjusting the first adjustable surface, the first adjustable surface facing partly upward when pushed by the exiting water, and the second discharge opening is associated with a second adjustable surface; the direction of the filtered water exiting the second discharge opening being adjustable by adjusting the second adjustable surface, the second adjustable surface facing partly upward when pushed by the exiting water.

6. The device of claim 1, further comprising at least two flaps that are pivotally connected to the discharge openings, the flaps having a spring mechanically biasing the flaps to stay closed to cover the discharge openings until being pushed open by water exiting the pumps of the device;

wherein the flaps open facing partly upward when pushed by the exiting water.

7. The device of claim 1, the filtered water exits the device at a first degree with respect to the plane parallel to the surface that the device travels upon, the first degree being adjustable, wherein the filtered water exits the device at a second degree with respect to a plane perpendicular to the surface that the device travels upon, the second degree being adjustable.

8. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps;

a filter for filtering out debris in water;

two discharge mounts being circular, the two pumps being attached to the two discharge mounts; and the two pumps having at least two propellers, each pump having at least one of the two propellers, the two propellers of the two pumps being positioned facing outside of the housing, the two discharge mounts being mechanically coupled to the two pumps inside the body, the two propellers being positioned in the circular discharge mounts, the two discharge mounts being located in, and mechanically coupled to, the two discharge openings, the two pumps being connected to the two discharge mounts from inside of the housing;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, wherein a direction and speed of the device are adjustable by adjusting what direction the water exits the device.

9. A device comprising;

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps; and a filter for filtering out debris in water;

at least two neck portions; and at least two flaps that are pivotally connected to the two neck portions, the flaps having a spring mechanically biasing the flaps to stay closed to cover openings in the neck portions until being pushed open by water exiting the pumps of the device, the water exiting each pump pushing one of the at least two flaps open to no more than a maximum angle regardless of how fast the water exits;

wherein the maximum angle to which at least one of the at least two flaps is capable of opening is adjustable;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction; wherein a direction and speed of the device are adjustable by adjusting what direction the water exits the device.

10. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps; and a filter for filtering out debris in water; and a movable stop that is movable to different positions, wherein the movable stop interferes with opening a flap, wherein moving the movable stop to different positions adjusts a maximum angle to which the flap opens when being pushed by water exiting the device;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, wherein a direction and speed of the device are adjustable by adjusting what direction the water exits the device.

11. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps;

a filter for filtering out debris in water;

a movable stop that is movable to different positions, wherein the movable stop interferes with opening a flap, wherein moving the movable stop to different positions adjusts a maximum angle to which the flap opens when being pushed by water exiting the device; and flap markings marking positions of the flap, the flap markings indicating, based on positions of the flap, angles to which the flap opens when pushed by water exiting the body;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, wherein a direction and speed of the device are adjustable by adjusting what direction the water exits the device.

12. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps; and a filter for filtering out debris in water;

at least two neck portions that are rotatable while fully assembled and connected to the housing, each of the at least two neck portions being associated with one of the at least two discharge openings; and flaps connected to the neck portions, wherein the flaps rotate with the rotations of the neck portions;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, wherein a direction and speed of the device are adjustable by adjusting what direction the water exits the device.

13. The device of claim 12, further comprising covers fitted in the neck portions preventing objects from getting in contact with the pumps, each cover having a plurality of openings through which water passes.

14. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps;

a filter for filtering out debris in water;

neck portions that are rotatable, the neck portions being connected to the housing and associated with the discharge openings;

flaps connect to the neck portions that rotate with the rotations of the neck portions; and rotation markings indicating an angle of a rotational angle at which the neck portions are set;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, wherein a direction and speed of the device are adjustable by adjusting what direction the water exits the device.

15. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for power to the two pumps;

a controller that automatically controls activating the two pumps;

a filter for filtering out debris in water; and a pump chamber having two ends, each end being connected to a housing of one of the two pumps, the controller being located inside the pump chamber, and each pump includes a propeller that is located outside of the pump chamber, wherein the two ends of the pump chamber are tilted upwards at an angle;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, wherein a direction and speed of the device are adjustable by adjusting what direction the water exits the device.

16. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps; and a filter for filtering out debris in water;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, wherein a direction and speed of the device are adjustable by adjusting what direction the filtered water exits the device, wherein the direction the filtered water exits the device is partly upward with respect to a plane parallel to a surface that the device travels upon, wherein what direction the filtered water exits at least one of the first discharge opening and second discharge opening is adjustable;

wherein the device does not include a conduit for carrying a flow of water that is propelled by at least one of the two pumps.

17. The device of claim 16, wherein the direction of travel of the filtered water, after the filtered water exits the device, being generally upward being at an acute angle, greater than zero, with respect to a plane parallel to a surface that the device travels upon.

18. The device of claim 16, further comprising a timer circuit for controlling a time period that each of the two pumps is on.

19. The device of claim 16, wherein an average density of the device is greater than or equal to the density of water.

20. The device of claim 16, wherein the body includes a head and a base that are pivotally attached at one end, allowing the head to open without detaching from the base.

21. The device of claim 16, wherein the water, without being carried in a conduit, exits the device at an acute angle, greater than zero away from the plane parallel to the surface that the device travels upon.

22. The device of claim 16, wherein each of the at least two discharge openings is covered by a flap, the flap being a one-way valve allowing water to exit the housing, wherein the flap opens facing partly upward when pushed by the exiting water.

23. The device of claim 16, wherein the device is cordless.

24. The device of claim 16, wherein when the controller is on, the controller turns each of the two pumps on for random periods of time.

25. A method of operating a device; the device including at least a housing of a body, the housing including at least two discharge openings, a first discharge opening of the two discharge openings is on a first side of the body and a second discharge opening of the two discharge openings is on a second side of the body;

two pumps being affixed inside the body for drawing water from within the body and pushing the water out of the body through the discharge openings, a first pump of the two pumps being associated with the first discharge opening and a second pump of the two pumps being associated with the second discharge opening;

the method comprising:

providing power to the two pumps from a power source;

automatically activating, by a controller, each of the two pumps;

the automatically activating including at least turning on one of the two pumps;

causing, by the one of the two pumps, water to pass through a filter, filtering out debris in water;

causing, by the one of the two pumps, filtered water to exit the device in a vicinity of one of the two discharge openings associated with one of the two pumps;

creating propulsion, by the one of the two pumps, by the filtered water exiting the device in a first direction in which water exits, which causes the device to travel in a first direction of travel;

turning off the one of the pumps and turning on another of the pumps;

causing, by the other of the two pumps, water to pass through the filter, filtering out debris in water;

causing, by the other of the two pumps, filtered water to exit the device in a vicinity of the other of the two discharge openings associated with the other of the two pumps;

creating propulsion, by the other of the two pumps, by the filtered water exiting the device in a second direction in which water exits, which causes the device to travel in a second direction of travel, and wherein the first direction of travel and speed of the device while traveling in the first direction of travel is adjustable by adjusting what direction is the first direction in which water exits the device, wherein the direction the filtered water exits the device is partly upward with respect to a plane parallel to a surface that the device travels upon, wherein what direction the filtered water exits at least one of the first discharge opening and second discharge opening is adjustable.

26. A method for assembling a device, comprising providing a housing of a body of the device, the housing being formed with at least two discharge openings, a first discharge opening of the two discharge openings is on a first side of the body and a second discharge opening of the two discharge openings is on a second side of the body;

affixing two pumps inside the body for drawing water from within the body and pushing the water out of the body through the two discharge openings, a first pump of the two pumps being associated with the first discharge opening and a second pump of the two pumps being associated with the second discharge opening;

connecting a power cable to the two pumps for providing power to the two pumps;

connecting a controller inside the body that automatically controls activating the two pumps; and connecting a filter inside the body for removing debris from water;

wherein when the first pump is turned on, water passes through the filter inside the body, filtering the water, the water exiting the device in a vicinity of the first discharge opening, the water exiting the device being exiting filtered water, the exiting filtered water creating propulsion, pushing the device in a first direction, wherein when the second pump is turned on, water passes through the filter inside the body, filtering the water, the water exiting the device in a vicinity of the second discharge opening, the exiting filtered water creating propulsion, pushing the device in a second direction, wherein a direction and speed of the device are adjustable by adjusting what direction the water exits the device, wherein the direction the filtered water exits the device is partly upward with respect to a plane parallel to a surface that the device travels upon wherein what direction the filtered water exits at least one of the first discharge opening and second discharge opening is adjustable.

27. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps; and a filter for filtering out debris in water;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, and wherein a direction and speed of the device are adjustable by adjusting what direction the water exits the device, wherein the direction the filtered water exits the device is not downward with respect to a plane parallel to a surface that the device travels upon, wherein what direction the filtered water exits at least one of the first discharge opening and second discharge opening is adjustable, wherein the device does not have any conduit inside the housing for carrying a flow of water that is propelled by at least one of the two pumps.

28. A device comprising:

a housing of a body, the housing including at least two discharge openings, a first discharge opening of the two discharge openings is on a first side of the body and a second discharge opening is on a second side of the body, the housing having only one intake opening, which is located at the bottom of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps; and a filter for filtering out debris in water;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, and wherein a direction and speed of the device are adjustable by adjusting what direction the water exits the device, wherein the direction the filtered water exits the device is partly upward with respect to a plane parallel to a surface that the device travels upon, wherein what direction the filtered water exits at least one of the first discharge opening and second discharge opening is adjustable.

29. A device comprising:

a housing of a body, the housing including at least two discharge openings, a first discharge opening of the two discharge openings is on a first side of the body and a second discharge opening is on a second side of the body;

two pumps being affixed inside the body for drawing water from within the body and pushing the water out of the body through the two discharge openings, a first pump of the two pumps being associated with the first discharge opening and a second pump of the two pumps being associated with the second discharge opening;

a power source for providing power to the two pumps;

a controller that automatically controls activating the two pumps;

a filter for filtering out debris in water; and at least two neck portions being two collars connected to the at least two pumps, each collar being located at one of the at least two discharge openings;

wherein when the first pump is turned on, water passes through the filter, filtering the water, the water exiting the device in a vicinity of the first discharge opening, the exiting water creating propulsion, pushing the device in a first direction, wherein when the second pump is turned on, water passes through the filter, filtering the water, the water exiting the device in a vicinity of the second discharge opening, the exiting water creating propulsion, pushing the device in a second direction, wherein a direction and speed of the device are adjustable by adjusting what direction the water exits the device;

wherein the device does not include a conduit for carrying a flow of water that is propelled by at least one of the two pumps.

* * * * *